US012751595B2

(12) United States Patent
Choi et al.

(10) Patent No.: US 12,751,595 B2
(45) Date of Patent: Oct. 6, 2026

(54) ROBOT CLEANER

(71) Applicant: SAMSUNG ELECTRONICS CO., LTD., Suwon-si (KR)

(72) Inventors: Hongseok Choi, Suwon-si (KR); Elijah Kim, Suwon-si (KR); Juyeong Kim, Suwon-si (KR); Jiwon Ryu, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 393 days.

(21) Appl. No.: 18/535,418

(22) Filed: Dec. 11, 2023

(65) Prior Publication Data

US 2024/0237866 A1 Jul. 18, 2024

Related U.S. Application Data

(63) Continuation of application No. PCT/KR2023/019577, filed on Nov. 30, 2023.

(30) Foreign Application Priority Data

Jan. 13, 2023 (KR) ..... 10-2023-0005478
Mar. 6, 2023 (KR) ..... 10-2023-0029381

(51) Int. Cl.
*A47L 11/282* (2006.01)
*A47L 13/16* (2006.01)

(52) U.S. Cl.
CPC ..... *A47L 11/282* (2013.01); *A47L 13/16* (2013.01); *A47L 2201/00* (2013.01)

(58) Field of Classification Search
CPC ..... A47L 13/16; A47L 11/40; A47L 11/24; A47L 11/282; A47L 11/283; A47L 2201/00
See application file for complete search history.

(56) References Cited

U.S. PATENT DOCUMENTS

| | | | |
|---|---|---|---|
| 9,717,388 | B2 | 8/2017 | Jeong et al. |
| 11,667,041 | B2 | 6/2023 | Kim et al. |
| 2019/0191952 | A1 | 6/2019 | Johnson et al. |
| 2020/0139561 | A1 | 5/2020 | Kim et al. |
| 2022/0079406 | A1 | 3/2022 | Zhang et al. |

(Continued)

FOREIGN PATENT DOCUMENTS

| | | | |
|---|---|---|---|
| CN | 113786133 | A | 12/2021 |
| CN | 215502788 | U | 1/2022 |

(Continued)

OTHER PUBLICATIONS

International Search Report issued on Feb. 23, 2024 for International Application No. PCT/KR2023/019577.

(Continued)

*Primary Examiner* — Shay Karls
(74) *Attorney, Agent, or Firm* — STAAS & HALSEY LLP

(57) ABSTRACT

A robot cleaner includes a housing; a motor in the housing; a separation driver including a stopper configured to vertically move up and down; and a cleaning cloth module including a first member including a stopper insertion hole into which the stopper is insertable, and an attaching member to which a cleaning cloth is detachably couplable, and a second member configured to be rotated by the motor, and positioned between the first member and the cleaning cloth to be coupled and separably coupled with the first member.

20 Claims, 41 Drawing Sheets

(56) References Cited

U.S. PATENT DOCUMENTS

| | | | |
|---|---|---|---|
| 2022/0225854 | A1 | 7/2022 | Johnson et al. |
| 2022/0248933 | A1 | 8/2022 | Zhang et al. |
| 2023/0172418 | A1 | 6/2023 | Zhang et al. |

FOREIGN PATENT DOCUMENTS

| | | | |
|---|---|---|---|
| CN | 217524953 | U | 10/2022 |
| CN | 217610889 | U | 10/2022 |
| CN | 115251769 | A | 11/2022 |
| CN | 217827700 | U | 11/2022 |
| EP | 3 366 180 | A1 | 8/2018 |
| KR | 10-0848568 | B1 | 7/2008 |
| KR | 10-0864727 | B1 | 10/2008 |
| KR | 10-2015-0078093 | | 7/2015 |
| KR | 20-2019-0001672 | U | 7/2019 |
| KR | 10-2020783 | B1 | 9/2019 |
| KR | 10-2020-0052071 | A | 5/2020 |
| KR | 10-2022-0115509 | A | 8/2022 |

OTHER PUBLICATIONS

Written Opinion issued on Feb. 23, 2024 for International Application No. PCT/KR2023/019577.
International Search Report dated Feb. 23, 2024 for International Application No. PCT/KR2023/019577.
Written opinion of the International Searching Authority dated Feb. 23, 2024 for International Application No. PCT/KR2023/019577.
Notice of Allowance issued on Jun. 1, 2026, in the counterpart European Patent Application No. 23 916 408.0.
Extended European Search Report dated Jan. 8, 2026, issued in counterpart European Patent Application No. 23916408.0.

ROBOT CLEANER

CROSS-REFERENCE TO RELATED APPLICATIONS

This application is a continuation application of International Application No. PCT/KR2023/019577 designating the United States, filed on Nov. 30, 2023, in the Korean Intellectual Property Receiving Office, which claims priority from Korean Patent Application Nos. 10-2023-0005478, filed on Jan. 13, 2023, and 10-2023-0029381, filed on Mar. 6, 2023, in the Korean Intellectual Property Office, the disclosures of which are hereby incorporated by reference herein in their entireties.

BACKGROUND

Field

Various embodiments of the disclosure relate to a robot cleaner capable of attaching and detaching a cleaning cloth.

Description of Related Art

A robot cleaner is a device that automatically cleans a cleaning space while moving in the cleaning space without the user's manipulation. In general, a robot cleaner may suck up a foreign object, such as dust accumulated on the surface to be cleaned (e.g., the floor), or wiping off a foreign object, such as dirt stuck on the surface to be cleaned, with a cleaning cloth. Among these robot cleaners, a type of robot cleaners wipe off the foreign object stuck on the surface by rotating a cleaning cloth attached thereto.

As cleaning proceeds, the cleaning cloth attached to the robot cleaner may be contaminated. For effective cleaning, the user needs to replace the contaminated cleaning cloth.

SUMMARY

Various embodiments of the disclosure may provide a robot cleaner that has an attaching/detaching structure for attaching or detaching a cleaning cloth to automatically replace the cleaning cloth without the user's intervention.

Aspects of embodiments of the disclosure will be set forth in part in the description which follows and, in part, will be apparent from the description, or may be learned by practice of the presented embodiments.

According to an embodiment of the disclosure, a robot cleaner includes a housing; a motor in the housing; a separation driver including a stopper configured to vertically move up and down; and a cleaning cloth module including a first member including a stopper insertion hole into which the stopper is insertable, and an attaching member to which a cleaning cloth is detachably couplable, and a second member configured to be rotated by the motor, and positioned between the first member and the cleaning cloth to be coupled and separably coupled with the first member.

While the cleaning cloth module is rotated with the second member coupled to the first member, when the stopper vertically moves down so as to be inserted into the stopper insertion hole, the first member is stopped by the stopper from being rotated, then separated from the second member to separate the cleaning cloth from the first member.

According to an embodiment of the disclosure, the separation driver may be configured to be rotated by the motor to vertically move up and down according to a rotating direction of the motor.

According to an embodiment of the disclosure, the separation driver may include a rotating member having a thread coupling portion protruding from an outer circumferential surface of the rotating member, and rotated by rotational power from the motor. The thread coupling portion may be configured to be engaged with a thread around the rotating member to be moved along a path of the thread when the rotating member is rotated to vertically move the stopper.

According to an embodiment of the disclosure, the separation driver may include an actuator to vertically move the stopper.

According to an embodiment of the disclosure, the actuator may operate in a solenoid manner.

According to an embodiment of the disclosure, the first member may include a first inclined portion protruding from a lower surface of the first member.

According to an embodiment of the disclosure, when rotation of the first member is stopped by the stopper, the second member may be slid along an inclined surface of the first inclined portion to separate the second member from the first member.

According to an embodiment of the disclosure, the first inclined portion may be inclined toward an end portion of the attaching member.

According to an embodiment of the disclosure, the robot cleaner may further include a cleaning cloth driver coupled to the cleaning cloth module to transfer rotational power of the motor to the cleaning cloth module, and configured to vertically move selectively depending on a rotating direction of the motor.

According to an embodiment of the disclosure, when the cleaning cloth driver is raised to a maximum height, the stopper may be inserted into the stopper insertion hole.

According to an embodiment of the disclosure, when a cleaning cloth may be detachably coupled to the attaching member, and the cleaning cloth contacts a surface to be cleaned, and the cleaning cloth driver is rotated in a first direction by the motor, the cleaning cloth is rotated while contacting the surface to be cleaned. When the cleaning cloth driver is rotated in a second direction opposite to the first direction by the motor, the cleaning cloth driver may be moved upward.

According to an embodiment of the disclosure, when the cleaning cloth driver has been moved upward, and the cleaning cloth driver is rotated in the first direction by the motor, the cleaning cloth driver may be moved downward.

According to an embodiment of the disclosure, the cleaning cloth driver may include a first lifting member configured to rotate about a rotational axis and not to vertically move, and a second lifting member between the first lifting member and the second member and configured to vertically move with respect to the first lifting member.

According to an embodiment of the disclosure, the second lifting member may include a rotational resistance member protruding outward from an outer circumferential surface of the second lifting member. The rotational resistance member may contact a portion of the housing when the second lifting member is raised, to provide resistance to rotational motion of the second lifting member.

According to an embodiment of the disclosure, the rotational resistance member may be an elastic material.

According to an embodiment of the disclosure, a magnetic body may be disposed in a portion adjacent to the second lifting member in the housing. The second lifting member may include a rotational resistance member having magnetism disposed on an outer circumferential surface of the second lifting member. The rotational resistance member may provide resistance to rotational motion of the second lifting member by a magnetic force generated in the magnetic body in the housing when the second lifting member is raised.

According to an embodiment of the disclosure, the robot cleaner may further include a gear assembly in the housing to transfer rotational power of the motor to the cleaning cloth module and the separation driver.

According to an embodiment of the disclosure, the cleaning cloth module may include a first elastic body configured to be compressed when a cleaning cloth is detachably coupled to the attaching member, and the cleaning cloth contacts a surface to be cleaned, to provide a repulsive force upward.

According to an embodiment of the disclosure, the cleaning cloth module may include a second elastic body between the first member and the second member to provide a force in a direction of bringing the first member and the second member into contact with each other.

According to an embodiment of the disclosure, the robot cleaner may further include a controller configured to control an overall operation of the robot cleaner. The controller may determine, when a cleaning cloth is detachably coupled to the attaching member, that the cleaning cloth needs to be replaced when a use time of the cleaning cloth exceeds a preset time.

BRIEF DESCRIPTION OF THE DRAWINGS

The above and other aspects, features, and advantages of certain embodiments of the disclosure will be more apparent from the following description taken in conjunction with the accompanying drawings, in which.

Figure 1:
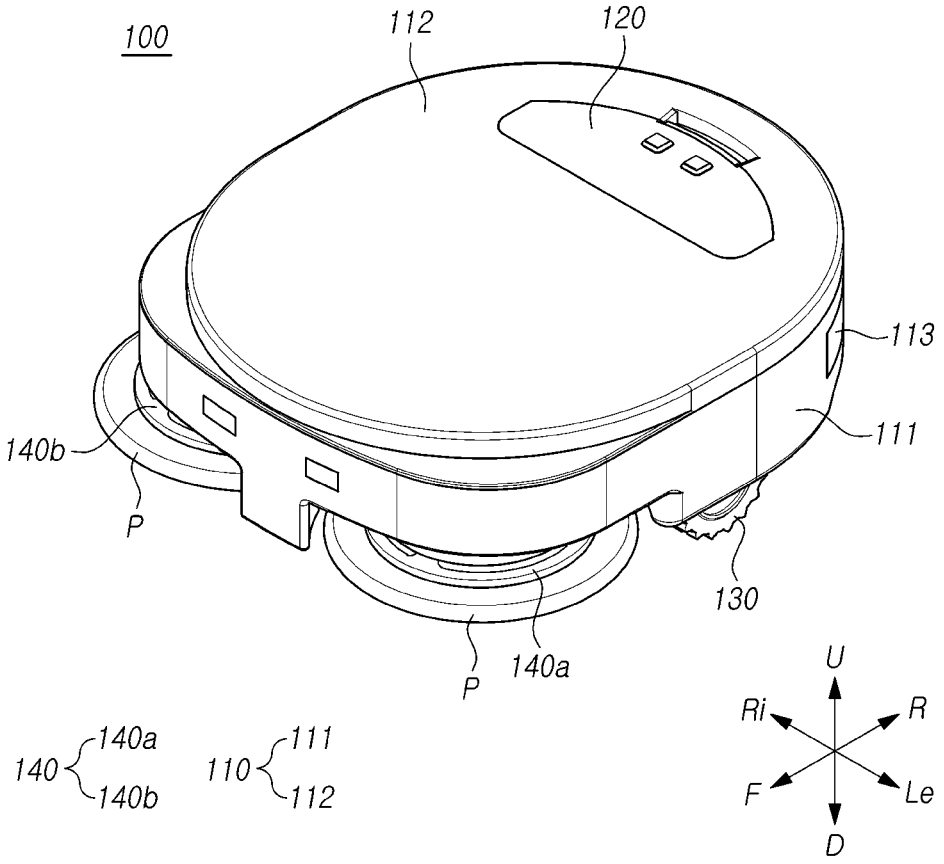
FIG. 1 is a perspective view illustrating a robot cleaner according to an embodiment.

Reference may be made to the accompanying drawings in the following description, and specific examples that may be practiced are shown as examples within the drawings. Other examples may be utilized and structural changes may be made without departing from the scope of the various examples.

DETAILED DESCRIPTION

Embodiments of the disclosure are now described with reference to the accompanying drawings in such a detailed manner as to be easily practiced by one of ordinary skill in the art. However, the disclosure may be implemented in other various forms and is not limited to the embodiments set forth herein. The same or similar reference denotations may be used to refer to the same or similar elements throughout the specification and the drawings. Further, for clarity and brevity, no description is made of well-known functions and configurations in the drawings and relevant descriptions.

Figure 2:
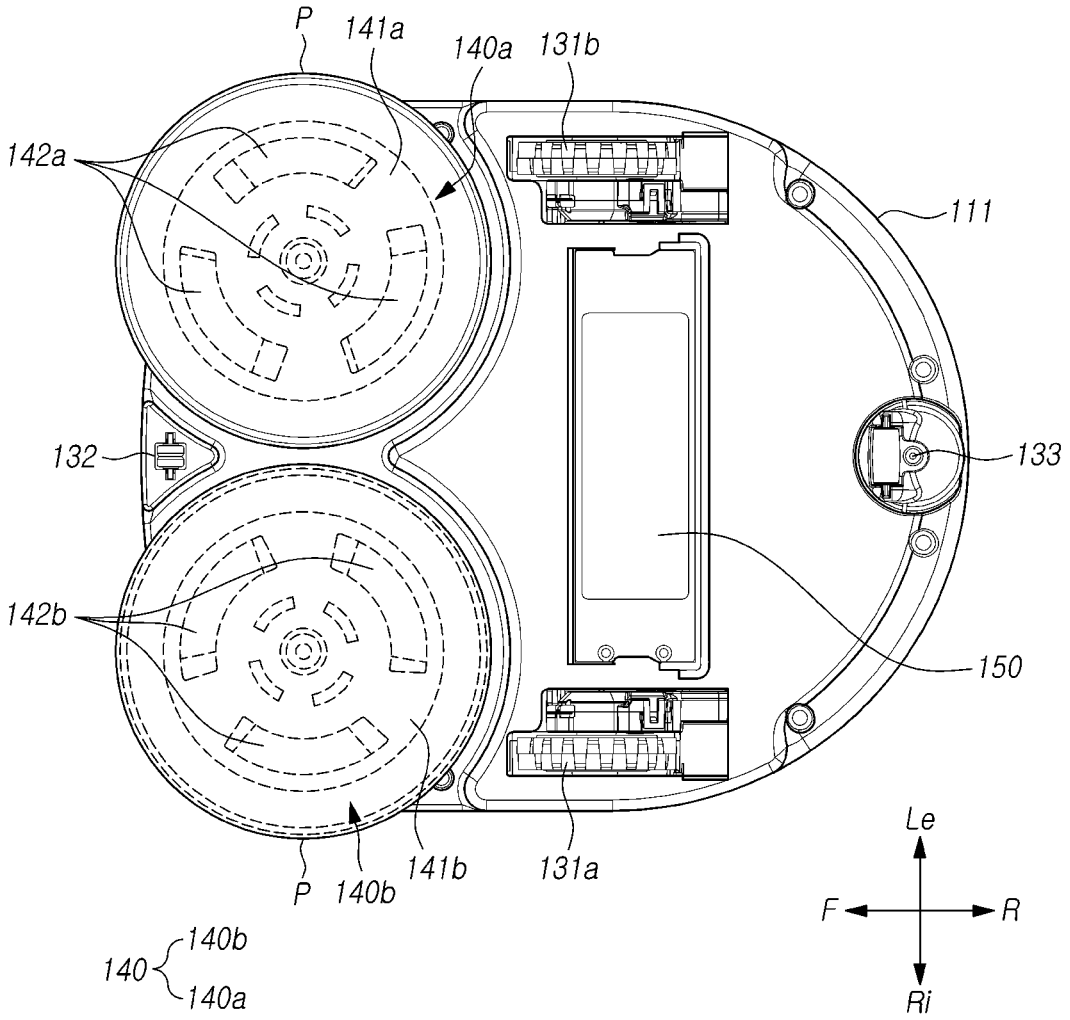
FIG. 2 is a bottom view illustrating a robot cleaner according to an embodiment.

FIG. 1 is a perspective view illustrating a robot cleaner according to an embodiment. FIG. 2 is a bottom view illustrating a robot cleaner according to an embodiment.

Referring to FIGS. 1 and 2, in an embodiment, the robot cleaner 100 may be in a state in which a cleaning cloth P (wet cleaning cloth or dry cleaning cloth) contactable to the surface to be cleaned (e.g., floor) is attached to cleaning cloth modules 140 at the underside of the robot cleaner 100.

The robot cleaner 100 may perform cleaning (or mopping) for removing the foreign objects stuck to the surface to be cleaned, by the cleaning cloth P attached to the cleaning cloth modules 140. For example, the robot cleaner 100 may remove the foreign objects stuck to the floor by the frictional force between the floor and the cleaning cloth P, created by rotating the attached cleaning cloth P. The robot cleaner 100 may, by itself, replace the contaminated cleaning cloth P attached to the cleaning cloth module 140. The attaching/detaching structure and operation of the cleaning cloth P of the robot cleaner 100 are described below.

According to an embodiment, the robot cleaner 100 may include a main body 110, a control panel 120, a traveling unit 130, the cleaning cloth module 140, and a battery 150.

According to an embodiment, the main body 110 may form a substantial external appearance of the robot cleaner 100. In an embodiment, the main body 110 may include a cleaner body 111 and a cleaner cover 112. In an embodiment, the cleaner body 111 may form an outer appearance of a lower portion disposed adjacent to a floor (or the surface to be cleaned) while the robot cleaner 100 is driven for cleaning, and a side portion extending upward from an edge of the lower portion to form a side surface of the robot cleaner 100. Although not specifically illustrated, according to an embodiment, the robot cleaner 100 may include a bumper on a side portion of the cleaner body 111 to mitigate an impact from the outside.

According to an embodiment, a power button 113 may be disposed on one side of the cleaner body 111. In an embodiment, the power button 113 may be manipulated by the user to turn on/off the power of the robot cleaner 100. The power button 113 may be implemented by, e.g., a button switch method, but is not limited thereto.

According to an embodiment, the cleaner body 111 may be formed such that an upper side thereof is opened. In an embodiment, an inner space in which various components (e.g., the driver 360 or the liquid container of FIG. 3) for operating the robot cleaner 100 are disposed may be formed inside the cleaner body 111.

According to an embodiment, the cleaner cover 112 may form an upper exterior of the robot cleaner 100. In an embodiment, the cleaner cover 112 may be coupled to an upper side of the cleaner body 111. In an embodiment, the cleaner cover 112 may be provided to cover the opening of the cleaner body 111. In an embodiment, the cleaner cover 112 may be separably coupled to the cleaner body 111. After separating the cleaner cover 112, the user may reach the components inside the main body 110 through the upper opening of the cleaner body 111.

According to an embodiment, the cleaner body 111 and the cleaner cover 112 may be integrally formed.

According to an embodiment, the control panel 120 may be disposed at an upper portion of the robot cleaner 100. The control panel 120 may be disposed, e.g., on the upper surface of the cleaner cover 112, but is not limited thereto.

According to an embodiment, the control panel 120 may receive various commands regarding the operation of the robot cleaner 100 from the user. In an embodiment, the control panel 120 may include an input device such as a button, a switch, or a touch panel. In this case, the robot cleaner 100 may receive a command (e.g., start/stop cleaning, or change the cleaning mode) regarding the operation of the robot cleaner 100 from the user through the control panel 120. In an embodiment, the control panel 120 may include a signal input device that receives various commands input from the user through an external remote controller in the form of an infrared signal, and the disclosure is not limited to a specific form.

According to an embodiment, the control panel 120 may provide the current status regarding the operation of the robot cleaner 100 to the user. According to an embodiment, the control panel 120 may include a display device such as a display. In this case, the robot cleaner 100 may visually transmit information (e.g., the current cleaning mode or the battery status) about the current state of the robot cleaner 100 to the user through the display device. In an embodiment, the above-described input device or display device may be integrally provided with the control panel 120, but is not limited thereto.

According to an embodiment, the traveling unit 130 may be disposed on the bottom surface of the cleaner body 111. In an embodiment, the traveling unit 130 may be configured to enable the robot cleaner 100 to move freely. The robot cleaner 100 may freely move the cleaning space through the traveling unit 130.

According to an embodiment, the traveling unit 130 may include one or more wheels that are connected to a driver (e.g., the travel driver 361 of FIG. 3) to receive power to thus rotate. The traveling unit 130 may include, e.g., a pair of main wheels (e.g., a first main wheel 131*a* and a second main wheel 131*b*). In an embodiment, the first main wheel 131*a* and the second main wheel 131*b* may be disposed to maintain the balance of the robot cleaner 100. The first main wheel 131*a* and the second main wheel 131*b* may be disposed, e.g., at opposite edges of the bottom surface of the cleaner body 111.

According to an embodiment, the traveling unit 130 may include a first sub wheel 132 or a second sub wheel 133. In an embodiment, the first sub wheel 132 and the second sub wheel 133, respectively, may be disposed at the front (e.g., in the F direction) and rear (e.g., in the R direction) in a direction perpendicular to the direction in which the first main wheel 131*a* and the second main wheel 131*b* are disposed.

The traveling direction of the robot cleaner 100 may be determined depending on how the movement of each of the first main wheel 131*a* and second main wheel 131*b* is controlled. For example, when each of the first main wheel 131*a* and the second main wheel 131*b* is controlled in the same direction and speed, the robot cleaner 100 may move forward (e.g., F direction) or backward (e.g., R direction). For example, when each of the first main wheel 131*a* and the second main wheel 131*b* is controlled in different directions and/or speeds, the robot cleaner 100 may be redirected and move corresponding to a preset direction.

In an embodiment, each of the first sub wheel 132 and the second sub wheel 133 may be disposed such that the robot cleaner 100 is balanced when the robot cleaner 100 moves forward (e.g., moves in the F direction) or backward (e.g., moves in the R direction). The first sub wheel 132 may be disposed, e.g., in a front portion (e.g., direction F) of the bottom surface of the cleaner body 111. The second sub wheel 133 may be disposed, e.g., in arear portion (e.g., in the R direction) of the bottom surface of the cleaner body 111.

According to an embodiment, the cleaning cloth module 140 may be disposed at a lower portion of the robot cleaner 100. The cleaning cloth module 140 may be disposed, e.g., on the bottom surface of the cleaner body 111. In an embodiment, the cleaning cloth module 140 may be disposed in the front of the bottom surface (e.g., direction F) of the cleaner body 111, but is not limited thereto. The cleaning cloth module 140 may be detachably coupled with the cleaning cloth P (e.g., a wet or dry cleaning cloth) for cleaning the surface to be cleaned, such as a floor.

In an embodiment, the cleaning cloth module 140 may rotate clockwise or counterclockwise together with the cleaning cloth P mounted on the cleaning cloth module 140. When the cleaning cloth module 140 rotates together with the cleaning cloth P coupled thereto, friction may occur between the cleaning cloth P and the floor, and thus the robot cleaner 100 may remove foreign objects stuck to the floor.

In an embodiment, the cleaning cloth module 140 may rise or fall within a predetermined range in the height direction (or a direction perpendicular to the ground) (e.g., the U or D direction of FIG. 1) of the robot cleaner 100.

In an embodiment, the cleaning cloth module 140 may include a first cleaning cloth module 140*a* or a second cleaning cloth module 140*b*. The first cleaning cloth module 140*a* and the second cleaning cloth module 140*b* may be configured to correspond to each other in operation, structure, and shape.

In an embodiment, each cleaning cloth module 140 (e.g., the first cleaning cloth module 140*a* and the second cleaning cloth module 140*b*) may include a rotating member (e.g., a first rotating member 141*a* or a second rotating member 141*b*) and an attaching member (e.g., a first attaching member 142*a* or a second attaching member 142*b*). In FIG. 2, the rotating members 141*a* and 141*b* and the attaching members 142*a* and 142*b* are covered by the cleaning cloths P coupled to the respective cleaning cloth modules 140, and to show this, the rotating members 141*a* and 141*b* and the attaching members 142*a* and 142*b* are illustrated in dashed lines.

In an embodiment, the first and second rotating members 141*a* and 141*b* may have a disk shape as a whole. However, embodiments of the disclosure are not limited thereto. According to an embodiment, the diameter of the first rotating member 141*a* may be set to be the same as or smaller than the diameter of the cleaning cloth P, but is not limited thereto. Likewise, the diameter of the second rotating member 141*b* may be set to be the same as or smaller than the diameter of the cleaning cloth P, but is not limited thereto.

In an embodiment, one or more attaching members (e.g., the attaching member 4421 of FIG. 9) to be described below may be disposed on each of the first and second attaching members 142*a* and 142*b*. According to an embodiment, the attaching members 4421 disposed on each of the first and second attaching members 142*a* and 142*b* may contact and couple to the cleaning cloths P disposed below the first and second rotating members 141*a* and 141*b* through openings (e.g., the opening 4431 of FIG. 8) provided in the first and second rotating members 141*a* and 141*b*. Hereinafter, a detailed structure of the cleaning cloth module 140 is described in more detail with reference to FIG. 4.

According to an embodiment, the battery 150 may be disposed at a lower portion of the robot cleaner 100. In an embodiment, the battery 150 may be provided to be detachable through the underside at the bottom surface of the cleaner body 111. The battery 150 may be electrically connected to a driver (e.g., the driver 360 of FIG. 3) and may supply power to the driver 360. The battery 150 may be a rechargeable secondary battery, but is not limited thereto.

According to an embodiment, the driver (e.g., the driver 360 of FIG. 3) may be provided inside the main body 110 of the robot cleaner 100. The driver 360 may be disposed, e.g., in an inner receiving space formed by the cleaner body 111. The driver 360 may include, e.g., a motor and/or an actuator, and may include a plurality of components for supplying power to each of the traveling unit 130 or the cleaning cloth module 140 described above.

According to an embodiment, the robot cleaner 100 may include a liquid container (not shown) configured to store liquid for wet cleaning. The liquid stored in the liquid container may be, e.g., water, but is not limited thereto, and may be a liquid material such as soap or solvent used for cleaning. The liquid container may be detachably disposed in the inner receiving space of the cleaner body 111. The user may reach the liquid container by separating the cleaner cover 112 from the cleaner body 111 and opening the upper portion of the cleaner body 111.

According to an embodiment, the robot cleaner 100 may include a liquid dispenser (not shown). For example, the liquid dispenser may have one end fluidly communicating with the liquid container and another end fluidly communicating with the cleaning cloth module 140 disposed at a lower portion of the robot cleaner 100. The liquid dispenser may be, e.g., a tube or hose. The robot cleaner 100 may supply liquid (e.g., water) of the cleaning cloth P mounted on the cleaning cloth module 140 through the liquid container and/or the liquid dispenser.

Although not illustrated in FIGS. 1 and 2, the robot cleaner 100 may include a controller (e.g., the controller 350 of FIG. 3) for generating a control command for controlling the operation of each part of the robot cleaner 100. In an embodiment, the control and driving of the robot cleaner 100, focusing on the controller 350, is briefly described with reference to FIG. 3.

Figure 3:
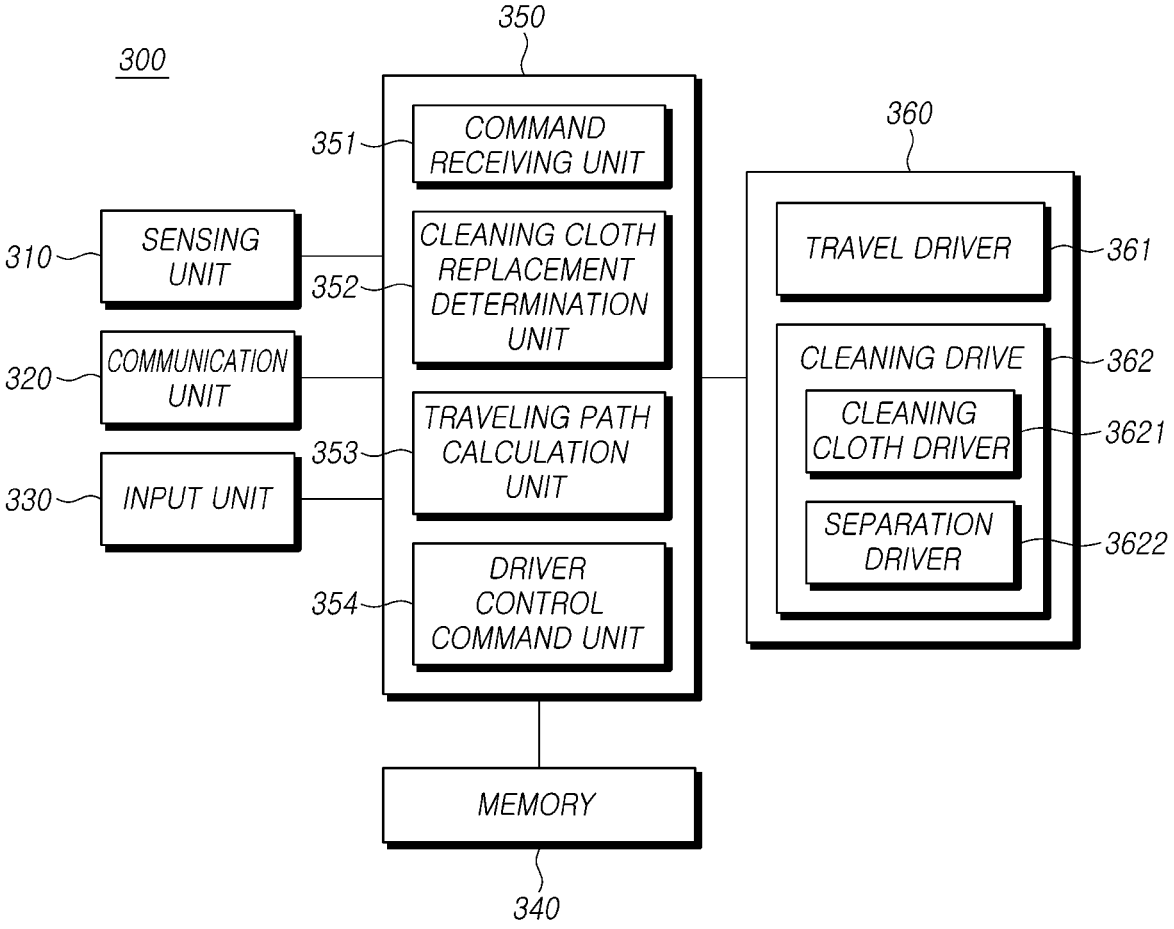
FIG. 3 is a functional block diagram illustrating the relationship between components, regarding the control and operation of a robot cleaner according to an embodiment.

FIG. 3 is a functional block diagram illustrating the relationship between components, regarding the control and operation of a robot cleaner according to an embodiment.

According to an embodiment, the robot cleaner 300 may include a sensing unit 310. The sensing unit 310 may include a plurality of sensors or cameras for sensing the surrounding environment of the robot cleaner 300. The sensing unit 310 may include, e.g., a plurality of cameras to photograph various directions. The distance sensor may include, e.g., an ultrasonic sensor, a radar sensor, and/or a rider sensor, but is not limited thereto. The sensing unit 310 may include, e.g., a microphone or an infrared sensor for sensing a surrounding environment. According to an embodiment, the sensing unit 310 may be coupled to each cleaning cloth module 140 of the robot cleaner 300 to detect the degree of contamination of each cleaning cloth being used for cleaning, but the disclosure is not limited thereto.

In an example, the robot cleaner 300 may include a communication unit 320 that supports signal transmission/reception to/from the outside. In an example, the communication unit 320 may receive and/or transmit a wired/wireless signal to/from an external wired/wireless communication system, an external server, and/or other devices according to a predetermined wired/wireless communication protocol. For example, the communication unit 320 may transmit/receive data according to a wireless Internet communication protocol, such as wireless LAN (WLAN), wireless-fidelity (Wi-Fi), Wi-Fi direct, digital living network alliance (DLNA), wireless broadband (WiBro), world interoperability for microwave access (WiMAX), high speed downlink packet access (HSDPA), high speed uplink packet access (HSUPA), long term evolution (LTE), or long term evolution-advanced (LTE-A). For example, the communication unit 320 may transmit/receive data according to at least one short-range communication protocol including, e.g., radio frequency identification (RFID), infrared data association (IrDA), ultra-wide band (UWB), Zigbee, near-field communication (NFC), Wi-Fi, Wi-Fi direct, or wireless universal serial bus (USB). In an example, the communication unit 320 may receive the configuration data signal input by the user on the mobile device of the user in the form of a wireless signal according to a predetermined wireless communication protocol. In an example, the communication unit 320 may receive information and/or a command for controlling the operation of the robot cleaner 300 from an external server in the form of a signal according to a predetermined wired/wireless communication protocol. The communication unit 320 may transfer various received signals to the controller 350 to be described below. In an example, the communication unit 320 may transmit various data generated or obtained on the robot cleaner 300 in the form of a wired/wireless signal according to a predetermined wired/wireless communication protocol, e.g., to a mobile device of the user or an external server.

In an example, the communication unit 320 may include a module for obtaining the position of the robot cleaner 300, e.g., a global positioning system (GPS) module or a Wi-Fi module. When the robot cleaner 300 utilizes the GPS module, the robot cleaner 300 may receive information about the location of the robot cleaner 300 using the signal transmitted from the GPS satellite. When the robot cleaner 300 utilizes the Wi-Fi module, the robot cleaner 300 may receive information about the location of the robot cleaner 300 based on information about a wireless access point (AP) that transmits and receives a wireless signal to and from the Wi-Fi module.

According to an embodiment, the robot cleaner 300 may include an input unit 330. The input unit 330 may receive, e.g., information about an operation mode of the robot cleaner 300 from the user. The input unit 330 may include, e.g., a keypad, a dome switch, a touch pad (static or capacitive), a jog wheel, a jog switch, or a remote controller. In addition to the above-described input unit 330, the user may input information about the operation mode of the robot cleaner 300 using a portable device such as a terminal.

According to an embodiment, the robot cleaner 300 may include a memory 340.

According to an embodiment, the memory 340 may store data supporting various functions of the robot cleaner 300. The memory 340 may store, e.g., a plurality of application programs (or applications) used in the robot cleaner 300, data for operating the robot cleaner 300, and/or instructions. At least some of the application programs may be downloaded from an external server via wireless communication. At least some of the application programs may be stored in the memory 340 from the time of shipment for the basic functions of the robot cleaner 300. For example, the application program may be stored in the memory 340 and driven to perform the operation (or function) of the robot cleaner 300 by the controller 350. According to an embodiment, the memory 340 may be included as a part of the controller 350. According to an embodiment, the memory 340 may store information for setting a traveling path of the robot cleaner 300.

According to an embodiment, the robot cleaner 300 may include a controller 350.

According to an embodiment, the controller 350 may control the operation of the robot cleaner 300 by using, e.g., the signal received from the sensing unit 310, the communication unit 320, or the input unit 330. Although not specifically illustrated, the controller 350 may include one or more processors.

According to an embodiment, the controller 350 may include a command receiving unit 351. The command receiving unit 351 may receive a driving-related command input from the outside through, e.g., the sensing unit 310, the communication unit 320, or the input unit 330 described above. The command receiving unit 351 may receive the command from the user, received through the above-described power button 113 and/or the control panel 120. The command receiving unit 351 may receive each user command including operation on/off command, cleaning start or pause command, or cleaning mode setting command.

In an embodiment, the controller 350 may include a cleaning cloth replacement determination unit 352 to determine whether to replace the cleaning cloth attached to the cleaning cloth module 140 during cleaning by the robot cleaner 300. In an embodiment, the cleaning cloth replacement determination unit 352 may obtain the result of sensing by a contamination sensor (not shown) provided in the sensing unit 310 and determine whether to cleaning cloth replacement is required depending on the obtained information. In an embodiment, the cleaning cloth replacement determination unit 352 man determine whether cleaning cloth replacement is required according to the elapse of cleaning time after the cleaning cloth is attached to the cleaning cloth module 140. In an embodiment, the cleaning cloth replacement determination unit 352 may determine whether cleaning cloth replacement is required according to the command received from the command receiving unit 351.

In an embodiment, the controller 350 may include a traveling path calculation unit 353 to calculate the traveling path of the robot cleaner 300. In an embodiment, the traveling path calculation unit 353 may calculate the traveling path of the robot cleaner 300 based on a predetermined algorithm, sensing results detected by various sensors provided in the sensing unit 310, and/or the user command received through the command receiving unit 351. In an embodiment, the traveling path calculation unit 353 may calculate the traveling path considering the result of sensing from the sensor provided in the sensing unit 310.

In an embodiment, when the cleaning cloth replacement determination unit 352 determines that the cleaning cloth needs to be replaced, the traveling path calculation unit 353 may calculate the traveling path to allow the robot cleaner 300 to travel to a preset position. When the cleaning cloth replacement determination unit 352 determines that the cleaning cloth needs to be replaced in the robot cleaner 300, the cleaning cloth replacement determination unit 352 may calculate the traveling path to allow the robot cleaner 300 to travel to the docking station (e.g., the docking station 2900 of FIG. 29 or the docking station 3000 of FIG. 30).

In an embodiment, the controller 350 may include a driver control command unit 354. In an embodiment, the driver control command unit 354 may generate control commands to control each component, e.g., motor and/or actuator, of the driver 360 of the robot cleaner 300 according to various commands received from the user or outside through the above-described command receiving unit 351, the sensing results detected by various sensors provided in the sensing unit 310 of the robot cleaner 300, and/or the traveling path determined by the traveling path calculation unit 353.

In an embodiment, each component of the driver 360 may be operated according to the command generated by the driver control command unit 354. According to an embodiment, the driver 360 may include the travel driver 361 and a cleaning driver 362.

In an embodiment, the travel/movement of the robot cleaner 300 may be controlled according to the command generated by the driver control command unit 354. In an embodiment, each component of the driver (e.g., the travel driver 361) may be operated to properly control the rotating direction and speed of the main wheel (e.g., the first or second main wheel 131*a* or 131*b* of FIG. 2) according to the command generated by the driver control command unit 354, thereby allowing the robot cleaner 300 to properly move in a required direction.

In an embodiment, the travel driver 361 may include a pair of drivers. Although not specifically shown, in an embodiment, each of the pair of travel drivers may include a motor and an actuator and may be connected to the above-described traveling unit 130, e.g., each of the first and second main wheels 131*a* and 131*b*, to provide power necessary to move the robot cleaner 100.

According to an embodiment, the cleaning driver 362 may include a cleaning cloth driver 3621 involved in rotation and/or vertical movement of the cleaning cloth module 140 and a separation driver 3622 involved in separating the cleaning cloth (e.g., the cleaning cloth P of FIG. 2) from the cleaning cloth module 140.

In an embodiment, the rotation and/or vertical movement of the cleaning cloth module (e.g., the cleaning cloth module 140 of FIG. 2) may be controlled according to the command generated by the driver control command unit 354. For example, the driver control command unit 354 may control the vertical movement of the cleaning cloth module 140 by controlling the rotating direction of each rotating member (e.g., the rotating members 141*a* and 141*b* of FIG. 2) of the cleaning cloth module 140. In this case, the distance between the cleaning cloth module 140 and the floor may be adjusted.

In an embodiment, the driver control command unit 354 may generate the control command for controlling each component, e.g., motor and/or actuator, of the driver (e.g., the cleaning cloth driver 3621) to allow the cleaning cloth module 140 to move based on the command received from the user through the above-described command receiving unit 351 and/or a pre-stored algorithm.

In an embodiment, each component of the driver (e.g., the cleaning cloth driver 3621) may be operated to properly adjust the rotating speed of each rotating member 141*a* or 141*b* according to the command generated by the driver control command unit 354. In this case, the floor mopping strength of the robot cleaner 300 may be adjusted.

In an embodiment, each component of the driver (e.g., the cleaning cloth driver 3621) may adjust the cleaning cloth module 140 to ascend or descend in the height direction according to the command generated by the driver control command unit 354.

In an embodiment, the cleaning driver 362 may include a pair of cleaning drivers 362. Although not explicitly illustrated, in an embodiment, each of the pair of cleaning drivers 362 may include a rotating motor and an actuator, and may be connected to each of the above-described cleaning cloth modules 140, e.g., the first and second cleaning cloth modules 140*a* and 140*b* (e.g., the first and second cleaning cloth modules 140*a* and 140*b* of FIG. 2) to provide power required to rotate the respective rotating members 141*a* and 141*b* of the cleaning cloth modules.

In an embodiment, the cleaning cloth P may be separated from the cleaning cloth module 140 according to a command generated by the driver control command unit 354. For example, the separation driver 3622 may be controlled by the driver control command unit 354 such that a stopper (e.g., the stopper 451 of FIG. 4) for stopping rotation of the first member 442 of the cleaning cloth module 140 is lowered in a state in which the cleaning cloth module 140 is moved upward. As the stopper 451 descends, the gap between the first member 442 and the second member 443 may be widened, and the cleaning cloth P may be separated from the cleaning cloth module 140. An operation in which the robot cleaner 300 automatically separates the cleaning cloth P from the cleaning cloth module 140 is described below.

The cleaning driver 400 described below may be mounted as one component of the robot cleaner 100 described above.

Figure 4:
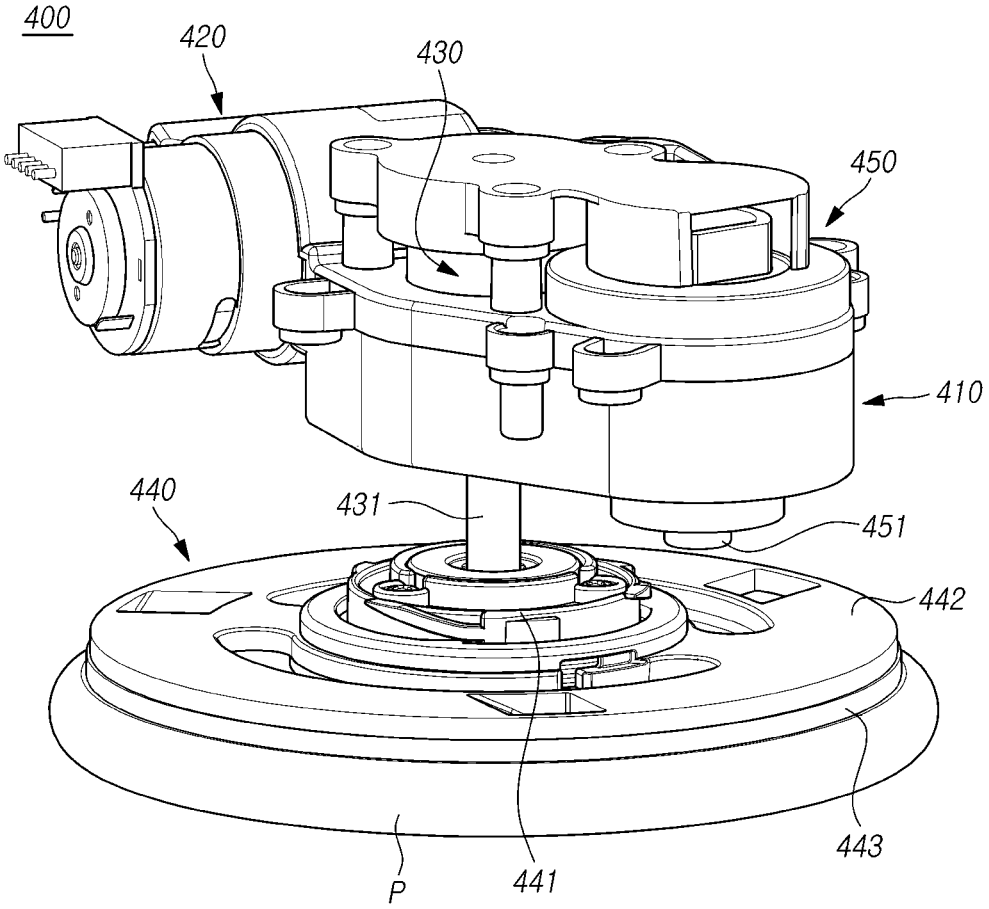
FIG. 4 is a perspective view illustrating a cleaning driver according to an embodiment.

FIG. 4 is a perspective view illustrating a cleaning driver according to an embodiment.

The cleaning driver 400 illustrated in FIG. 4 may have substantially the same configuration and function as the cleaning driver 362 described with reference to FIG. 3. The cleaning driver 400 illustrated in FIG. 4 is exemplary, and the structure of the cleaning driver 400 is not limited to the illustrated structure.

According to an embodiment, the cleaning driver 400 may include a housing 410, a motor 420, a cleaning cloth driver 430, a cleaning cloth module 440, or a separation driver 450. Components, such as a gear assembly (e.g., the gear assembly 460 of FIG. 5), for transferring power generated by the motor 420 may be disposed in the housing 410. The cleaning cloth driver 430 or the separation driver 450 may be disposed, e.g., through the lower surface of the housing 410, but is not limited thereto. The cleaning cloth module 440 illustrated in FIG. 4 may overall have the same structure and shape as the cleaning cloth module 140 described with reference to FIGS. 1 and 2.

According to an embodiment, the cleaning cloth driver 430 may be rotated by the motor 420 to transmit rotational power to the cleaning cloth module 440. The cleaning cloth driver 430 may include a shaft 431 for transferring rotational power to the cleaning cloth module 440. The shaft 431 may be disposed to protrude downward of the housing 410. One end portion of the shaft 431 may be coupled to the cover member 441 of the cleaning cloth module 440. For example, the shaft 431 may selectively rise or fall depending on the rotating direction of the motor 420. When the shaft 431 moves upward or downward, the cleaning cloth module 440 coupled thereto may also move upward or downward.

Various structures or methods may be applied to lower the shaft 431. For example, a driver for rotating the shaft 431 and a driver for vertically moving the shaft 431 may be provided to control the movement of the shaft 431. As an example, the upward and/or downward movement of the shaft 431 may be controlled by adjusting only the rotating direction of the motor 420 using one driver. Hereinafter, one of structures capable of raising and/or lowering the shaft 431 by adjusting the rotating direction of the motor 420 is described as an example.

The cleaning cloth P may be attached to the lower surface of the cleaning cloth module 440. In case that the shaft 431 and the cleaning cloth module 440 are rotated by the operation of the motor 420, the cleaning cloth P attached to the cleaning cloth module 440 may also be rotated. The cleaning cloth P may be rotated in contact with the floor while the robot cleaner (e.g., the robot cleaner 100 of FIG. 1) moves to clean the floor.

According to an embodiment, the separation driver 450 may be configured to receive rotational power from the motor 420.

As illustrated, the cleaning cloth driver 430 and the separation driver 450 may be configured to receive rotational power from one motor 420 at the same time, but are not limited thereto. For example, unlike illustrated, the cleaning cloth driver 430 and the separation driver 450 may be independently driven with respect to each other by different motors. For example, unlike illustrated, the cleaning cloth driver 430 may be configured to be rotated and vertically moved by the rotation of the motor 420, and the separation driver 450 may include a separate actuator to be vertically moved by the operation of the actuator. Here, the separate actuator may be driven in a solenoid manner.

The separation driver 450 may include a stopper 451 configured to vertically move according to the rotating direction. For example, by the operation of the motor 420, the stopper 451 may be raised or lowered according to the rotating direction of the motor 420. For example, when the motor 420 rotates in a first direction, the stopper 451 may be raised. For example, when the motor 420 rotates in a second direction opposite to the first direction, the stopper 451 may be lowered. While the cleaning cloth module 440 is rotated by the cleaning cloth driver 430, the lowered stopper 451 may be inserted into the recess of the first member (e.g., the first member 442 of FIG. 6) of the cleaning cloth module 440 to stop the rotation of the first member 442. Even if the rotation of the first member 442 is stopped, the rotating member (e.g., the second member 443 of FIG. 6) disposed thereunder may still be rotated by the cleaning cloth driver 430. In other words, the second member 443 may be rotated with respect to the first member 442. In case that the second member 443 is rotated with respect to the first member 442, the first member 442 is pushed upward by a second inclined portion (e.g., the second inclined portion 4432 of FIG. 9) to be described below, so that the gap between the first member 442 and the second member 443 may be increased. As a result, the cleaning cloth P attached to the attaching member (e.g., the attaching member 4421 of FIG. 9) of the first member 442 may be separated from the first member 442. An operation in which the robot cleaner 100 automatically replaces the cleaning cloth P is described below.

Figure 5:
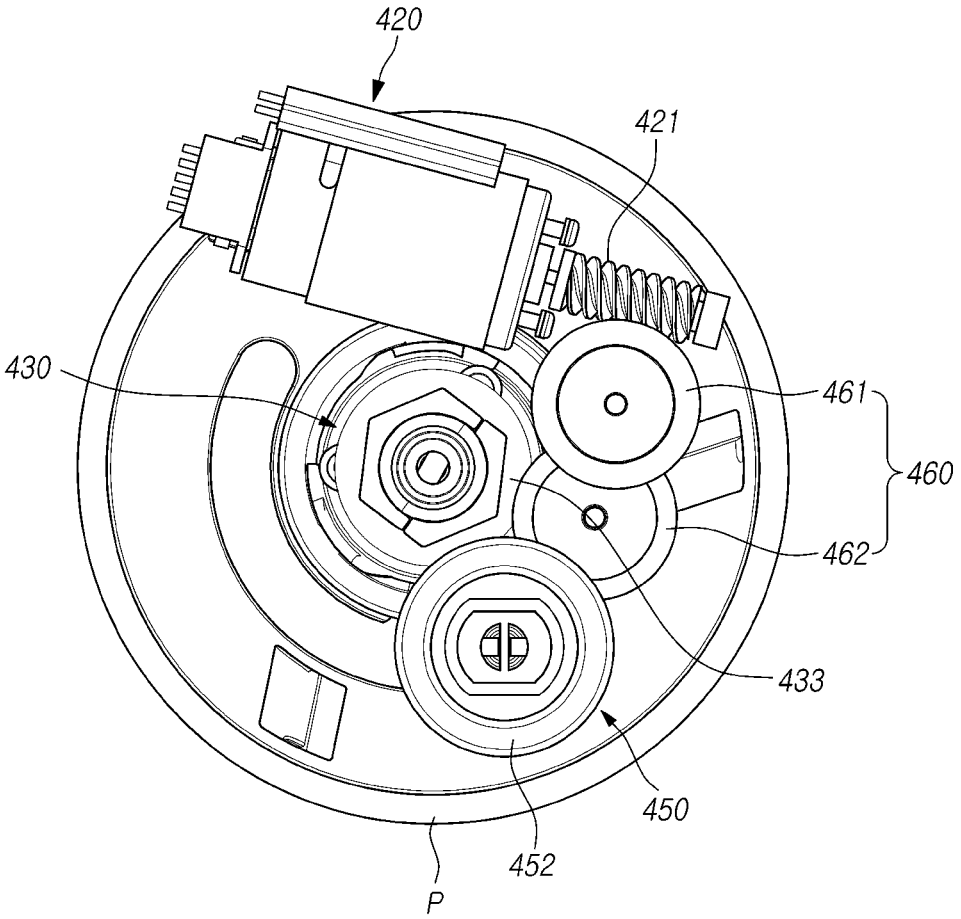
FIG. 5 is a view illustrating operations of a cleaning driver according to an embodiment.

FIG. 5 is a view illustrating operations of a cleaning driver according to an embodiment.

The cleaning driver 400 illustrated in FIG. 5 may have substantially the same configuration and function as the cleaning driver 362 described with reference to FIG. 3. FIG. 5 illustrates a state in which the housing 410 is omitted from the cleaning driver 400 of FIG. 4 to describe a structure of the gear assembly 460 inside the housing 410. The cleaning driver 400 illustrated in FIG. 5 is exemplary, and the disclosure is not limited to the illustrated structure.

According to an embodiment, the motor 420 may include a worm forming portion 421 provided on the rotating shaft.

According to an embodiment, the cleaning driver 400 may include a gear assembly 460. The gear assembly 460 may include a first gear unit 461 and a second gear unit 462. The first gear unit 461 may be a two-stage gear. The first gear unit 461 may include, e.g., a 1-1th gear and a 1-2th gear having different diameters. The second gear unit 462 may be a two-stage gear. The second gear unit 462 may include, e.g., a 2-1th gear and a 2-1th gear having different diameters.

The first gear unit 461 may be engaged with the worm forming portion 421. The first gear unit 461 may be, e.g., a worm gear. For example, the 1-1th gear of the first gear unit 461 may be engaged with the worm forming portion 421.

The second gear unit 462 may be engaged with the first gear unit 461. For example, the 2-1th gear of the second gear unit 462 may be disposed to be engaged with the 1-2th gear of the first gear unit 461.

The second gear unit 462 may be engaged with a first rotation portion 433 of the cleaning cloth driver 430 and a second rotation portion 452 of the separation driver 450. For example, the 2-2th gear of the second gear unit 462 may be disposed to be engaged with the threaded shape formed on the outer circumferential surface of the first rotation portion 433. For example, the 2-2th gear of the second gear unit 462 may be disposed to be engaged with the threaded shape formed on the outer circumferential surface of the second rotation portion 452.

As illustrated, the cleaning driver 400 may be configured such that one motor 420 rotates the cleaning cloth driver 430 and the separation driver 450, but is not limited thereto, and the cleaning cloth driver 430 and the separation driver 450 may be rotated by different motors 420.

Figure 6:
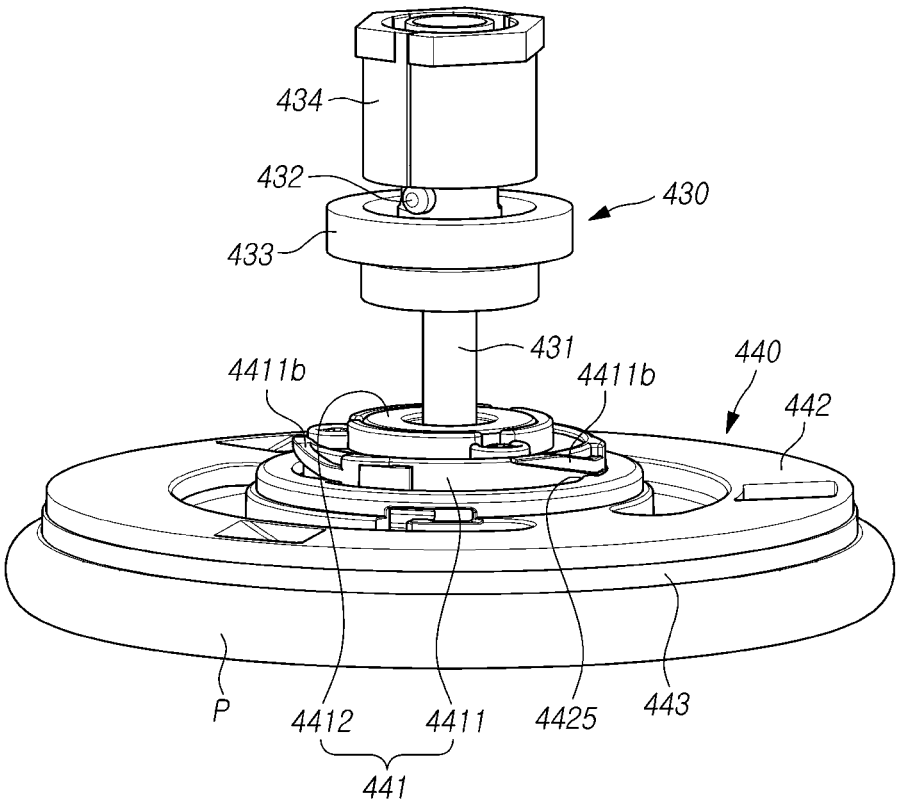
FIG. 6 is a view illustrating a cleaning cloth driver and a cleaning cloth module in a cleaning driver according to an embodiment.
Figure 7:
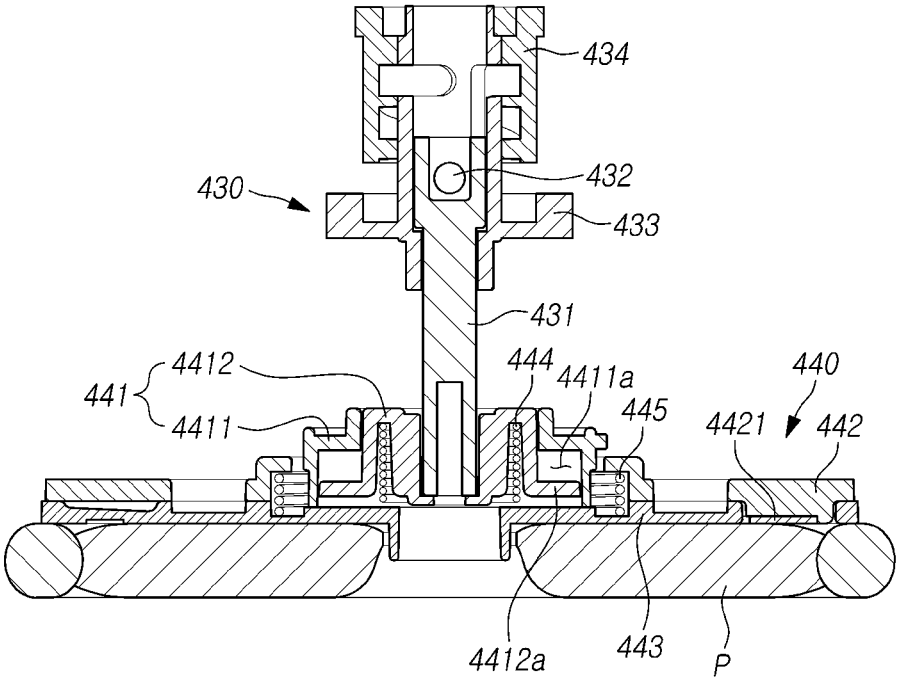
FIG. 7 is a cross-sectional view illustrating a cleaning cloth driver and a cleaning cloth module in a cleaning driver according to an embodiment.

FIG. 6 is a view illustrating a cleaning cloth driver and a cleaning cloth module in a cleaning driver according to an embodiment. FIG. 7 is a cross-sectional view illustrating a cleaning cloth driver and a cleaning cloth module in a cleaning driver according to an embodiment.

The cleaning cloth driver 430 and the cleaning cloth P module illustrated in FIGS. 6 and 7 may be substantially the same as or similar in configuration to the cleaning cloth driver 430 and the cleaning cloth module 440 illustrated in FIGS. 4 and 5. The structure and shape of the cleaning cloth driver 430 and the cleaning cloth P illustrated in FIGS. 6 and 7 are exemplary, and the disclosure is not limited thereto. Hereinafter, descriptions of duplicate configurations will be omitted.

According to an embodiment, the cleaning cloth driver 430 may include the shaft 431, a shaft rod 432, the first rotation portion 433, or a guide portion 434. The cleaning cloth driver 430 may rotate the shaft 431 by receiving power from a motor (e.g., the motor 420 of FIG. 4). The shaft 431 may be coupled to the cleaning cloth module 440 to transfer rotational power to the cleaning cloth module 440.

According to an embodiment, the first rotation portion 433 may be engaged with a second gear unit (e.g., the second gear unit 462 of FIG. 5). In case that the motor 420 rotates, the first rotation portion 433 may be rotated by the rotational power transferred by the gear assembly (e.g., the gear assembly 460 of FIG. 5). The first rotation portion 433 may be formed to be hollow. The first rotation portion 433 may include a guide rail (e.g., the guide rail 4331 of FIG. 8) which is penetrated by the shaft rod 432 described below and guides the moving path of the shaft rod 432. The shaft rod 432 may be rotated while being stuck to an edge of the guide rail 4331 along the rotating direction of the first rotation portion 433. Or, the shaft rod 432 may be moved relative to the first rotation portion 433 although not actually moved, along the guide rail 4331 along the rotating direction of the first rotation portion 433. In case that interacting with the first rotation portion 433, the shaft 431 may be rotated or vertically moved.

According to an embodiment, a portion of the shaft 431 may be inserted into a hollow portion of the first rotation portion 433. The shaft rod 432 may be disposed through the portion of the shaft 431 inserted into the first rotation portion 433. The shaft rod 432 may be disposed to pass through the through portion 4311 of the shaft 431. The shaft rod 432 may be disposed to pass through, e.g., the shaft 431 and the first rotation portion 433. A portion of the shaft rod 432 may be visible from the outside. The shaft rod 432 may be provided to connect the shaft 431 and the first rotation portion 433 so that the rotational power of the first rotation portion 433 may be transferred to the shaft 431. In case that the shaft rod 432 is pressed in the rotating direction by the rotation of the first rotation portion 433, the shaft 431 coupled to the shaft rod 432 may be rotated. Even when the first rotation portion 433 rotates, in case that the shaft rod 432 moves relative to the first rotation portion 433 in the guide portion 434, the shaft 431 may not rotate.

According to an embodiment, the guide portion 434 may be positioned above the first rotation portion 433. The guide portion 434 may be formed to surround, e.g., a portion of the first rotation portion 433. The cross-sectional area of the guide portion 434 may be greater than the cross-sectional area of the first rotation portion 433. The guide portion 434 may have a substantially cylindrical shape with a hollow inside.

According to an embodiment, a guide groove 4341 configured to guide the movement of the shaft rod 432 may be formed in the inner surface of the guide portion 434. The guide groove 4341 may have an inclined path so that the shaft rod 432 may move upward or downward while rotating.

According to an embodiment, the cleaning cloth module 440 may include a cover member 441, the first member 442, or the second member 443. The cleaning cloth P may be attached or coupled to the lower surface of the cleaning cloth module 440. The cleaning cloth P may tightly contact the floor when the robot cleaner (e.g., the robot cleaner 100 of FIG. 1) operates. For example, the cleaning cloth module 440 may receive rotational power from the shaft 431 to rotate the cleaning cloth P in tight contact with the floor. For example, the cleaning cloth module 440 may be separably coupled to the shaft 431 of the cleaning cloth driver 430.

According to an embodiment, the cover member 441 may be coupled to a lower end of the shaft 431. The cover member 441 may be a portion that receives rotational power directly from the shaft 431. The cover member 441 may include an outer cover member 4411 and an inner cover member 4412. The outer cover member 4411 may be vertically coupled to, e.g., the second member 443. The outer cover member 4411 may form a receiving space 4411*a* in which a portion of the inner cover member 4412 is received so that the inner cover member 4412 may be vertically moved. At least a portion of the inner cover member 4412 may be disposed to be received in the outer cover member 4411. The inner cover member 4412, e.g., may be directly coupled to the shaft 431. The inner cover member 4412 may be disposed to be vertically movable, e.g., within the outer cover member 4411.

According to an embodiment, the inner cover member 4412 may include a stop portion 4412*a*. The stop portion 4412*a* may be stuck to the outer cover member 4411 so that the inner cover member 4412 may no longer move upward. The inner cover member 4412 may move upward until the stop portion 4412*a* is stuck to a portion of the outer cover member 4411. The stop portion 4412*a* may prevent the inner cover member 4412 from falling off the outer cover member 4411 by excessively moving upward. The stop portion 4412*a* may protrude radially outward of, e.g., the inner cover member 4412. The stop portion 4412*a* may extend, e.g., from a lower end of the inner cover member 4412.

According to an embodiment, the outer cover member 4411 may include an inclined guide portion 4411*b* protruding outward of the outer circumferential surface. The inclined guide portion 4411*b* may be formed to be inclined to guide the movement of the first member 442 when the first member 442 is separated from the second member 443 and moves upward.

According to an embodiment, the cleaning cloth module 440 may include a first elastic body 444 disposed between the cover member 441 and the second member 443. One side of the first elastic body 444 may be supported by the inner cover member 441. The other side of the first elastic body 444 may be supported by the second member 443. For example, in case that the first elastic body 444 is compressed, a force may be applied to the inner cover member 4412 upward by the elastic restoring force. For example, in case that the first elastic body 444 is compressed, a force may be applied downward to the second member 443 by the elastic restoring force. The first elastic body 444 may be, e.g., a spring.

If the cleaning cloth P adjacent to the lower surface of the second member 443 comes in tight contact with the floor and is pressed by the weight of the robot cleaner 100, the first elastic body 444 may be compressed. In case that the first elastic body 444 is compressed, the second member 443 is indirectly supported by the floor, and thus a force may be applied upward to the inner cover member 4412 by the elastic restoring force. The force applied by the first elastic body 444 to the inner cover member 4412 may be transferred to the shaft 431 coupled to the inner cover member 4412. For example, when the first elastic body 444 is compressed, a force may be applied upward to the shaft 431. Even when a force is applied to the shaft 431, in case that the shaft rod 432 coupled to the shaft 431 is fixed so as not to be moved upward by the guide rail 4331, the vertical movement of the shaft 431 may be fixed. Although it is illustrated in the drawings that the first elastic body 444 indirectly presses the shaft 431, this is merely an example, and the first elastic body 444 may be disposed between the shaft 431 and the second member 443 to directly press the shaft 431.

According to an embodiment, the second member 443 may be coupled to the cover member 441. For example, the second member 443 and the cover member 441 may be coupled by screwing. For example, the second member 443 may be coupled to the outer cover member 4411. In case that the cover member 441 is rotated by the shaft 431, the second member 443 coupled to the outer cover member 4411 may also be rotated. The second member 443 may have, e.g., a hollow center. The second member 443 may have, e.g., a disk shape as a whole.

According to an embodiment, the first member 442 may be disposed above the second member 443. The first member 442 may be provided to be directly coupled or attached to the cleaning cloth P. The first member 442 may vertically move with respect to the second member 443. In case that the second member 443 rotates while the rotation of the first member 442 is stopped, the first member 442 may be moved upward as the engagement between the first member 442 and the second member 443 is released. The first member 442 may have, e.g., a disk shape as a whole.

According to an embodiment, the first member 442 may include a stop protrusion 4425 protruding from the inner circumferential surface toward the central portion. The stop protrusion 4425 may be disposed to be stuck to the inclined guide portion 4411*b* of the outer cover member 4411. The stop protrusion 4425 may move, e.g., along the inclined guide portion 4411*b* while the first member 442 is separated from the second member 443 and moved upward or downward to be coupled with the second member 443.

According to an embodiment, the cleaning cloth module 440 may include a second elastic body 445 disposed between the first member 442 and the second member 443. One side of the second elastic body 445 may be fixed to the first member 442. The other side of the second elastic body 445 may be fixed to the second member 443. The second elastic body 445 may provide an elastic force in a direction in which the first member 442 and the second member 443 come in tight contact with each other. In case that the distance between the first member 442 and the second member 443 increases, the second elastic body 445 may expand. The expanded second elastic body 445 may be formed with a reaction force in a direction in which the expanded second elastic body 445 contracts, and thus a force may be applied in a direction in which the first member 442 and the second member 443 approach each other. For example, the expanded second elastic body 445 may pull the second member 443 upward. For example, the expanded second elastic body 445 may pull the first member 442 downward. The vertical movement of the second member 443 may be fixed by coupling with the cover member 441 and the shaft 431. The second elastic body 445 may have, e.g., a larger diameter than the first elastic body 444. The second elastic body 445 may be positioned, e.g., outside the cover member 441. The second elastic body 445 may be disposed to surround, e.g., the circumferential surface of the cover member 441. The second elastic body 445 may be, e.g., a torsion spring.

Figure 8:
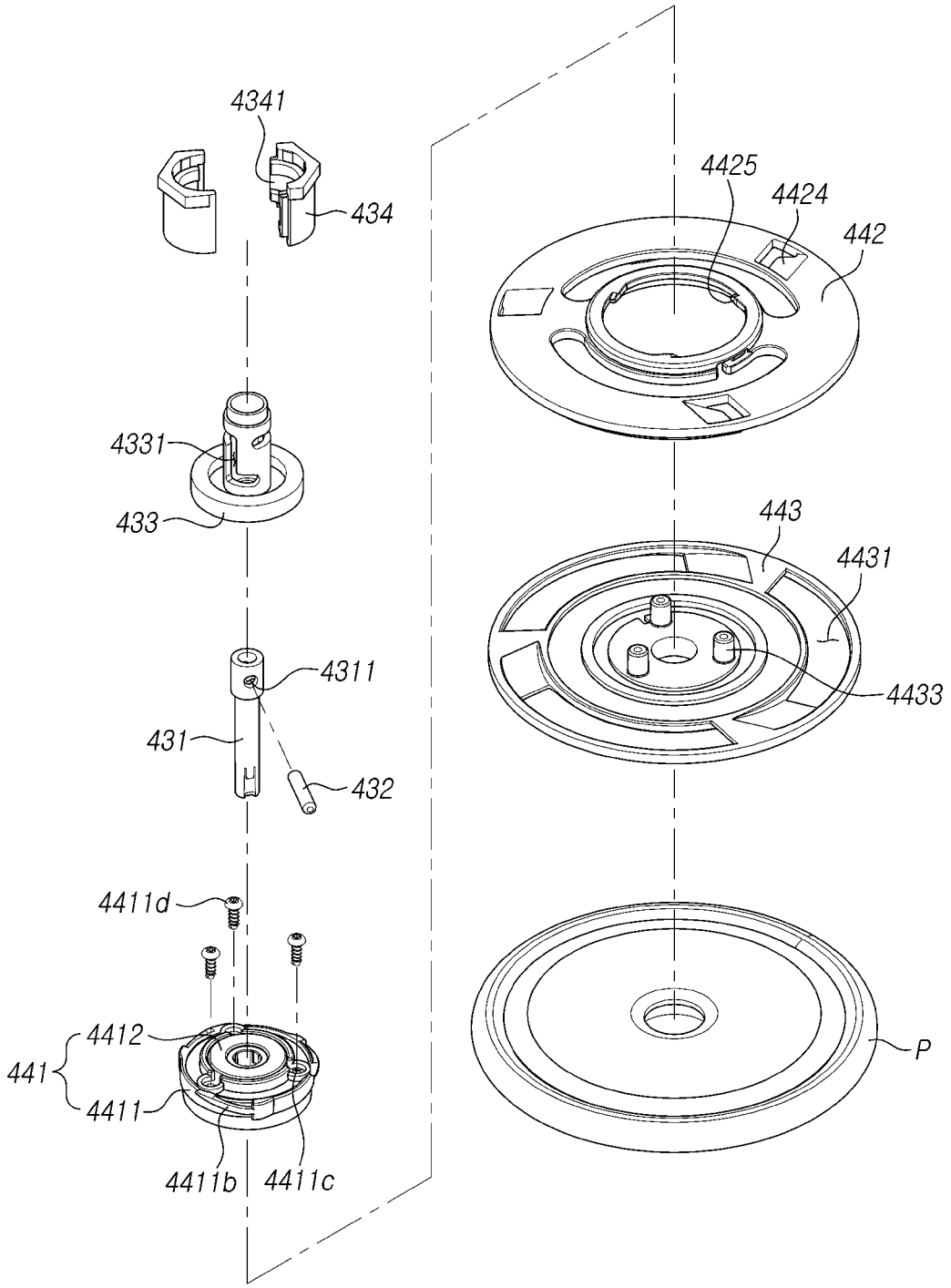
FIG. 8 is a top exploded perspective view illustrating a cleaning cloth driver and a cleaning cloth module according to an embodiment.
Figure 9:
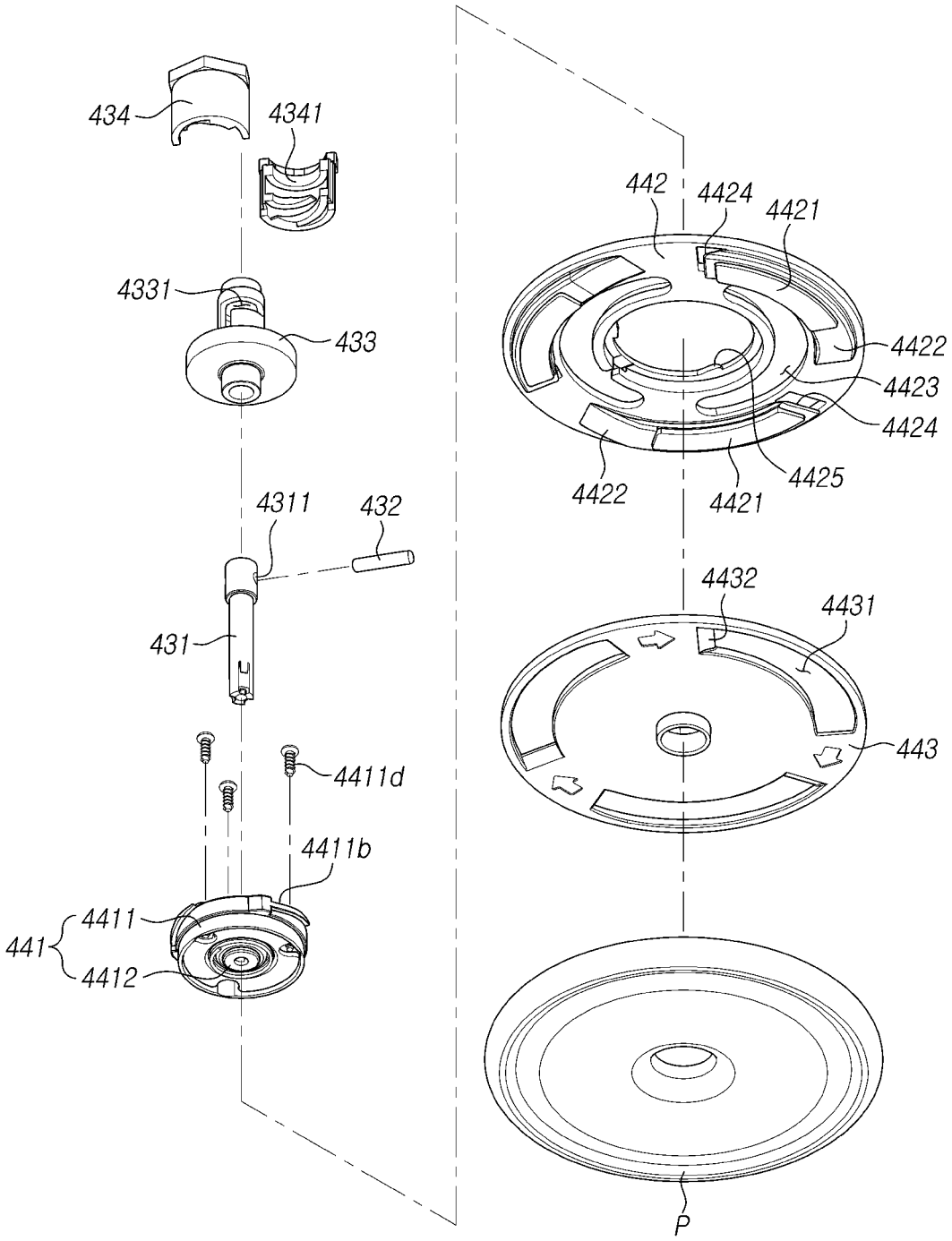
FIG. 9 is a bottom exploded perspective view illustrating a cleaning cloth driver and a cleaning cloth module according to an embodiment.

FIG. 8 is a top exploded perspective view illustrating a cleaning cloth driver and a cleaning cloth module according to an embodiment. FIG. 9 is a bottom exploded perspective view illustrating a cleaning cloth driver and a cleaning cloth module according to an embodiment.

The cleaning cloth driver 430 and the cleaning cloth module 440 illustrated in FIGS. 8 and 9 may be substantially the same as or similar in configuration to the cleaning cloth driver 430 and the cleaning cloth module 440 illustrated in FIGS. 4 to 7. The structure and shape of the cleaning cloth driver 430 and the cleaning cloth module 440 illustrated in FIGS. 8 and 9 are exemplary, and the disclosure is not limited thereto. Hereinafter, descriptions of duplicate configurations will be omitted.

According to an embodiment, the cover member 441 may be coupled to the second member 443. In a state in which the fastening hole 4411*c* of the cover member 441 corresponds to the fastening protrusion 4433 of the second member 443, the fastening portion 4411*d* may pass through the fastening hole 4411*c* and the fastening protrusion 4433, thereby coupling the cover member 441 and the second member 443.

According to an embodiment, the first member 442 may include an attaching member 4421, a first inclined portion 4422, a stopper insertion hole 4423, or a rotating member coupling portion 4424.

According to an embodiment, the attaching member 4421 may be provided to be coupled to the cleaning cloth P. The attaching member 4421 may be positioned on a lower surface of the first member 442. The attaching member 4421, e.g., may have an arc shape as a whole. For example, a plurality of attaching members 4421 may be provided to be spaced apart from each other along the circumferential direction of the first member 442. The attaching member 4421 may be, e.g., a magnet or Velcro, but is not limited thereto, and various types of attachment structures may be applied. The attaching member 4421 may protrude downward of the first member 442 to be attached to the cleaning cloth P through, e.g., the second member 443.

According to an embodiment, the first inclined portion 4422 may be formed to protrude from the first member 442. The first inclined portion 4422 may protrude to a lower surface of the first member 442. The first inclined portion 4422 may be disposed adjacent to, e.g., the attaching member 4421. The first inclined portion 4422 may be positioned near an end portion of the attaching member 4421. The first inclined portion 4422 and the attaching member 4421 may be positioned adjacent to each other and may have an arc shape as a whole.

According to an embodiment, the stopper insertion hole 4423 may have an arc shape. The stopper insertion hole 4423 may be a portion into which a stopper (e.g., the stopper 451 of FIG. 13), which is described below, moves downward and is inserted. The stopper insertion hole 4423 may be positioned closer to the central portion of the first member 442 than the first inclined portion 4422 or the attaching member 4421, but is not limited thereto.

According to an embodiment, the rotating member coupling portion 4424 may be a portion into which a portion of the second member 443 is inserted when the first member 442 is coupled to the second member 443. As a portion of the second member 443 is inserted into the rotating member coupling portion 4424, the first member 442 and the second member 443 may be separably coupled or brought in tight contact with each other. The first member 443 may be rotated together with the second member 443 as the second member 443 is inserted into the rotating member coupling portion 4424.

According to an embodiment, the second member 443 may include an opening 4431 or a second inclined portion 4432. The second inclined portion 4432 may be positioned adjacent to, e.g., the opening 4431. The second inclined portion 4432 and the opening 4431 may be positioned adjacent to each other and may have an arc shape as a whole. The second inclined portion 4432 may be, e.g., a portion inserted into the rotating member coupling portion 4424 of the first member 442.

According to an embodiment, the opening 4431 may be disposed at a position corresponding to the attaching member 4421. The opening 4431 may have, e.g., an arc shape as a whole. In a state in which the first member 442 and the second member 443 are coupled, the attaching member 4421 and the first inclined portion 4422 of the first member 442 may be seated in the opening 4431 of the second member 443. The first member 442 and the second member 443 may be coupled such that, e.g., the opening 4431 and the attaching member 4421 overlap each other. The first member 442 and the second member 443 may be coupled such that, e.g., a portion of the opening 4431 and the first inclined portion 4422 overlap each other. In case that the first member 442 and the second member 443 are coupled or brought in tight contact, the first inclined portion 4422 may be positioned in the opening 4431. The attaching member 4421 may be coupled to or attached to the cleaning cloth P through the opening 4431. In case that the distance between the first member 442 and the second member 443 increases, the attaching member 4421 and the cleaning cloth P may also be spaced apart from each other so that the cleaning cloth P may be separated from the cleaning cloth module 440.

If only the second member 443 rotates with the first member 442 fixed, one surface of the second member 443 may move along the first inclined portion 4422, so that the gap between the first member 442 and the second member 443 may be widened.

FIGS. 10A, 10B, 10C, 10D, 10E, and 10F are views illustrating a lifting operation process of a cleaning cloth driver according to an embodiment.

The cleaning cloth driver 430 illustrated in FIGS. 10A to 10F may be substantially the same as or similar in configuration to the cleaning cloth driver 430 illustrated in FIGS. 4 to 9. The operations illustrated in FIGS. 10A to 10F are for describing an operation in which a robot cleaner (e.g., the robot cleaner 100 of FIG. 1) lifts a cleaning cloth (e.g., the cleaning cloth P of FIG. 1) upward, and are described under the assumption that the cleaning cloth P is mounted on the robot cleaner 100 and comes in tight contact with the floor.

According to an embodiment, the guide rail 4331 of the first rotation portion 433 may include a first guide rail 4331*a*, a second guide rail 4331*b*, or a third guide rail 4331*c*. The first guide rail 4331*a* may extend in a horizontal direction. The second guide rail 4331*b* may extend from one end portion of the first guide rail 4331*a*. The second guide rail 4331*b* may extend, e.g., in a direction perpendicular to the first guide rail 4331*a*. The third guide rail 4331*c* may extend from one end portion of the second guide rail 4331*b*. In other words, the second guide rail 4331*b* may connect the first guide rail 4331*a* and the first guide rail 4331*a*. As the shaft rod 432 moves between the first guide rail 4331*a*, the second guide rail 4331*b*, and the third guide rail 4331*c*, the shaft 431 may be vertically moved.

Figure 10A:
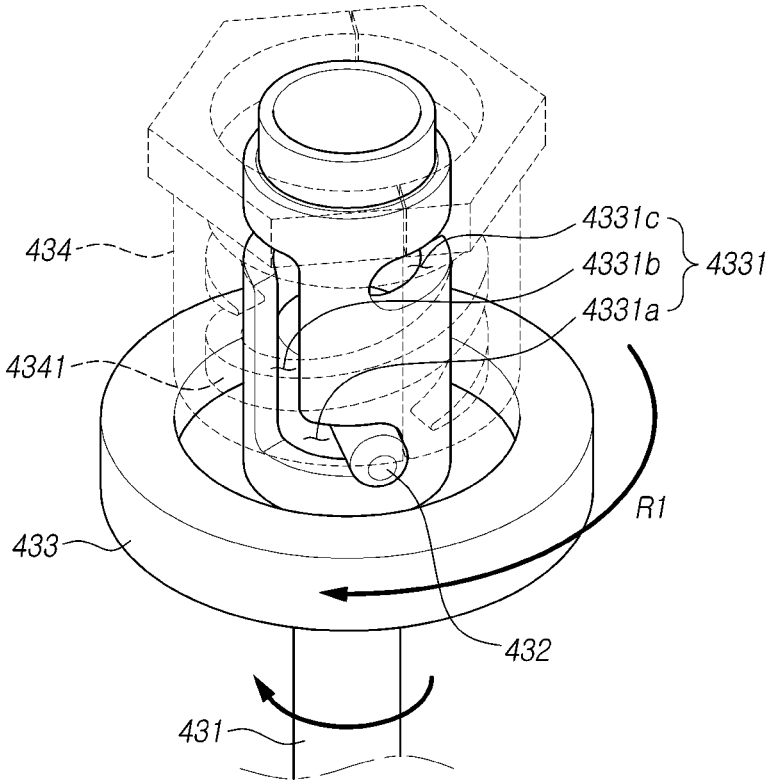
FIGS. 10A, 10B, 10C, 10D, 10E, and 10F are views illustrating a lifting operation process of a cleaning cloth driver according to an embodiment.

Referring to FIG. 10A, when the first rotation portion 433 rotates in the first direction R1, the shaft rod 432 may be stuck to the edge of the first guide rail 4331*a* so that the shaft 431 may also rotate in the first direction R1. For example, the shaft rod 432 may be rotated by pressing of the first rotation portion 433 while being stuck to the closed end portion of the first guide rail 4331*a*. The first direction R1 may refer to, e.g., a clockwise direction when the first rotation portion 433 is viewed from above, but is not limited thereto. In case that the shaft rod 432 is positioned on the first guide rail 4331*a*, the shaft 431 may move downward so that the cleaning cloth P attached to the cleaning cloth module 440 may come in tight contact with the floor. In a state in which the shaft rod 432 is positioned on the first guide rail 4331*a*, the shaft rod 432 may be positioned below (or outside) the guide portion 434. In other words, the first guide rail 4331*a* may be a portion that is not surrounded by the guide portion 434.

Figure 10B:
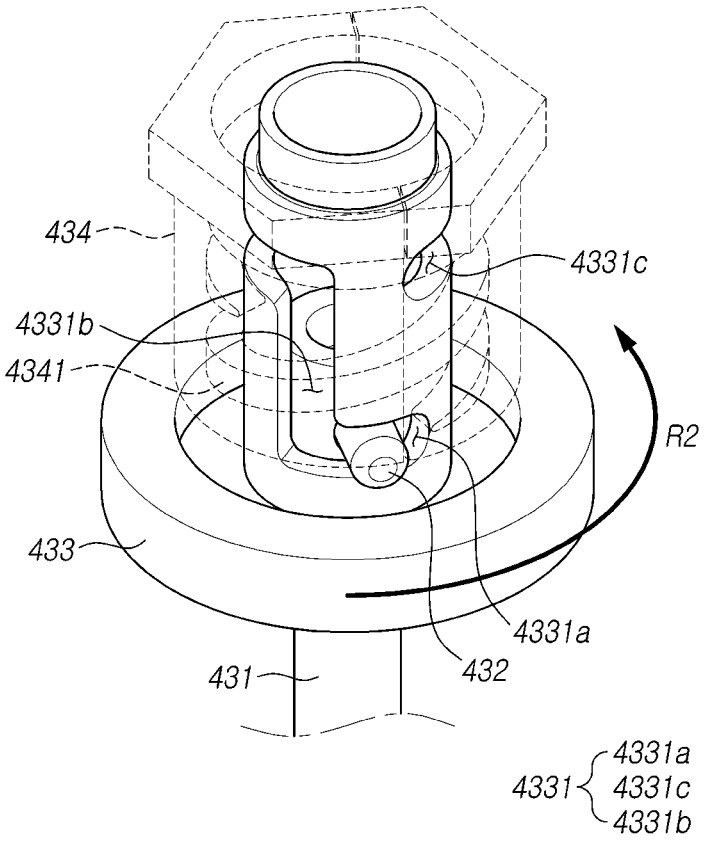

FIG. 10B is a view illustrating an initial state in which the first rotation portion 433 rotates in a second direction R2 opposite to the first direction R1 in the state of FIG. 10A. Referring to FIG. 10B, when the first rotation portion 433 starts to rotate in the second direction R2, the shaft rod 432 may be moved along the first guide rail 4331*a* relative to the first rotation portion 433. In this case, only the first rotation portion 433 may be rotated while the shaft rod 432 is not rotated. The second direction R2 may refer to, e.g., a counterclockwise direction when the first rotation portion 433 is viewed from above, but is not limited thereto.

Figure 10C:
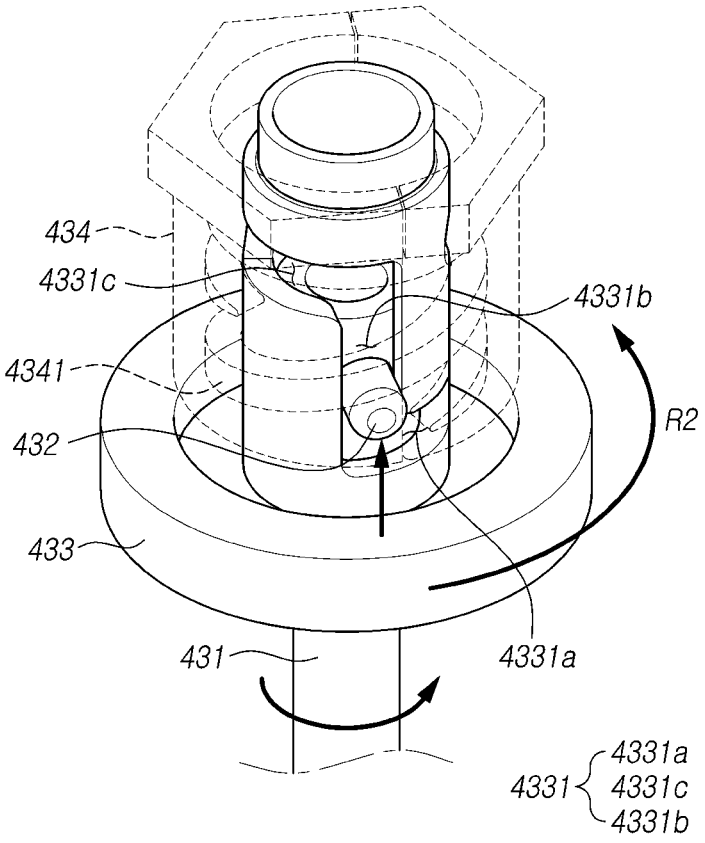

FIG. 10C is a view illustrating a state in which the shaft rod 432 enters the second guide rail 4331*b* as the first rotation portion 433 keeps rotating in the second direction R2 in the state of FIG. 10B. In case that the shaft rod 432 enters the second guide rail 4331*b*, the shaft rod 432 may be moved upward by the repulsive force of the above-described first elastic body (e.g., the first elastic body 444 of FIG. 7).

Figure 10D:
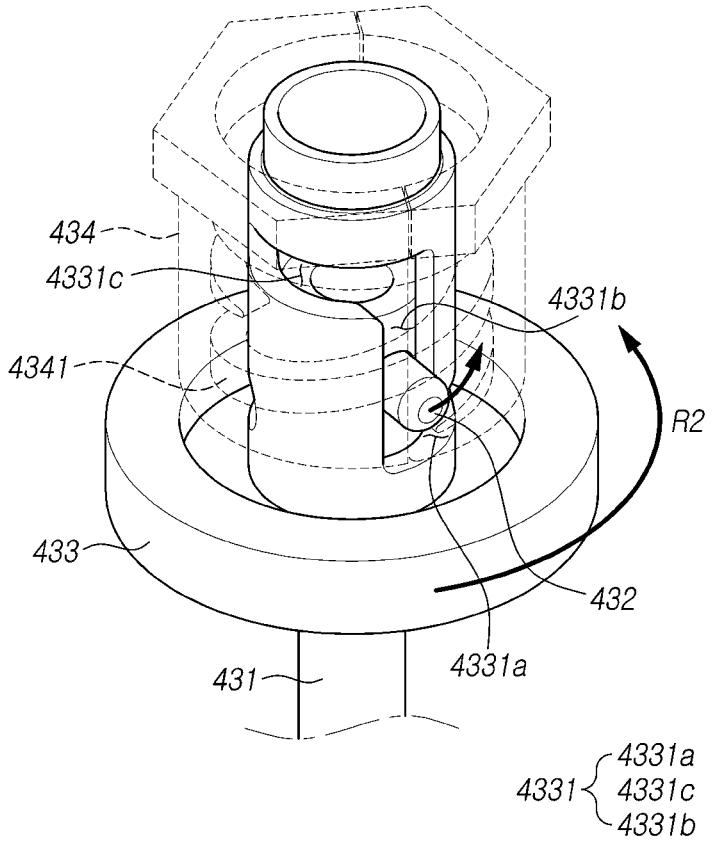

FIG. 10D is a view illustrating a state in which the shaft rod 432 of the first rotation portion 433 enters the guide groove 4341 of the guide portion 434 in the state of FIG. 10C. In case that the shaft rod 432 is moved upward of the lower end of the second guide rail 4331*b* by the repulsive force of the first elastic body 444, the guide rail 4331 may enter the guide groove 4341 of the guide portion 434.

Figure 10E:
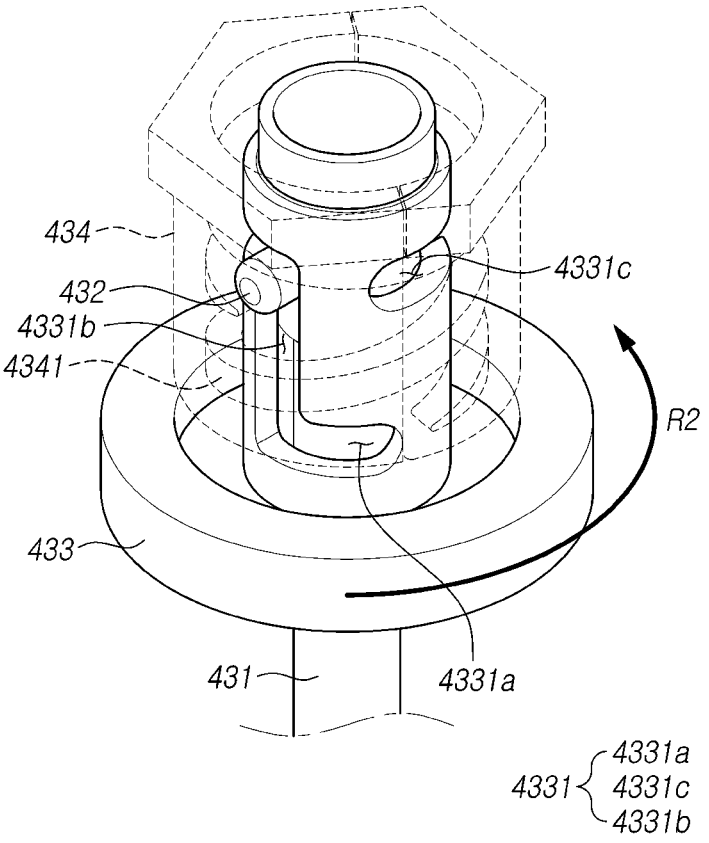

FIG. 10E is a view illustrating a state in which the shaft rod 432 is moved upward along the guide groove 4341 as the first rotation portion 433 keeps rotating in the second direction R2 in the state of FIG. 10D. While the shaft rod 432 passes through the second guide rail 4331*b*, the shaft rod 432 may be stuck to the edge of the second guide rail 4331*b* and may be rotated in the second direction R2 together with the first rotation portion 433. In case that the shaft rod 432 is moved in the second direction R2, the shaft rod 432 may be moved upward along the upward inclined guide groove 4341. In case that the shaft rod 432 is moved upward, not only the shaft 431 coupled thereto but also the cleaning cloth module 440 coupled to the shaft 431 may be moved upward.

Figure 10F:
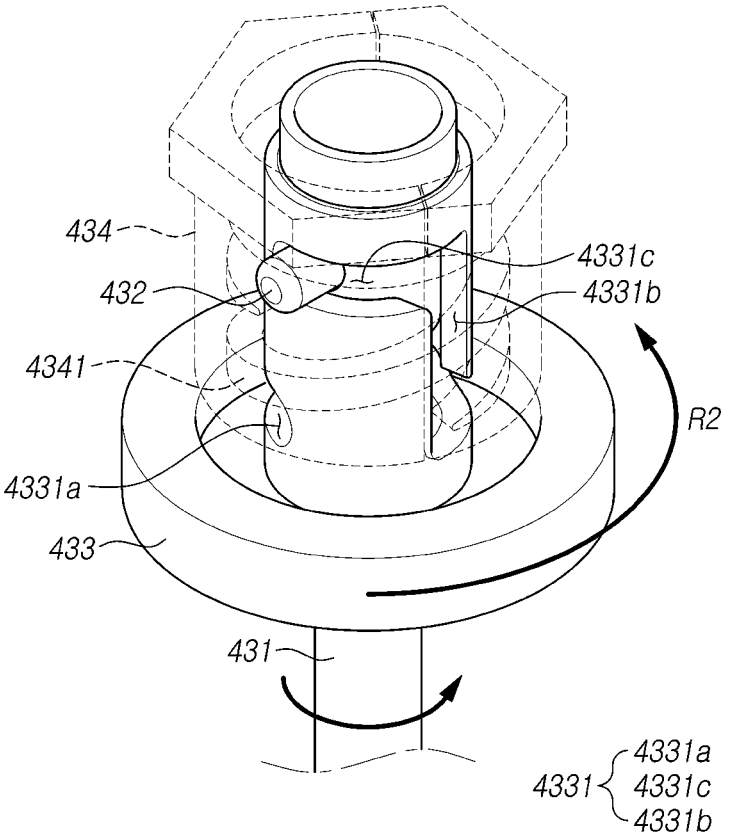

FIG. 10F is a view illustrating a scene in which the shaft rod 432 is moved toward the closed end of the third guide rail 4331*c* as the first rotation portion 433 keeps rotating in the second direction R2 in the state of FIG. 10E. After the shaft rod 432 reaches the upper end portion of the second guide rail 4331*b* along the guide groove 4341, the shaft rod 432 may be moved along the third guide rail 4331*c*. In case that the shaft rod 432 reaches the upper end portion of the second guide rail 4331*b*, the shaft 431 and the cleaning cloth module 440 may no longer be lifted. In case that the shaft rod 432 reaches the closed end portion of the third guide rail 4331*c*, the shaft rod 432 may be rotated in the second direction R2 together with the first rotation portion 433.

In the state of FIG. 10F, in case that the first rotation portion 433 rotates again in the first direction R1, the shaft rod 432 may be moved in the reverse order of FIGS. 10A to 10F In this case, when the shaft rod 432 reaches the upper end portion of the second guide rail 4331*b*, the shaft rod 432 may be moved downward of the second guide rail 4331*b* by gravity.

Figure 11A:
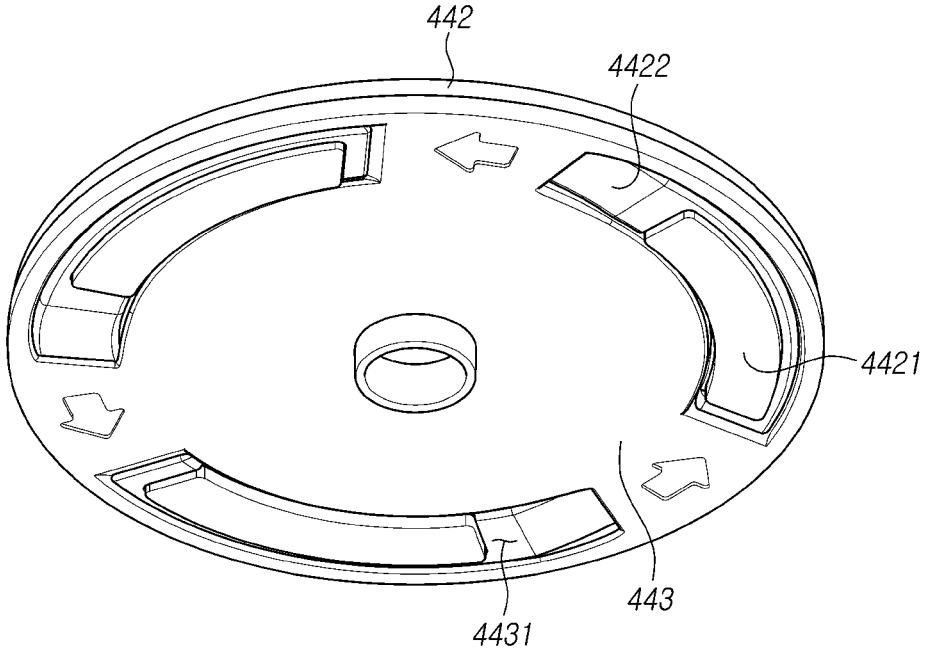
FIGS. 11A and 11B are views illustrating the interference between a first member and a rotating member in a cleaning cloth driver according to an embodiment.
Figure 11B:
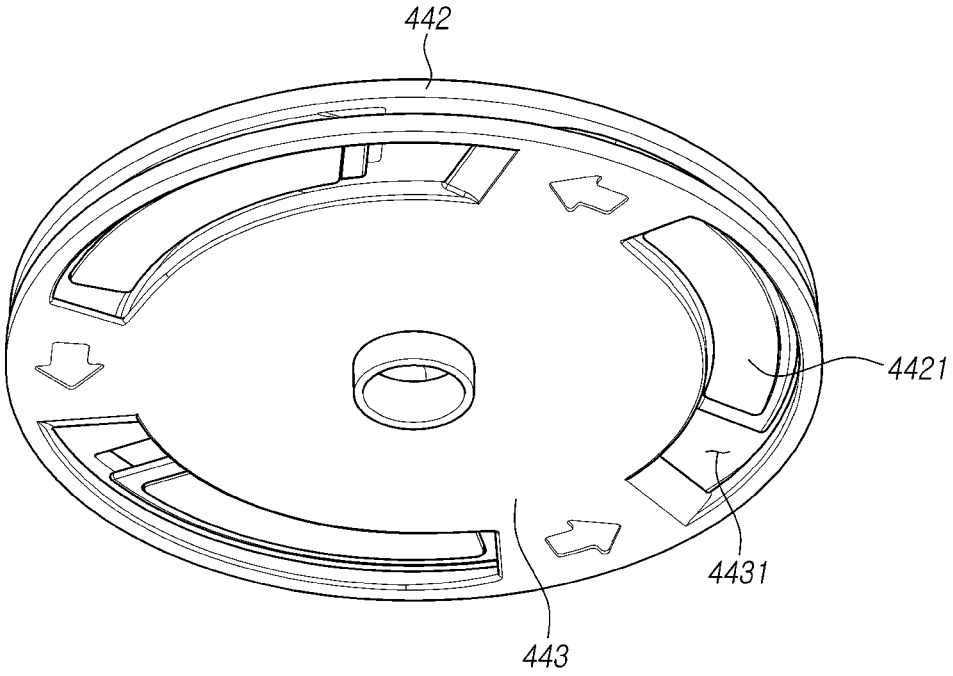
Figure 12:
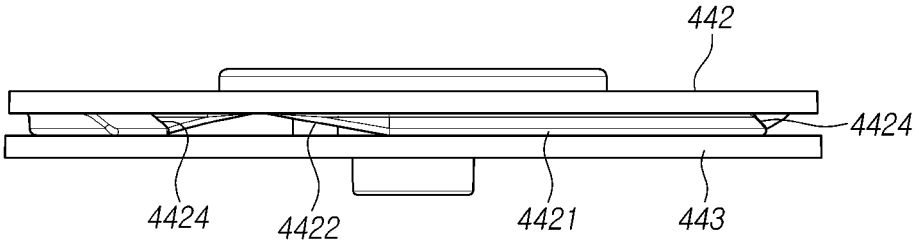
FIG. 12 is a side view of FIG. 11B.

FIGS. 11A and 11B are views illustrating the interference between a first member and a rotating member in a cleaning cloth driver according to an embodiment. FIG. 12 is a side view of FIG. 11B.

The first member 442 and the second member 443 illustrated in FIGS. 11A, 11B, and 12 may be substantially the same in configuration as the first member 442 and the second member 443 illustrated in FIGS. 6 to 9. The structure and shape of the first member 442 and the second member 443 illustrated in FIGS. 11A, 11B, and 12 are exemplary, and the disclosure is not limited thereto. Hereinafter, descriptions of duplicate configurations will be omitted.

Referring to FIG. 11A, as illustrated, the first member 442 and the second member 443 may be coupled such that the attaching member 4421 and the first inclined portion 4422 of the first member 442 are positioned in the opening 4431 of the second member 443. In case that the cleaning cloth module 440 rotates in the first direction (e.g., the first direction R1 of FIG. 10A), the second member 443 and the first member 442 may rotate together in the first direction R1 in the coupled state.

If only the second member 443 rotates while the stopper (e.g., the stopper 451 of FIG. 13) is inserted into the stopper insertion hole 4423 of the first member 442 to stop the rotation of the first member 442, the second member 443 may rotate while contacting the first inclined portion 4422 positioned in the opening 4431. In case that one surface of the second member 443 moves along the first inclined portion 4422, the first member 442 and the second member 443 may be spaced apart from each other as illustrated in FIGS. 11B and 12.

Figure 13:
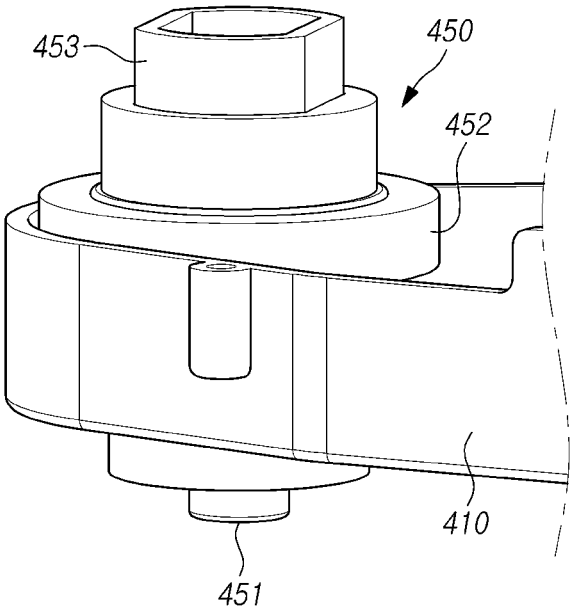
FIG. 13 is a view illustrating a separation driver in a cleaning driver according to an embodiment.
Figure 14:
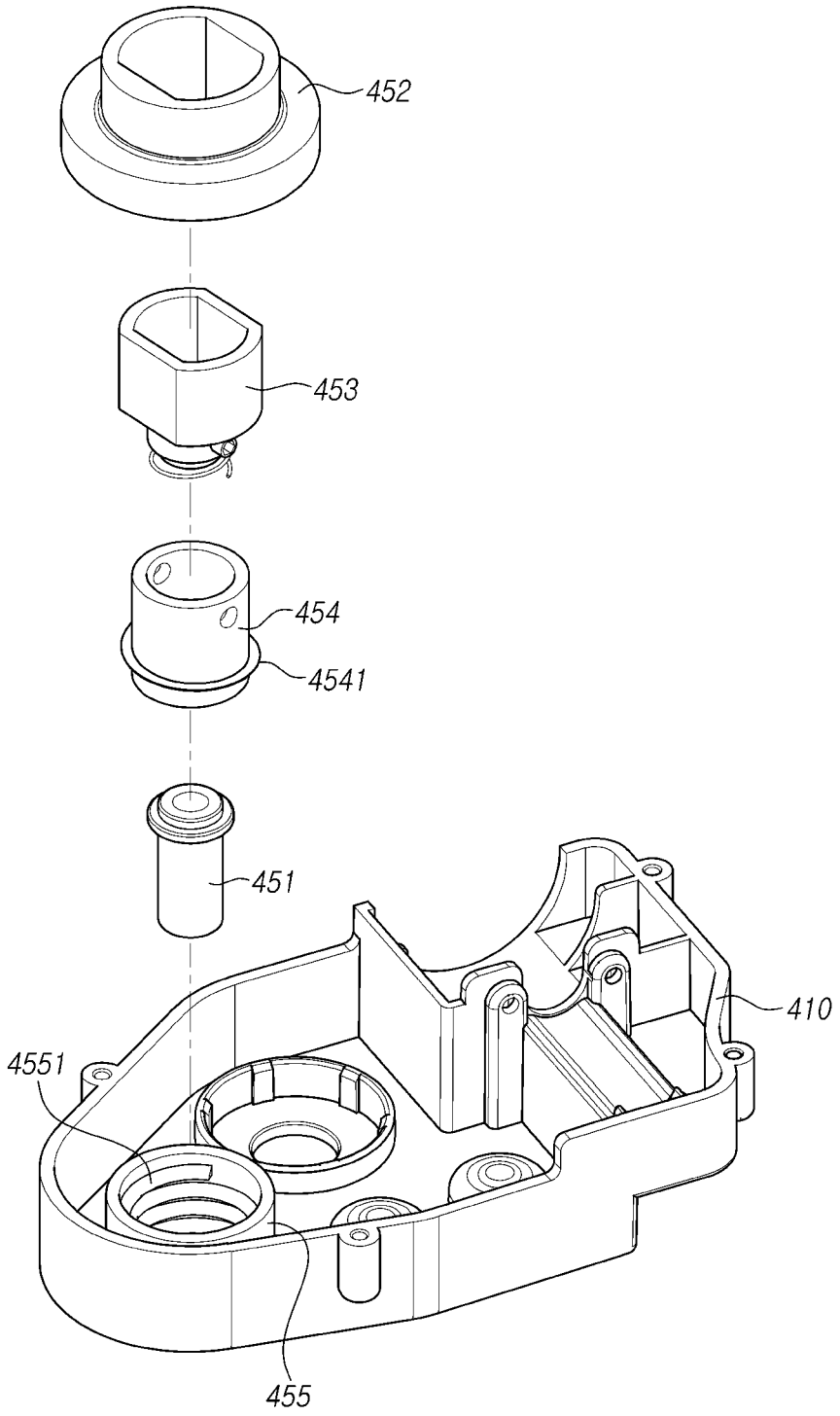
FIG. 14 is an exploded perspective view illustrating a separation driver in a cleaning driver according to an embodiment.
Figure 15:
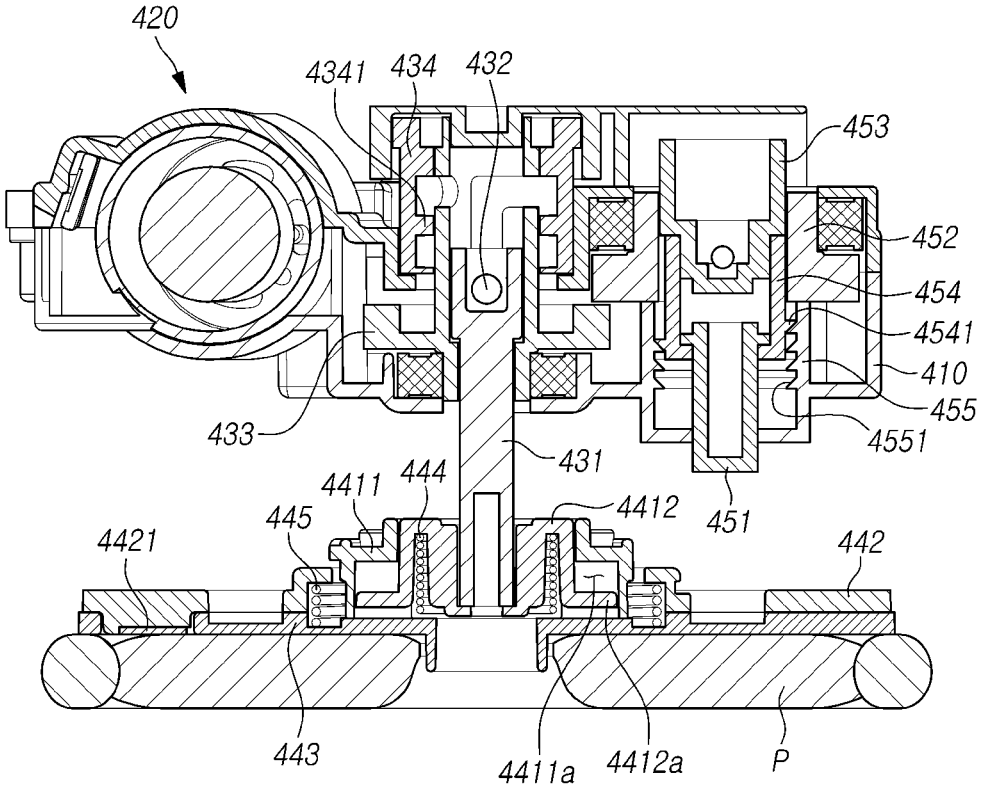
FIG. 15 is a cross-sectional view illustrating a cleaning driver according to an embodiment.

FIG. 13 is a view illustrating a separation driver in a cleaning driver according to an embodiment. FIG. 14 is an exploded perspective view illustrating a separation driver in a cleaning driver according to an embodiment. FIG. 15 is a cross-sectional view illustrating a cleaning driver according to an embodiment.

The separation driver 450 illustrated in FIGS. 13 to 15 may be substantially the same in configuration as the separation driver 450 illustrated in FIGS. 4 and 5. The structure and shape of the separation driver 450 illustrated in FIGS. 13 to 15 are exemplary, and the disclosure is not limited thereto.

According to an embodiment, the separation driver 450 may include the stopper 451, the second rotation portion 452, a connection portion 453, a vertical movement portion 454, or a cylindrical portion 455.

According to an embodiment, the second rotation portion 452 may be engaged with a second gear unit (e.g., the second gear unit 462 of FIG. 5). In case that the motor (e.g., the motor 420 of FIG. 4) rotates, the second rotation portion 452 may be rotated by the rotational power transferred by the gear assembly (e.g., the gear assembly 460 of FIG. 5). The second rotation portion 452 may be formed to be hollow. The connection portion 453 may be disposed in a hollow portion of the second rotation portion 452.

According to an embodiment, the connection portion 453 may be configured to connect the second rotation portion 452 and the vertical movement portion 454. The vertical movement portion 454 may be coupled to a lower side of the second rotation portion 452. The connection portion 453 may be rotated together as the second rotation portion 452 is rotated.

According to an embodiment, the vertical movement portion 454 may be connected to the connection portion 453 and may be rotated together according to the rotation of the second rotation portion 452. For example, a portion of the vertical movement portion 454 may be received in a hollow portion of the second rotation portion 452. The vertical movement portion 454 may be disposed such that, e.g., a portion thereof protrudes downward of the second rotation portion 452. The vertical movement portion 454 may have, e.g., a cylindrical shape as a whole. According to an embodiment, the vertical movement portion 454 may be directly coupled to the second rotation portion 452 without the connection portion 453.

According to an embodiment, a thread coupling portion 4541 may be formed at a lower portion of the vertical movement portion 454. The thread coupling portion 4541 may be formed to protrude, e.g., along the outer circumferential surface of the vertical movement portion 454.

According to an embodiment, the cylindrical portion 455 may be coupled to a lower portion of the vertical movement portion 454. The cylindrical portion 455 may have an empty cylindrical shape. A thread 4551 may be formed on the inner circumferential surface of the cylindrical portion 455. In case that the thread coupling portion 4541 of the vertical movement portion 454 is coupled to the thread 4551 of the cylindrical portion 455 and the vertical movement portion 454 is rotated, the thread coupling portion 4541 may move along the thread 4551 of the cylindrical portion 455 and vertically move. The cylindrical portion 455 may be integrally formed with the housing 410 as illustrated, but is not limited thereto. The cylindrical portion 455 may be manufactured as a separate component and coupled to the housing 410.

According to an embodiment, the stopper 451 may be coupled to a lower portion of the vertical movement portion 454. As described above, in case that the second rotation portion 452 is rotated by the rotation of the motor 420, the vertical movement portion 454 may be moved upward or downward. As the vertical movement portion 454 is moved upward or downward, the stopper 451 may also be moved upward or downward. The stopper 451 may be disposed to protrude from the lower surface of the housing 410.

According to an embodiment, the separation driver 450 may be disposed to be inserted into a stopper insertion hole (e.g., the stopper insertion hole 4423 of FIG. 8) of the first member (e.g., the first member 442 of FIG. 8) in case that the stopper 451 descends. The stopper 451 may be positioned, e.g., at a portion of the portion overlapping the stopper insertion hole 4423 when viewed from below. For example, when the cleaning cloth module 440 is moved upward, the stopper 451 may be moved downward. For example, while the cleaning cloth module 440 is rotated in one direction for upward movement, the stopper 451 may be rotated in one direction for downward movement.

FIGS. 16, 17, 18, and 19 are views illustrating a process in which a cleaning driver automatically attaches and detaches a cleaning cloth according to an embodiment.

Figure 16:
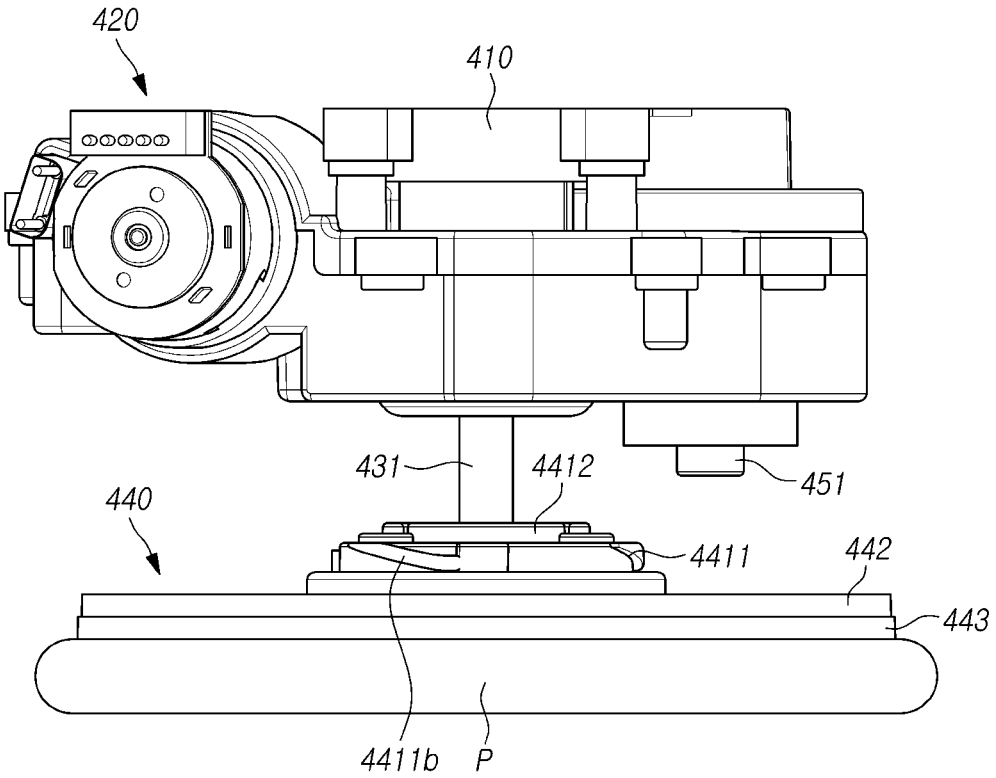
FIGS. 16, 17, 18, and 19 are views illustrating a process in which a cleaning driver automatically attaches and detaches a cleaning cloth according to an embodiment.

Referring to FIG. 16, the robot cleaner 100 may clean the floor by rotating the cleaning cloth module 440 in the first direction R1. In case that the cleaning cloth module 440 is rotated in the first direction R1, the cleaning cloth module 440 may be rotated while the cleaning cloth P comes in tight contact with the floor surface to clean the floor surface.

Figure 17:
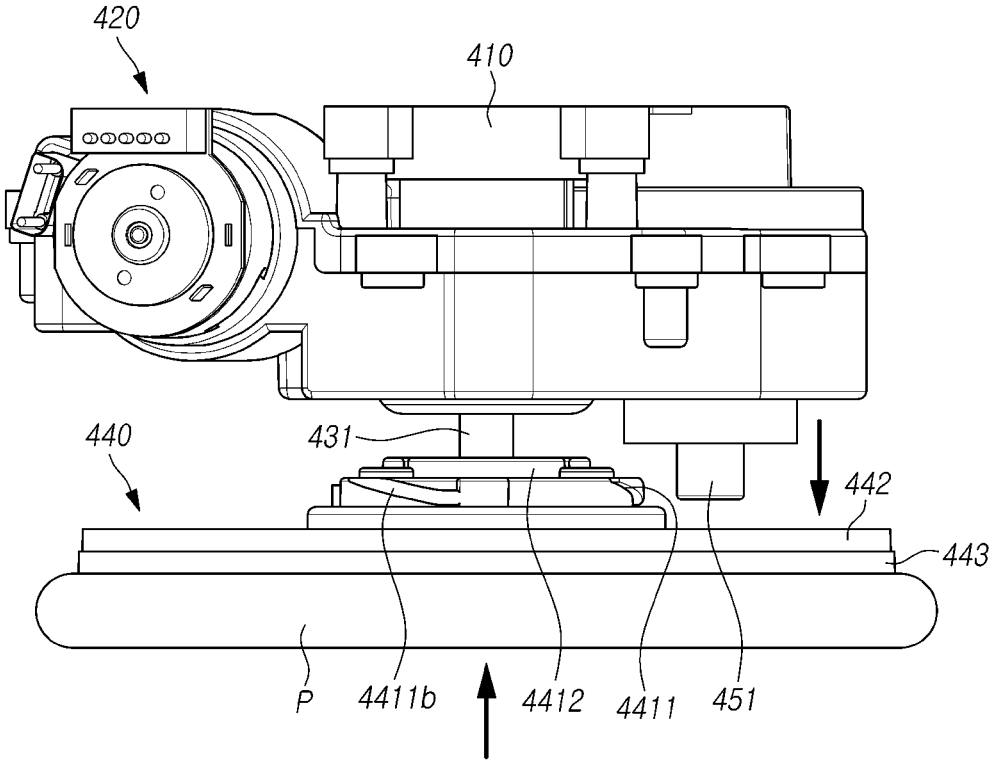

Referring to FIG. 17, in case that it is determined that the cleaning cloth P needs to be replaced, the robot cleaner 100 may raise the cleaning cloth module 440. For example, the robot cleaner 100 may determine whether the cleaning cloth P needs to be replaced based on the degree of contamination of the cleaning cloth P identified using a contamination level sensor (not shown). For example, the robot cleaner 100 may determine whether it is necessary to replace the cleaning cloth P based on the time used for cleaning the floor of the cleaning cloth P. For example, in case that the cleaning cloth P is used for cleaning the floor in excess of a predetermined time, the robot cleaner 100 may determine that the cleaning cloth P needs to be replaced. The determination may be performed by a controller (e.g., the controller 350 of FIG. 3) of the robot cleaner 100.

The robot cleaner 100 may raise the cleaning cloth module 440 while lowering the stopper 451 of the separation driver 450. In this case, the speed at which the cleaning cloth module 440 is raised may be faster than the speed at which the stopper 451 is lowered. Even after the cleaning cloth module 440 is moved upward to the maximum height, the stopper 451 may be continuously rotated and lowered. In case that the robot cleaner 100 determines that the cleaning cloth P should be spaced apart from the floor during cleaning, the robot cleaner 100 may perform the operation illustrated in FIG. 17 to raise the cleaning cloth P. In the state of FIG. 17, since the stopper 451 does not interfere with the rotation of the first member 442, the cleaning cloth P may be spaced apart from the floor while maintaining a state in which the cleaning cloth P is attached to the first member 442.

For example, the robot cleaner 100 may rotate the cleaning cloth module 440 in the second direction R2 opposite to the first direction R1 to move the cleaning cloth module 440 upward. In this case, the robot cleaner 100 may be provided with the cleaning cloth driver 430 described with reference to FIGS. 6 to 10F.

Figure 18:
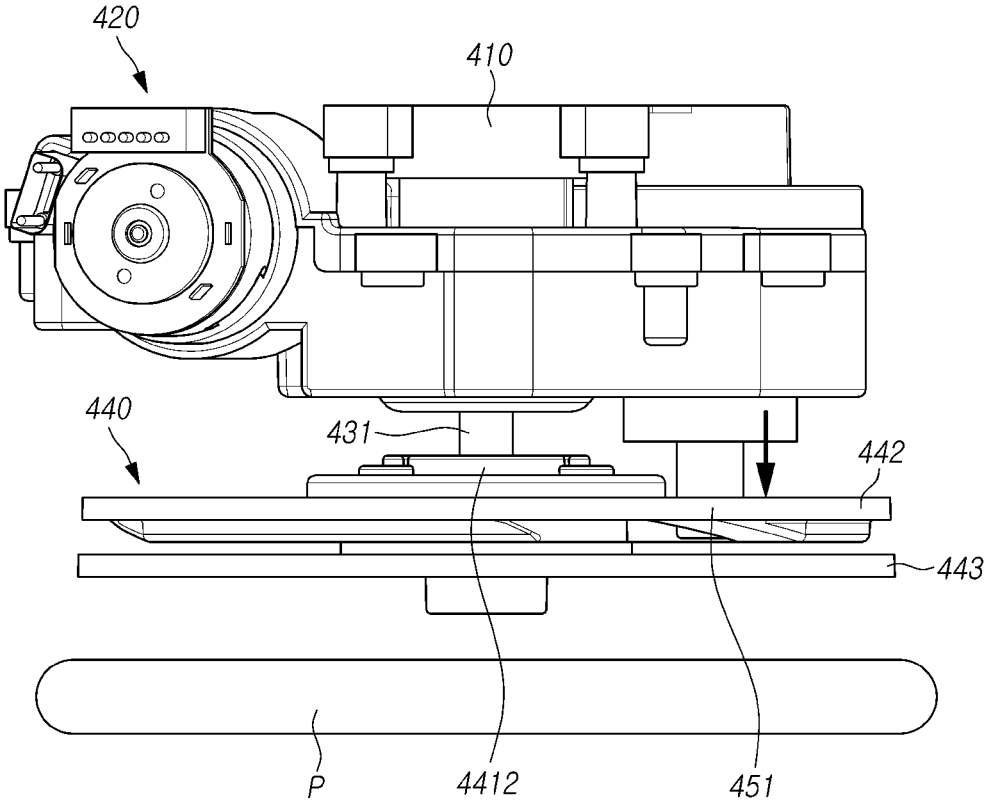

Referring to FIG. 18, the robot cleaner 100 may lower the stopper 451 even after the upward movement of the cleaning cloth module 440 is completed. While the stopper 451 is lowered, the cleaning cloth module 440 may be rotated even when the upward movement is completed. The stopper 451 may be lowered until it is inserted into the stopper insertion hole 4423 of the first member 442. In case that the stopper 451 is inserted into the stopper insertion hole 4423, the stopper may be stuck to the edge of the stopper insertion hole 4423, thereby stopping rotation of the first member 442. Even when the stopper 451 stops the rotation of the first member 442, the second member 443 of the cleaning cloth module 440 may keep rotating. As only the second member 443 is rotated while the first member 442 is stopped, the second member 443 may press the first inclined portion 4422, and thus the first member 442 may be moved upward. As the stop protrusion (e.g., the stop protrusion 4425 of FIG. 6) is moved upward along the inclined guide portion 4411*b* of the outer cover member 4411, the first member 442 may be moved upward. In other words, a gap between the second member 443 and the first member 442 may be widened. In case that the first member 442 is moved upward, the cleaning cloth P coupled to the first member 442 at the lower side of the second member 443 may be decoupled or detached from the first member 442. As a result, the cleaning cloth P may be separated from the cleaning cloth module 440.

Figure 19:
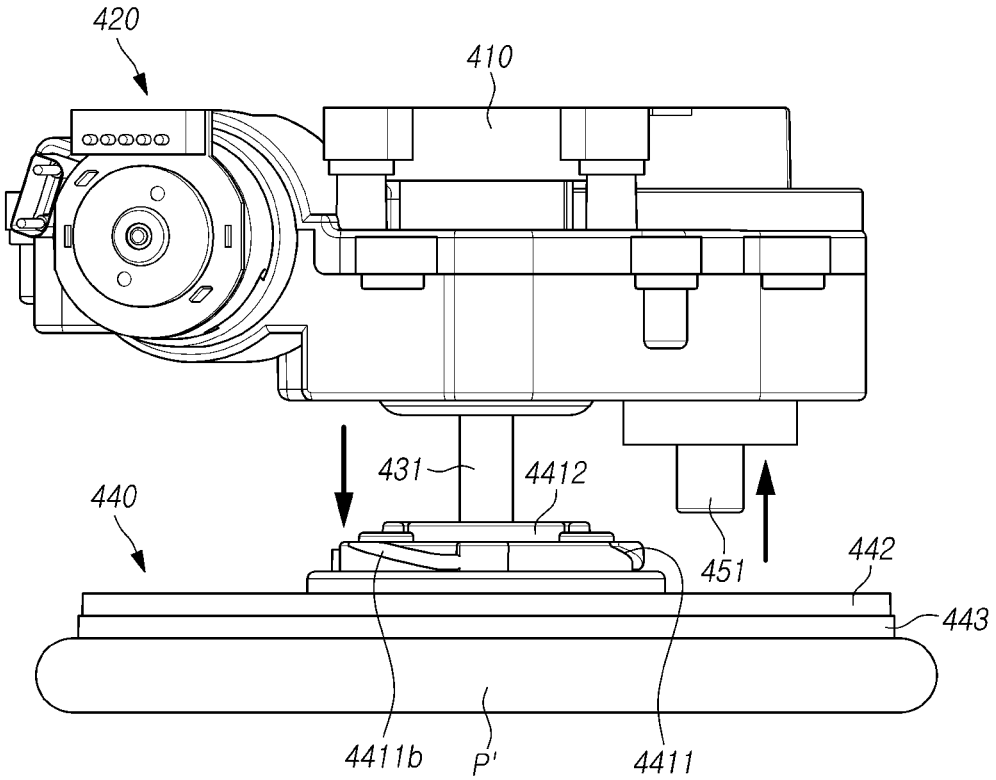

Referring to FIG. 19, the robot cleaner 100 may lower the cleaning cloth module 440 to replace with anew cleaning cloth P'. The new cleaning cloth P' may be disposed at a predetermined position. The robot cleaner 100 may move to a predetermined position, align the cleaning cloth module 440 to be positioned above the new cleaning cloth P', and then lower the cleaning cloth module 440. When the cleaning cloth module 440 is lowered, the stopper 451 may be raised. For example, the cleaning cloth module 440 may be lowered while being rotated. The second member 443 and the first member 442 may be realigned and coupled to the first member 442 as the second member 443 rotates. As the stop protrusion 4425 is moved downward along the inclined guide portion 4411*b* of the outer cover member 4411, the first member 442 may be moved downward. In case that the first member 442 descends, the first member 442 may come in tight contact with the second member 443 by the elastic restoring force of the second elastic body (e.g., the second elastic body 445 of FIG. 7) disposed between the second member 443 and the first member 442. In case that the first member 442 comes in tight contact with the second member 443, the first member 442 and the second member 443 may be rotated together again.

In the process of separating the cleaning cloth P, the cleaning cloth driver 430 does not necessarily have to be applied only to the components illustrated in FIGS. 6 to 10F, but various other structures for raising or lowering the cleaning cloth module 440 may be applied. In other words, any vacuum cleaner having a structure for lifting the cleaning cloth module 440 may automatically separate and/or attach the cleaning cloth P as illustrated in FIGS. 16 to 19 in case that it is a vacuum cleaner having the separation driver 450 and the cleaning cloth module 440 illustrated. The cleaning cloth driver 430 may raise or lower the cleaning cloth module 440 by the structure shown in FIGS. 6 to 10F, but is not limited thereto, and various lifting structures applicable by one of ordinary skill in the art may be applied.

According to an embodiment, the cleaning cloth P may be separated from the cleaning cloth module 440 by using only the operation of lowering the stopper 451 of the separation driver 450 without the lifting structure or process of the cleaning cloth module 440. For example, even if the cleaning cloth module 440 does not rise, the cleaning cloth P may be separated from the cleaning cloth module 440 by lowering the stopper 451 until the stopper 451 is inserted into the stopper insertion hole 4423 of the first member 442.

Hereinafter, various structures for vertically moving the cleaner module and various structures for vertically moving the separation driver are described with reference to FIGS. 20 to 27B.

Figure 20:
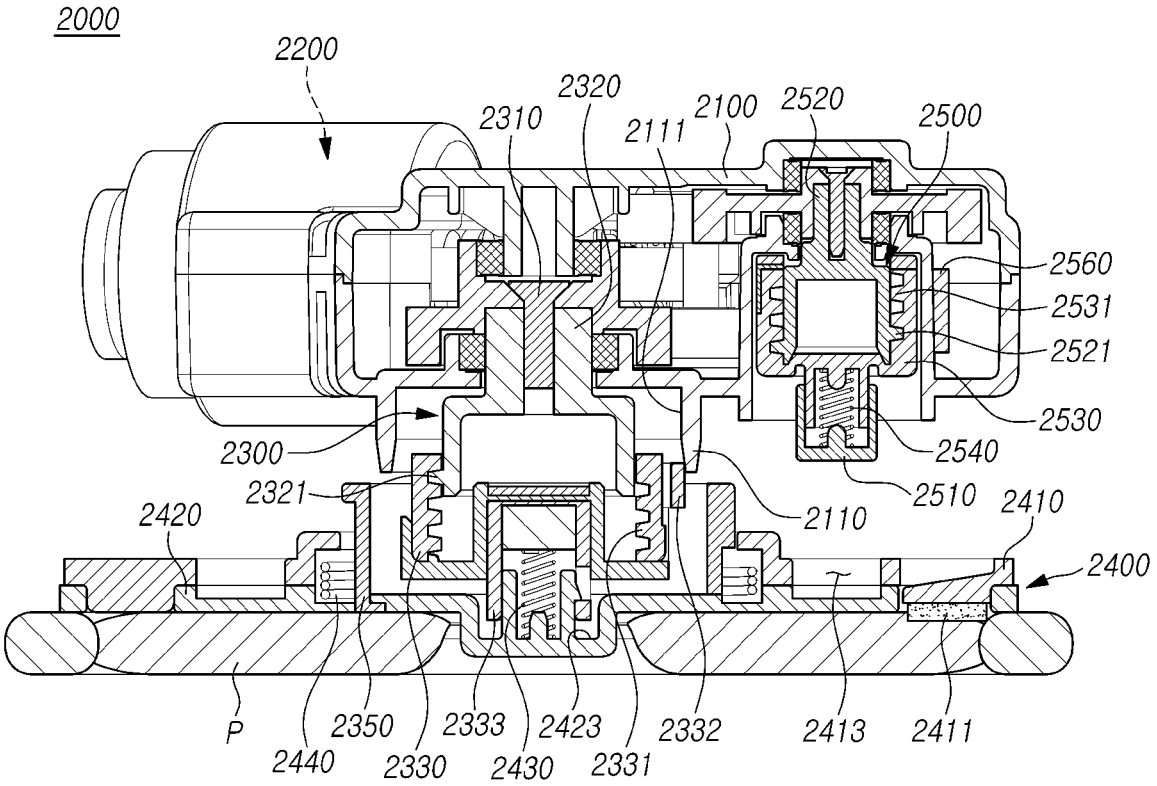
FIG. 20 is a cross-sectional view illustrating a cleaning driver according to an embodiment.

FIG. 20 is a cross-sectional view illustrating a cleaning driver according to an embodiment.

The cleaning driver 2000 illustrated in FIG. 20 may be included as some components of the robot cleaner 100 described with reference to FIGS. 1 to 3. The robot cleaner 100 of FIGS. 1 to 3 may include at least one cleaning driver 2000.

The housing 2100 and the motor 2200 of the cleaning driver 2000 illustrated in FIG. 20 may be substantially the same in configuration as the housing 410 and the motor 420 of the cleaning driver 400 illustrated in FIGS. 4 to 19. Further, although not shown, the cleaning driver 2000 of FIG. 20 may have the gear assembly 460 shown in FIG. 5 to transfer the rotational power of the motor 2200 to the cleaning cloth driver 2300 and/or the separation driver 2500. Hereinafter, a detailed description of a configuration that is substantially the same as the configuration described with reference to FIGS. 4 to 19 will be omitted.

According to an embodiment, the cleaning driver 2000 may include a cleaning cloth driver 2300. The cleaning cloth driver 2300 may transfer the rotational power to the cleaning cloth module 2400 due to the power transferred from the motor 2200. The cleaning cloth driver 2300 may be disposed, e.g., through the lower surface of the housing 2100, but is not limited thereto. At least a portion of the cleaning cloth driver 2300 may be received in the housing 2100.

According to an embodiment, the cleaning cloth driver 2300 may include a rotating shaft member 2310, a first lifting member 2320, a second lifting member 2330, or a guide cover member 2450. The rotating shaft member 2310 may provide a central shaft that rotates using the rotational power transferred from the motor 2200. The rotating shaft member 2310 may serve as, e.g., a central shaft for rotating the first lifting member 2320.

According to an embodiment, the first lifting member 2320 may be coupled to be rotatable together with the rotating shaft member 2310. The first lifting member 2320 may be disposed to rotate together according to the rotating speed and the rotating direction of the rotating shaft member 2310. The first lifting member 2320 may be disposed not to vertically move with respect to, e.g., the rotating shaft member 2310. A thread coupling portion 2321 protruding outward may be formed on the outer circumferential surface of the first lifting member 2320.

According to an embodiment, the second lifting member 2330 may be coupled to be rotatable with respect to the first lifting member 2320. The second lifting member 2330 may be coupled to a lower portion of the first lifting member 2320. At least a portion of the first lifting member 2320 may be inserted into the hollow portion of the second lifting member 2330 to be coupled to each other. A thread 2331 may be formed on the surface of the hollow portion of the second lifting member 2330 (or the inner circumferential surface of the second lifting member 2330). The thread coupling portion 2321 of the first lifting member 2320 may be engaged with the thread 2331 of the second lifting member 2330 to move along the path of the thread 2331.

The second lifting member 2330 may include a rotational resistance member 2332. The rotational resistance member 2332 protruding outward may be provided on the outer circumferential surface of the second lifting member 2330. The rotational resistance member 2332 may have, e.g., an elastic material. The rotational resistance member 2332 may contact the circumferential protrusion 2110 of the housing 2100 according to the vertical movement of the second lifting member 2330. For example, in case that the second lifting member 2330 rises, the rotational resistance member 2332 may contact the inner circumferential surface of the circumferential protrusion 2110. In case that the rotational resistance member 2332 comes into contact with the inner circumferential surface of the circumferential protrusion 2110, a frictional force may be formed, and resistance to rotation of the second lifting member 2330 may be generated by the frictional force. In case that resistance occurs to the rotation of the second lifting member 2330, the first lifting member 2320 rotates relatively faster than the second lifting member 2330, and the thread coupling portion 2321 of the first lifting member 2320 moves along the thread 2331 of the second lifting member 2330. As the thread coupling portion 2321 moves, the second lifting member 2330 may be vertically moved.

For example, depending on the situation, the second lifting member 2330 may rotate together with the first lifting member 2320, may rotate relatively slowly compared to the first lifting member 2320, or may stop rotating while only the first lifting member 2320 rotates.

The second lifting member 2330 may be coupled to the second member 2420 of the cleaning cloth module 2400. The second member 2420 may be coupled to rotate together with, e.g., the second lifting member 2330.

According to an embodiment, the cleaning driver 2000 may include a cleaning cloth module 2400. The cleaning cloth P may be attached to the lower surface of the cleaning cloth module 2400. In case that the cleaning cloth drier 2300 and the cleaning cloth module 2400 are rotated by the operation of the motor 2200, the cleaning cloth P attached to the cleaning cloth module 2400 may also be rotated. The cleaning cloth P may be rotated in contact with the floor while the robot cleaner (e.g., the robot cleaner 100 of FIG. 1) moves to clean the floor.

According to an embodiment, the cleaning cloth module 2400 may include a first member 2410 and a second member 2420. The first member 2410 may be disposed above the second member 2420. The first member 2410 may be provided to be directly coupled or attached to the cleaning cloth P. The first member 2410 may vertically move with respect to the second member 2420. In case that the second member 2420 rotates while the rotation of the first member 2410 is stopped, the first member 2410 may be moved upward as the engagement between the first member 2410 and the second member 2420 is released. The first member 2410 may have, e.g., a disk shape as a whole.

A first elastic body 2430 may be provided between the second member 2420 and the second lifting member 2330. The first elastic body 2430 may be compressed, e.g., when the cleaning cloth module 2400 or the cleaning cloth P attached to the cleaning cloth module 2400 contacts the floor. For example, while the cleaning cloth P contacts the floor, the first elastic body 2430 may be compressed to generate an elastic repulsive force.

According to an embodiment, the cleaning cloth module 2400 may include a guide cover member 2450. An upper surface and a lower surface of the guide cover member 2450 may be opened, and an empty space may be provided therein. For example, the guide cover member 2450 may have a hollow cylindrical shape as a whole. For example, at least a portion of the second lifting member 2330 may be received in an empty space inside the guide cover member 2450. The guide cover member 2450 may be coupled to the second member 2420. The guide cover member 2450 may be vertically moved together with, e.g., the second lifting member 2330. The guide cover member 2450 may be rotated together with, e.g., the second member 2420.

According to an embodiment, the cleaning driver 2000 may include a separation driver 2500. The separation driver 2500 may be configured to receive rotational power from the motor 2200. The separation driver 2500 may include a stopper 2510 configured to vertically move according to the rotating direction. For example, by the operation of the motor 2200, the stopper 2510 may be raised or lowered according to the rotating direction of the motor 2200. For example, when the motor 2200 rotates in a first direction, the stopper 2510 may be raised. For example, when the motor 2200 rotates in a second direction opposite to the first direction, the stopper 2510 may be lowered. While the cleaning cloth module 2400 is rotated by the cleaning cloth driver 2300, the lowered stopper 2510 may be inserted into the stopper insertion hole 2413 of the first member 2410 of the cleaning cloth module 2400 to stop rotation of the first member 2410. Even if the rotation of the first member 2410 is stopped, the second member 2420 disposed thereunder may still be rotated by the cleaning cloth driver 2300. In other words, the second member 2420 may be rotated with respect to the first member 2410. In case that the second member 2420 is rotated with respect to the first member 2410, the first member 2410 is pushed upward by a second inclined portion (e.g., the second inclined portion 2422 of FIG. 23) to be described below, so that the gap between the first member 2410 and the second member 2420 may be increased. As a result, the cleaning cloth P attached to the attaching member 2411 of the first member 2410 may be separated from the first member 2410. An operation in which the robot cleaner 100 automatically replaces the cleaning cloth P is described below.

According to an embodiment, the cleaning cloth module 2400 may include a second elastic body 2440 disposed between the first member 2410 and the second member 2420. One side of the second elastic body 2440 may be fixed to the first member 2410. The other side of the second elastic body 2440 may be fixed to the second member 2420. The second elastic body 2440 may provide an elastic force in a direction in which the first member 2410 and the second member 2420 come in tight contact with each other. In case that the distance between the first member 2410 and the second member 2420 increases, the second elastic body 2440 may expand. The expanded second elastic body 2440 may be formed with a reaction force in a direction in which the expanded second elastic body 445 contracts, and thus a force may be applied in a direction in which the first member 2410 and the second member 2420 approach each other. For example, the expanded second elastic body 2440 may apply a force to pull the second member 2420 upward. For example, the expanded second elastic body 2440 may apply a force for pulling the first member 2410 downward. The second elastic body 2440 may have, e.g., a larger diameter than the first elastic body 2430. The second elastic body 445 may be, e.g., a torsion spring.

The separation driver 2500 may be disposed, e.g., through the lower surface of the housing 2100, but is not limited thereto. At least a portion of the separation driver 2500 may be received in the housing 2100.

The cleaning cloth driver 2300 and the separation driver 2500 may be configured to receive rotational power from one motor 2200 at the same time, but are not limited thereto. For example, the cleaning cloth driver 2300 and the separation driver 2500 may be independently driven with respect to each other by different motors. For example, the cleaning cloth driver 2300 may be configured to be rotated and vertically moved by rotation of the motor 2200, and the separation driver 2500 may be configured to vertically move in a solenoid manner.

Figure 21:
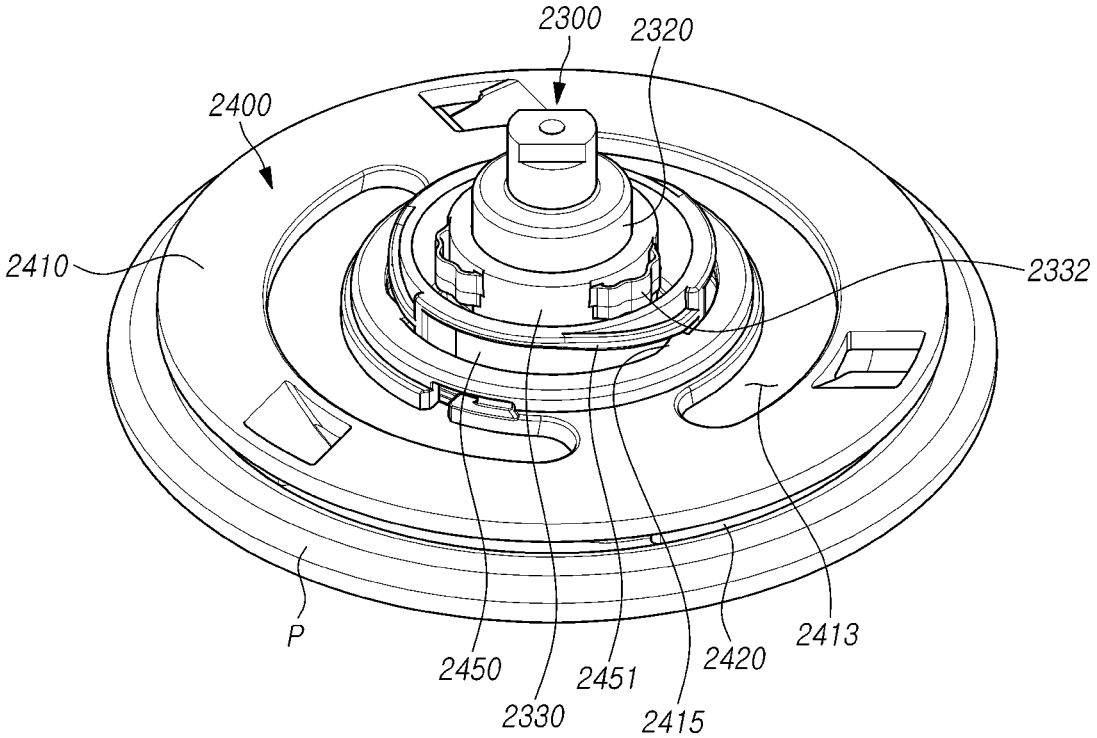
FIG. 21 is a view illustrating a cleaning cloth driver and a cleaning cloth module in a cleaning driver according to an embodiment.
Figure 22:
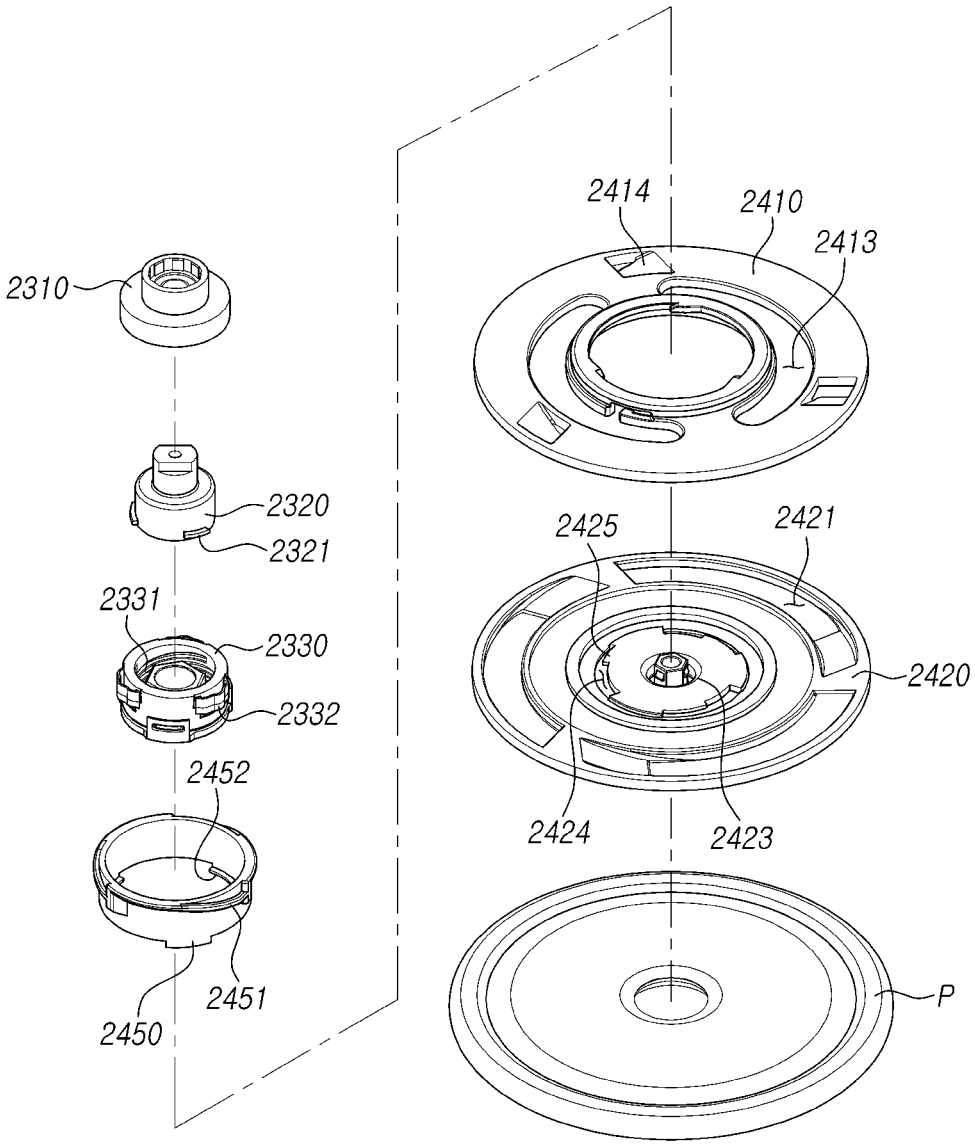
FIG. 22 is a top exploded perspective view illustrating a cleaning cloth driver and a cleaning cloth module according to an embodiment.
Figure 23:
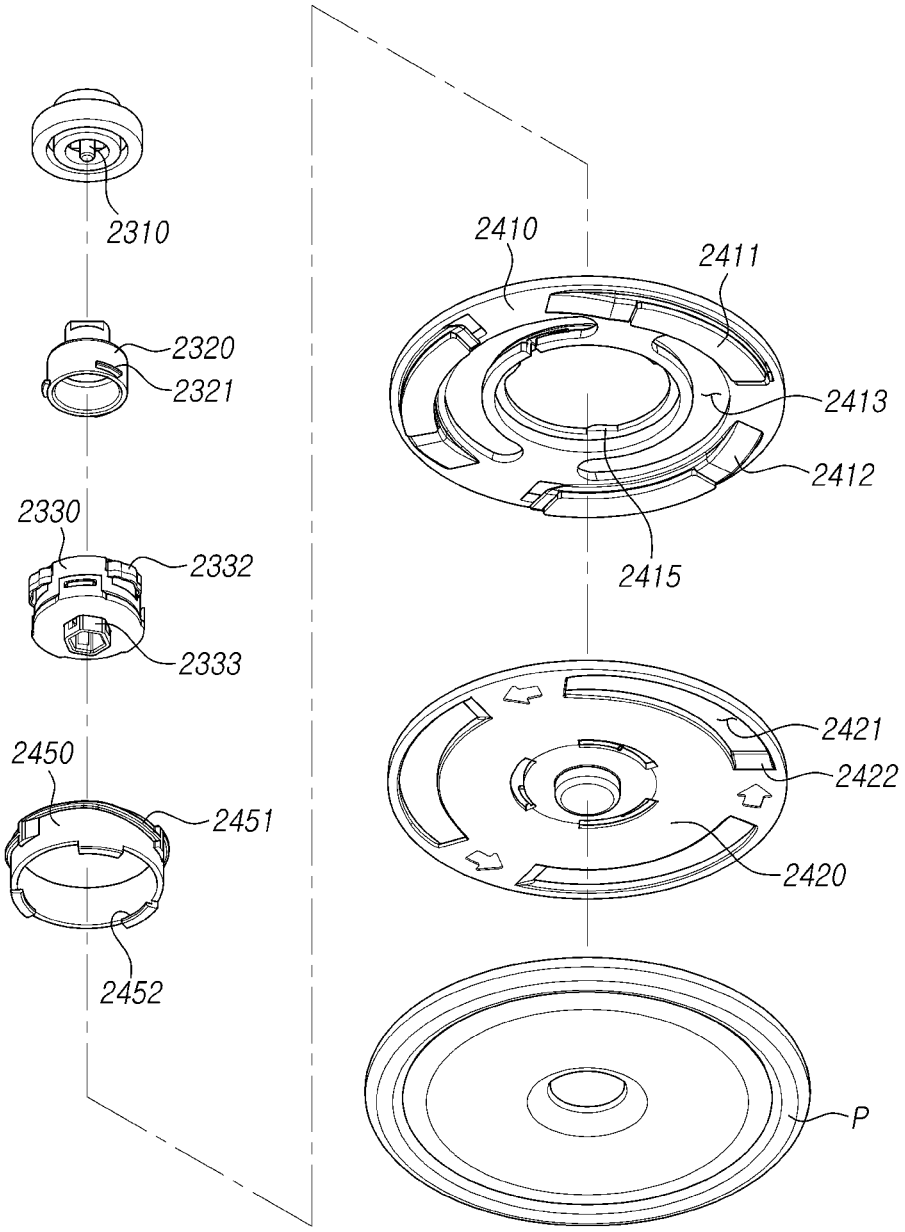
FIG. 23 is a bottom exploded perspective view illustrating a cleaning cloth driver and a cleaning cloth module according to an embodiment.

FIG. 21 is a view illustrating a cleaning cloth driver and a cleaning cloth module in a cleaning driver according to an embodiment. FIG. 22 is a top exploded perspective view illustrating a cleaning cloth driver and a cleaning cloth module according to an embodiment. FIG. 23 is a bottom exploded perspective view illustrating a cleaning cloth driver and a cleaning cloth module according to an embodiment.

The cleaning cloth driver 2300 and the cleaning cloth module 2400 illustrated in FIGS. 21 to 23 may be substantially the same in configuration as the cleaning cloth driver 2300 and the cleaning cloth module 2400 illustrated in FIG. 20. The structure and shape of the cleaning cloth driver 2300 and the cleaning cloth module 2400 illustrated in FIGS. 21 to 23 are exemplary, and the disclosure is not limited thereto. Hereinafter, descriptions of duplicate configurations will be omitted.

According to an embodiment, the first member 2410 may include an attaching member 2411, a first inclined portion 2412, a stopper insertion hole 2413, or a rotating member coupling portion 2414.

According to an embodiment, the attaching member 2411 may be provided to be coupled to the cleaning cloth P. The attaching member 2411 may be positioned on a lower surface of the first member 2410. The attaching member 2411, e.g., may have an arc shape as a whole. For example, a plurality of attaching members 2411 may be provided to be spaced apart from each other along the circumferential direction of the first member 2410. The attaching member 2411 may be, e.g., a magnet or Velcro, but is not limited thereto, and various types of attachment structures may be applied. The attaching member 2411 may protrude downward of the first member 2410 to be attached to the cleaning cloth P through, e.g., the second member 2420.

According to an embodiment, the first inclined portion 2412 may be formed to protrude from the first member 2410. The first inclined portion 2412 may protrude to a lower surface of the first member 2410. The first inclined portion 2412 may be disposed adjacent to, e.g., the attaching member 2411. The first inclined portion 2412 may be positioned near an end portion of the attaching member 2411. The first inclined portion 2412 and the attaching member 2411 may be positioned adjacent to each other and may have an arc shape as a whole.

According to an embodiment, the stopper insertion hole 2413 may have an arc shape. The stopper insertion hole 2413 may be a portion into which the stopper 2510, which is described below, moves downward and is inserted. The stopper insertion hole 2413 may be positioned closer to the central portion of the first member 2410 than the first inclined portion 2412 or the attaching member 2411, but is not limited thereto.

According to an embodiment, the rotating member coupling portion 2414 may be a portion into which a portion of the second member 2420 is inserted when the first member 2410 is coupled to the second member 2420. As a portion of the second member 2420 is inserted into the rotating member coupling portion 2414, the first member 2410 and the second member 2420 may be separably coupled or brought in tight contact with each other. The first member 2410 may be rotated together with the second member 2420 as the second member 2420 is inserted into the rotating member coupling portion 2414.

According to an embodiment, the first member 2410 may include a stop protrusion 2415 protruding from the inner circumferential surface toward the central portion. The stop protrusion 2415 may be disposed to be stuck to the inclined guide portion 2451 of the guide cover member 2450. The stop protrusion 2415 may move, e.g., along the inclined guide portion 2451 while the first member 2410 is separated from the second member 2420 and moved upward or downward to be coupled with the second member 2420.

According to an embodiment, the second member 2420 may include an opening 2421 or a second inclined portion 2422. The second inclined portion 2422 may be positioned adjacent to, e.g., the opening 2421. The second inclined portion 2422 and the opening 2421 may be positioned adjacent to each other and may have an arc shape as a whole. The second inclined portion 2422 may be, e.g., a portion inserted into the rotating member coupling portion 2414 of the first member 2410.

According to an embodiment, the opening 2421 may be disposed at a position corresponding to the attaching member 2411. The opening 2421 may have, e.g., an arc shape as a whole. In a state in which the first member 2410 and the second member 2420 are coupled, the attaching member 2411 and the first inclined portion 2412 of the first member 2410 may be seated in the opening 2421 of the second member 2420. The first member 2410 and the second member 2420 may be coupled such that, e.g., the opening 2421 and the attaching member 2411 overlap each other. The first member 2410 and the second member 2420 may be coupled such that, e.g., a portion of the opening 2421 and the first inclined portion 2412 overlap each other. In case that the first member 2410 and the second member 2420 are coupled or brought in tight contact, the first inclined portion 2412 may be positioned in the opening 2421. The attaching member 2411 may be coupled to or attached to the cleaning cloth P through the opening 2421. In case that the distance between the first member 2410 and the second member 2420 increases, the attaching member 2411 and the cleaning cloth P may also be spaced apart from each other so that the cleaning cloth P may be separated from the cleaning cloth module 2400.

According to an embodiment, the guide cover member 2450 may include a rotating member stop portion 2452 protruding downward. The rotating member stop portion 2452 may be formed, e.g., as a lower end portion is bent inward. When the portion bent inward of the guide cover member 2450 is coupled to the second member 2420, it may serve to allow it to be stuck thereto. The guide cover member 2450 and the second member 2420 may be coupled to each other as the rotating member stop portion 2452 is inserted into the guide cover member insertion hole 2424 of the second member 2420 and is then rotated in one direction to be stuck to the stop jaw 2425.

According to an embodiment, the second lifting member 2330 may include a rotating member coupling portion 2414 provided at a lower portion thereof to be coupled to the second member 2420. As the rotating member insertion portion 2333 is inserted into and fixed to the insertion recess 2423 positioned near the center of the second member 2420, the second lifting member 2330 and the second member 2420 may be coupled to each other.

Figure 24:
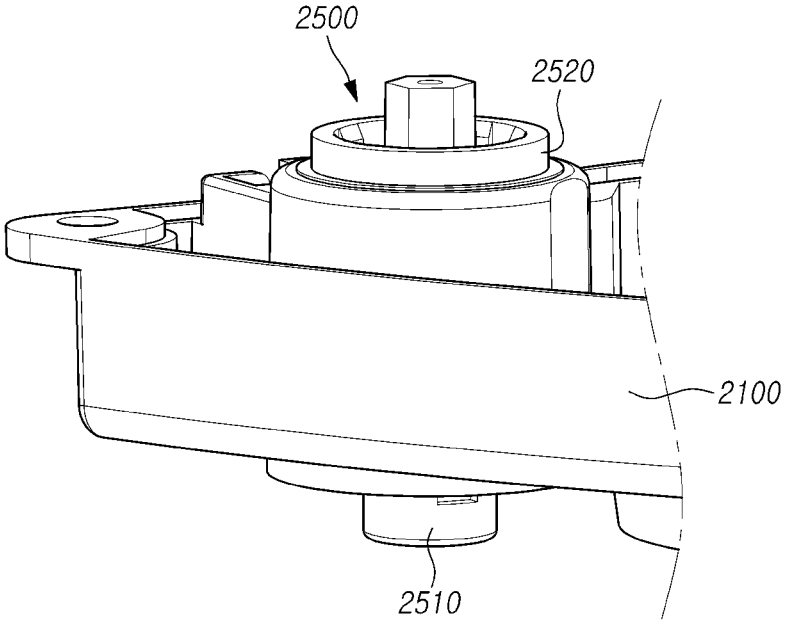
FIG. 24 is a view illustrating a separation driver in a cleaning driver according to an embodiment.
Figure 25:
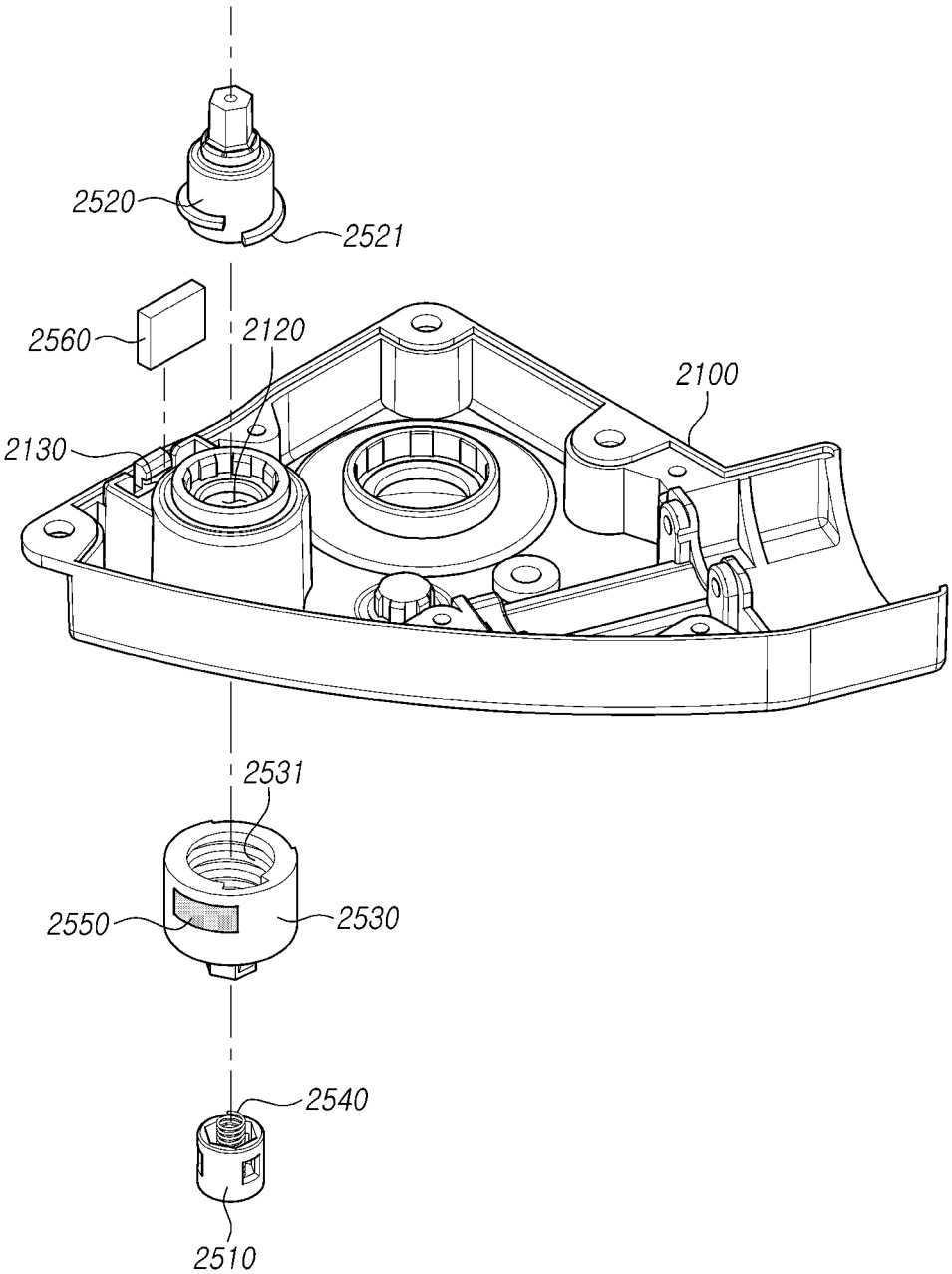
FIG. 25 is an exploded perspective view illustrating a separation driver in a cleaning driver according to an embodiment.

FIG. 24 is a view illustrating a separation driver in a cleaning driver according to an embodiment. FIG. 25 is an exploded perspective view illustrating a separation driver in a cleaning driver according to an embodiment.

The separation driver 2500 illustrated in FIGS. 24 and 25 may be substantially the same in configuration as the separation driver 2500 illustrated in FIG. 20. The structure and shape of the separation driver 2500 illustrated in FIGS. 24 and 25 are exemplary, and the disclosure is not limited thereto.

According to an embodiment, the separation driver 2500 may include all or some of the stopper 2510, the third lifting member 2520, the fourth lifting member 2530, the third elastic body 2540, the first magnetic body 2550, and the second magnetic body 2560.

According to an embodiment, the third lifting member 2520 may be provided to be rotated by receiving rotational power from a motor (e.g., the motor 2200 of FIG. 20). The third lifting member 2520 may be disposed, e.g., in the inner space of the housing 2100. The fourth lifting member 2530 may be coupled to the lower portion of the third lifting member 2520. A thread coupling portion 2521 protruding outward may be formed on the outer circumferential surface of the third lifting member 2520.

According to an embodiment, the fourth lifting member 2530 may be coupled to the third lifting member 2520. The fourth lifting member 2530 may have a cylindrical appearance. The fourth lifting member 2530 may have a space in which at least a portion of the upper surface thereof is opened and at least a portion of the third lifting member 2520 is received therein. A thread 2531 may be formed on the surface of the inner space of the fourth lifting member 2530 (or an inner circumferential surface of the fourth lifting member 2530). As the thread coupling portion 2521 of the third lifting member 2520 is engaged with the thread 2531 of the fourth lifting member 2530, the third lifting member 2520 and the fourth lifting member 2530 may be coupled to each other. For example, at least a portion of the fourth lifting member 2530 may be received in the receiving portion 2120.

According to an embodiment, the first magnetic body 2550 may be provided on a portion of the outer circumferential surface of the fourth lifting member 2530. According to an embodiment, the second magnetic body 2560 may be received in the magnetic body receiving portion 2130 of the housing 2100. The magnetic body receiving portion 2130 may be positioned adjacent to, e.g., the receiving portion 2120. The first magnetic body 2550 and the second magnetic body 2560 may form magnetic forces that attract each other. Rotational resistance may be generated in the fourth lifting member 2530 by magnetic forces of the first magnetic body 2550 and the second magnetic body 2560. In case that a rotational resistance is generated in the fourth lifting member 2530, the third lifting member 2520 coupled to the fourth lifting member 2530 may be rotated relatively correctly. As a result, the thread coupling portion 2521 of the third lifting member 2520 may move along the thread 2531, so that the fourth lifting member 2530 may vertically move.

Selectively depending on the situation, the fourth lifting member 2530 may rotate together with the third lifting member 2520, rotate slower than the third lifting member 2520, or stop rotating while the third lifting member 2520 rotates.

According to an embodiment, the third elastic body 2540 may be provided between the fourth lifting member 2530 and the stopper 2510. The third elastic body 2540 may be formed to be compressed when the stopper 2510 comes into contact with the upper surface of the first member 2410 rather than the stopper insertion hole 2413 of the first member 2410 while the stopper 2510 is lowered. The third elastic body 2540 may prevent the first member 2410 from being pressed downward and damaged when the stopper 2510 contacts the upper surface of the first member 2410.

FIGS. 26A, 26B, 26C, 26D, and 26E are views illustrating a process in which a cleaning driver automatically attaches and detaches a cleaning cloth according to an embodiment.

FIGS. 26A to 26E are views for describing the operation of the cleaning driver 2000 illustrated in FIG. 20. Hereinafter, descriptions of duplicate components will be omitted, and the operational relationship between components is described.

Figure 26A:
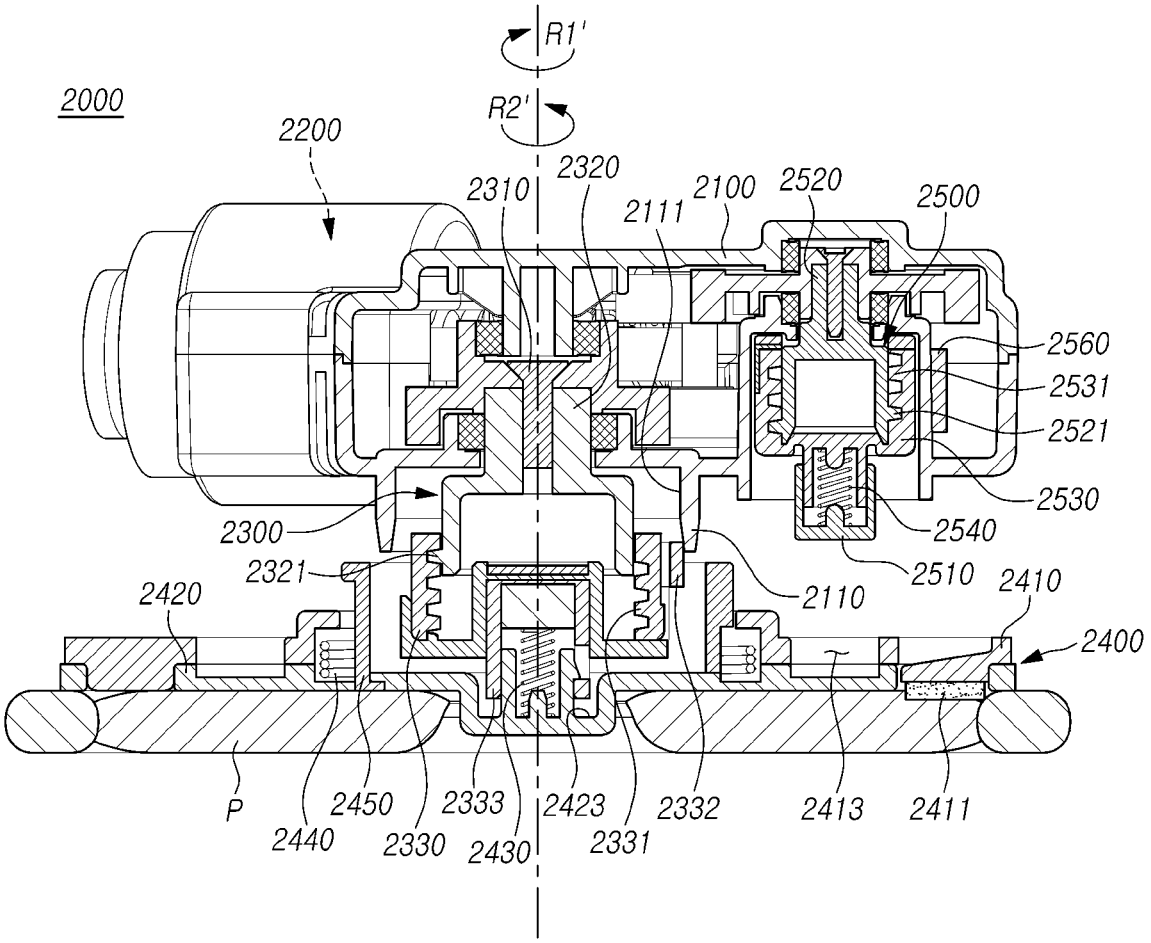
FIGS. 26A, 26B, 26C, 26D, and 26E are views illustrating a process in which a cleaning driver automatically attaches and detaches a cleaning cloth according to an embodiment.

Referring to FIG. 26A, the robot cleaner 100 may clean the floor by rotating the cleaning cloth module 2400 in the first direction R1. In case that the cleaning cloth module 2400 is rotated in the first direction R1, the cleaning cloth module 440 may be rotated while the cleaning cloth P comes in tight contact with the floor surface to clean the floor surface. As the cleaning cloth P comes in tight contact with the floor, the first elastic body 2430 may be maintained in a compressed state. An elastic repulsive force may be applied in a direction in which the second lifting member 2330 is moved upward by compression of the first elastic body 2430, but while the cleaning cloth module 2400 rotates in the first direction R1', the second lifting member 2330 may be prevented from rising by a coupling structure between the thread coupling portion 2321 of the first lifting member 2320 and the thread 2331 of the second lifting member 2330.

Figure 26B:
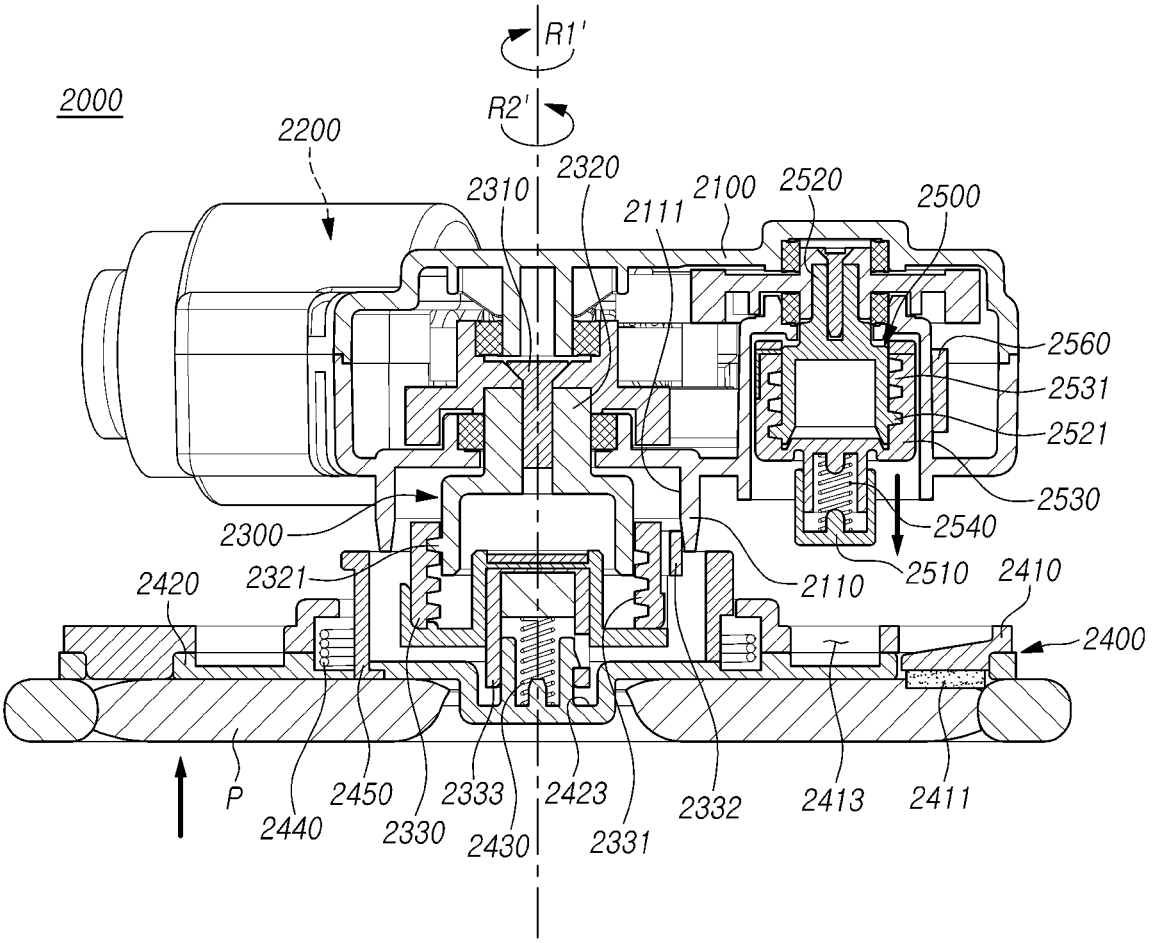

Referring to FIG. 26B, in case that it is determined that the cleaning cloth P needs to be replaced, the robot cleaner 100 may raise the cleaning cloth module 2400. For example, the robot cleaner 100 may determine whether the cleaning cloth P needs to be replaced based on the degree of contamination of the cleaning cloth P identified using a contamination level sensor (not shown). For example, the robot cleaner 100 may determine whether it is necessary to replace the cleaning cloth P based on the time used for cleaning the floor of the cleaning cloth P.

The robot cleaner 100 may raise the cleaning cloth module 2400 while lowering the stopper 2510 of the separation driver 2500. In this case, the speed at which the cleaning cloth module 2400 is raised may be faster than the speed at which the stopper 2510 is lowered. Even after the cleaning cloth module 2400 is moved upward to the maximum height, the stopper 2510 may be continuously lowered. In case that the robot cleaner 100 determines that the cleaning cloth P should be spaced apart from the floor during cleaning, the robot cleaner 100 may perform the operation of raising the cleaning cloth P. For example, the robot cleaner 100 may rotate the cleaning cloth module 2400 in the second direction R2' opposite to the first direction R1' to move the cleaning cloth module 2400 upward. At an initial stage when the cleaning cloth module 2400 is rotated in the second direction R2', as shown in FIG. 26B, the upward movement of the second lifting member 2330 starts due to the elastic repulsive force of the first elastic body 2430.

Figure 26C:
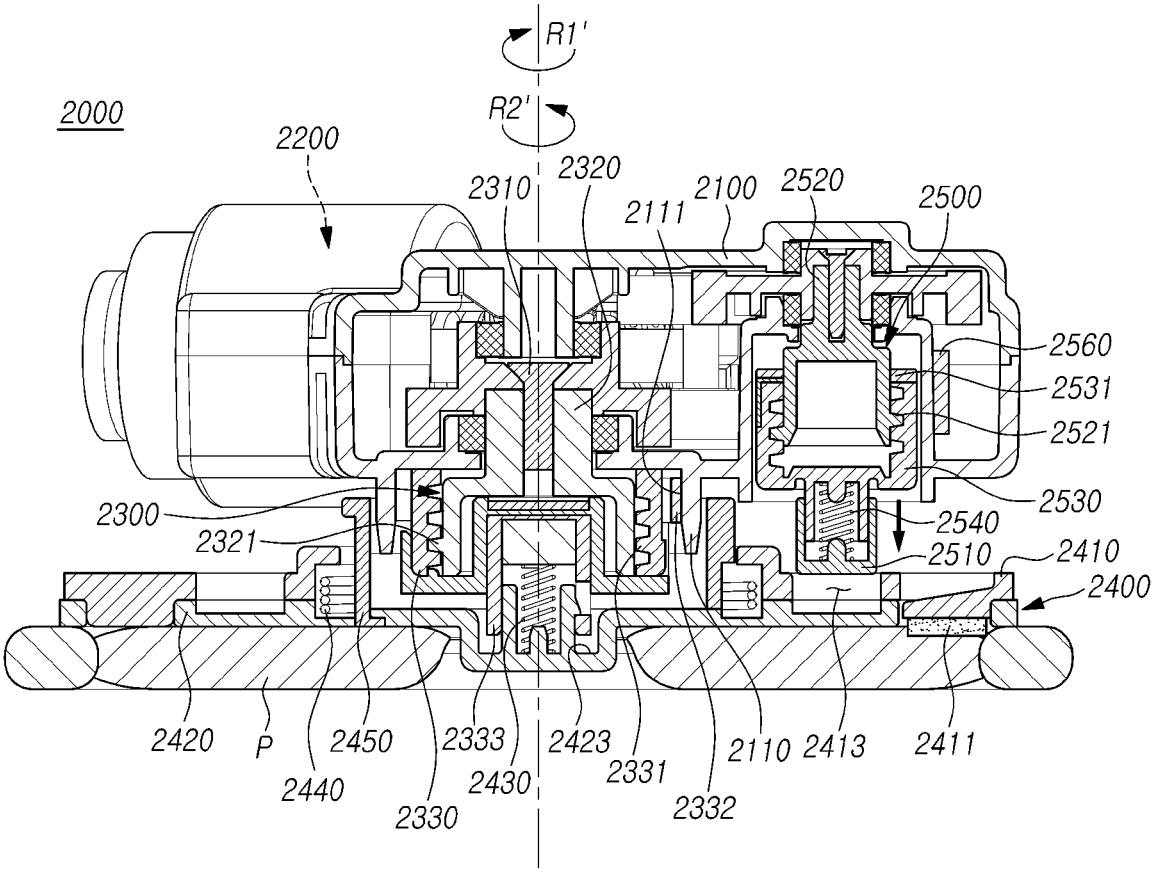

Referring to FIG. 26C, the second lifting member 2330 may be raised by the elastic repulsive force of the first elastic body 2430, so that the rotational resistance member 2332 may come in tight contact with the inner circumferential surface 2111 of the circumferential protrusion 2110 of the housing 2100, thereby generating a frictional force. Due to the frictional force, a rotational resistance may be generated in the second lifting member 2330, and the first lifting member 2320 may rotate relatively faster than the second lifting member 2330. As the first lifting member 2320 rotates relatively rapidly, the thread coupling portion 2321 of the first lifting member 2320 may move along the path of the thread 2331 of the second lifting member 2330, and as a result, the second lifting member 2330 may be lifted. While the second lifting member 2330 is raised, the stopper 2510 of the separation driver 2500 may move downward. As illustrated in FIG. 26C, even when the second lifting member 2330 is completely raised, the stopper 2510 may not be inserted into the stopper insertion hole 2413 of the first member 2410.

Figure 26D:
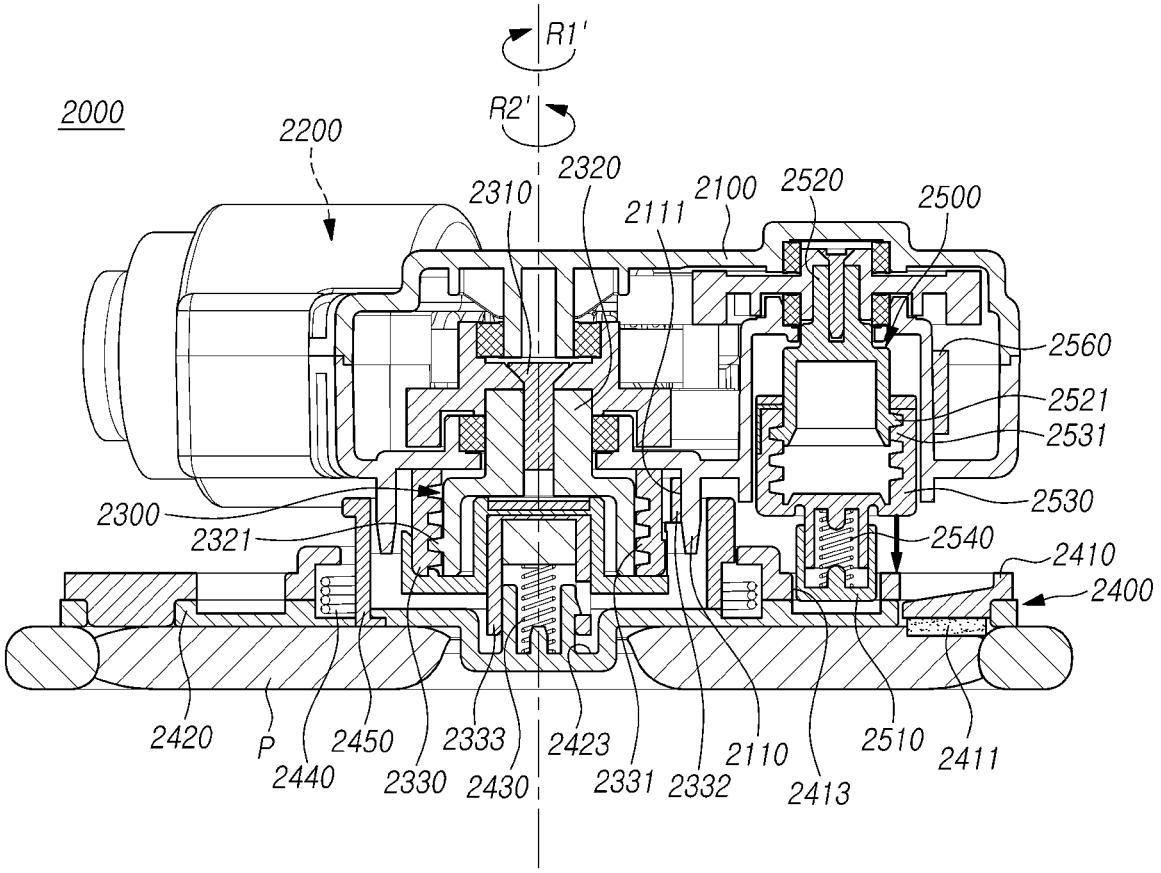

Referring to FIG. 26D, in a state in which the second lifting member 2330 is completely raised, the stopper 2510 may continue to move downward and may be inserted into the stopper insertion hole 2413 of the first member 2410. In this case, the cleaning cloth module 2400 may be continuously rotated in the second direction R2'.

Figure 26E:
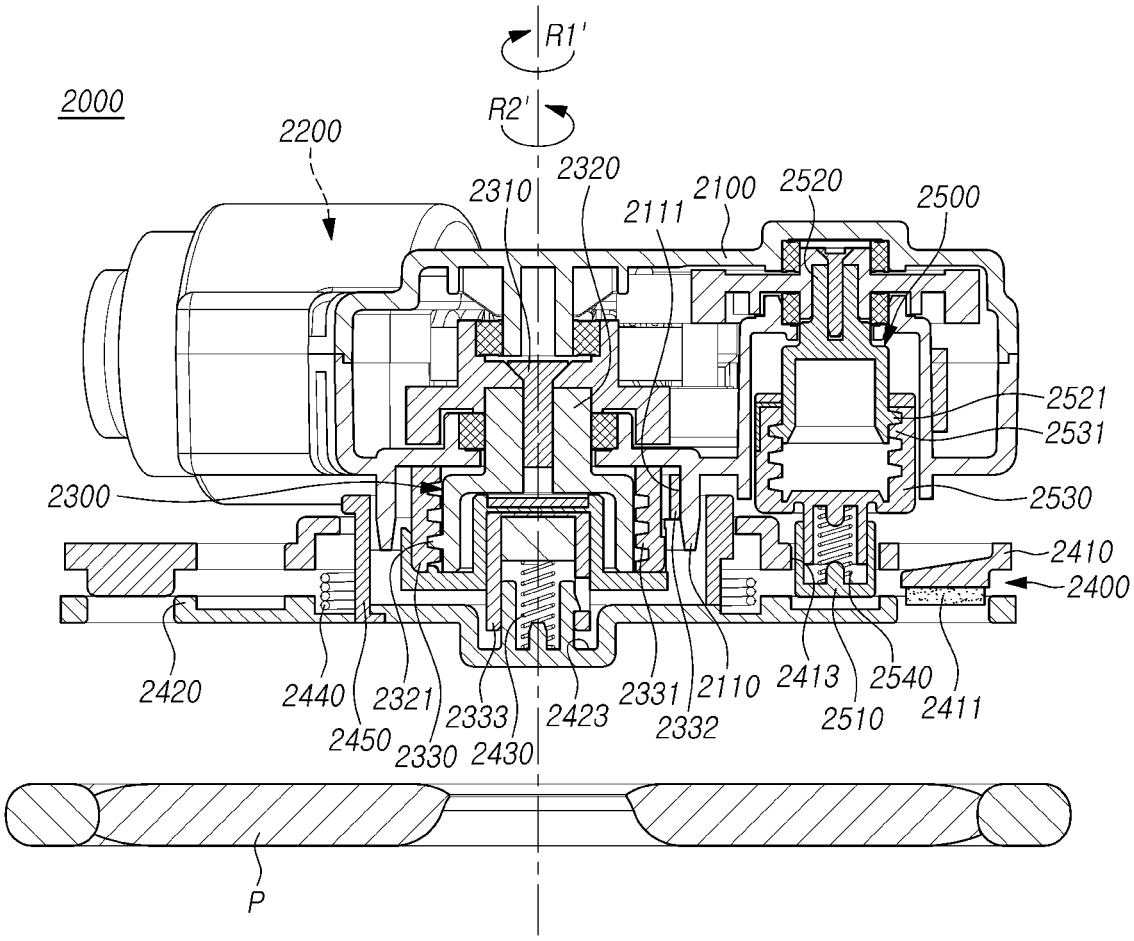

Referring to FIG. 26E, in case that the cleaning cloth module 2400 is rotated in the second direction R2' in a state in which the stopper 2510 is inserted into the stopper insertion hole 2413, the stopper 2510 may be stuck to the edge of the stopper insertion hole 2413, thereby stopping the rotation of the first member 2410. Only the second member 2420 may be rotated while the rotation of the first member 2410 is stopped, and as a result, the first member 2410 and the second member 2420 may be separated. In this case, the second member 2420 may be separated from the first member 2410 while the first member 2410 rises along the inclined guide portion 2451 of the guide cover member 2450 in a state in which the vertical movement is fixed. The description of FIGS. 11A, 11B, and 12 may be applied to the structure and operation in which the second member 2420 is rotated and separated while the first member 2410.

If the first member 2410 is separated by moving upward with respect to the second member 2420, the cleaning cloth P may be separated as it is spaced apart from the cleaning cloth P coupled to or attached to the first member 2410.

According to an embodiment, the robot cleaner 100 may lower the second lifting member 2330 and the cleaning cloth module 2400 in the reverse order of the process of separating the cleaning cloth P described above, and may couple the first member 2410 and the second member 2420 again to mount the new cleaning cloth P.

According to an embodiment, the cleaning cloth P may be separated from the cleaning cloth module 2400 by using only the operation of lowering the stopper 2510 of the separation driver 2500 without the lifting structure or process of the cleaning cloth module 2400. For example, even if the cleaning cloth module 2400 does not rise, the cleaning cloth P may be separated from the cleaning cloth module 2400 by lowering the stopper 2510 until the stopper 2510 is inserted into the stopper insertion hole 2413 of the first member 2410.

Figure 27A:
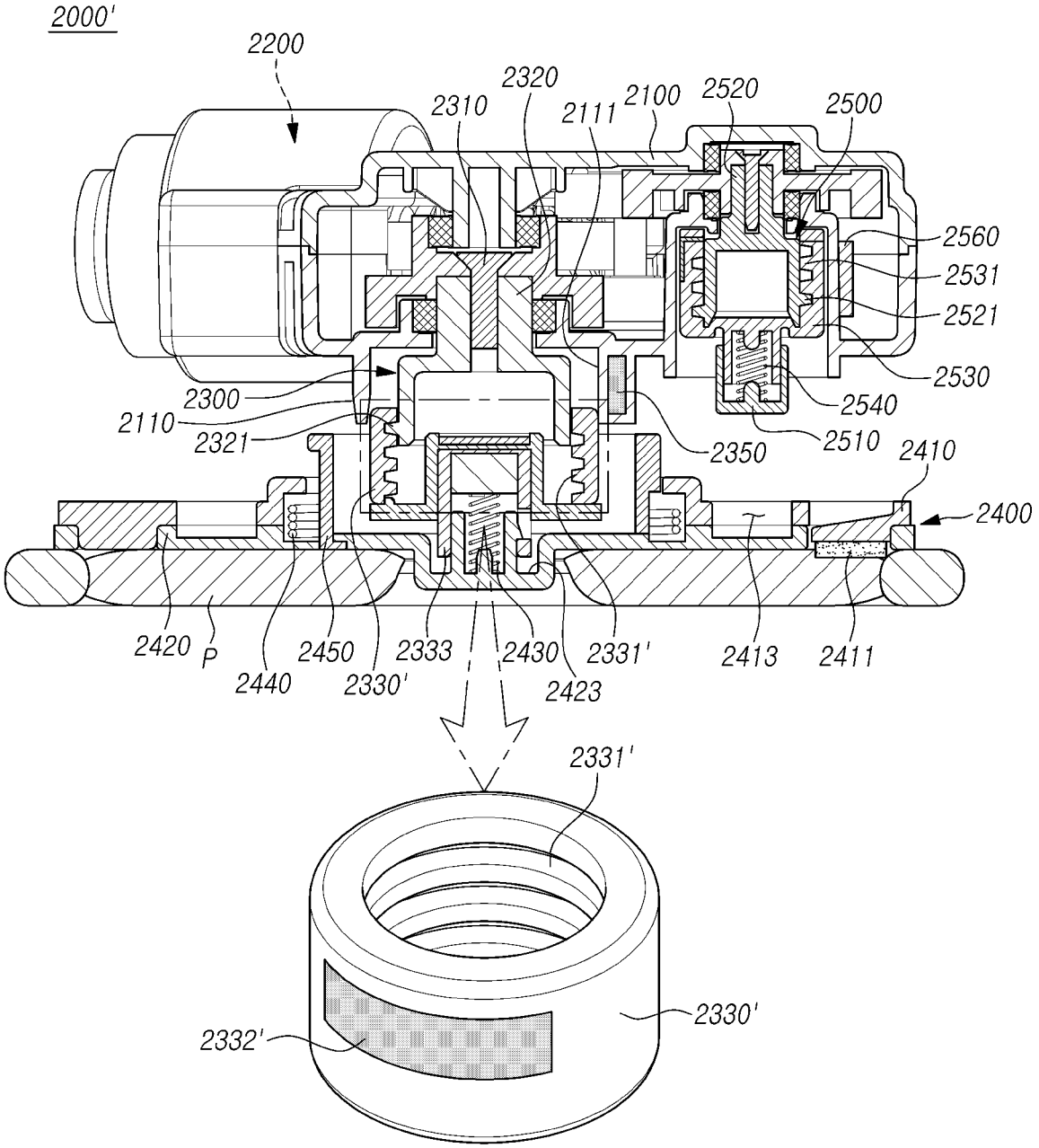
FIGS. 27A and 27B are views illustrating a cleaning driver having an anti-rotation member of a magnetic body according to an embodiment.
Figure 27B:
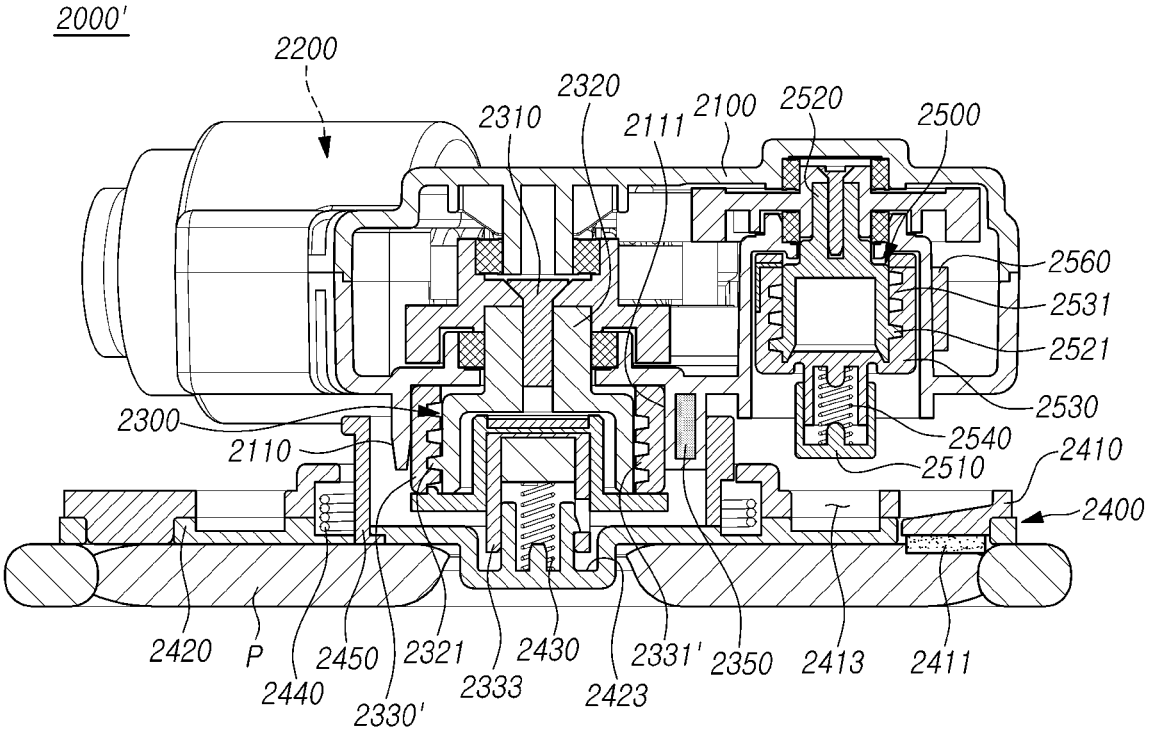

FIGS. 27A and 27B are views illustrating a cleaning driver having an anti-rotation member of a magnetic body.

Most components of the cleaning driver 2000' illustrated in FIGS. 27A and 27B are substantially the same as those of the cleaning driver 2000 illustrated in FIGS. 20 to 26E, except for the configuration of the second lifting member 2330'. The following description focuses primarily on the differences.

According to an embodiment, the cleaning driver 2000' may include a second lifting member 2330' rotatably coupled to a lower side of the first lifting member 2320. A thread 2331' for coupling with the first lifting member 2320 may be formed on an inner circumferential surface of the second lifting member 2330'. The second lifting member 2330' may include a rotational resistance member 2332' for generating a rotational resistance of the second lifting member 2330'. Unlike the embodiment illustrated in FIGS. 20 to 26E, the rotational resistance member 2332' may be a magnetic body. Resistance to rotation of the second lifting member 2330' may be generated by the magnetic force of the magnetic body.

According to an embodiment, the cleaning driver 2000' may include an additional magnetic body 2700 disposed around the circumferential protrusion 2110. The additional magnetic body 2700 may be received in the housing 2100. The additional magnetic body 2700 may generate an attractive force with the rotational resistance member 2332' to generate a resistance to rotation of the second lifting member 2330'.

Figure 28:
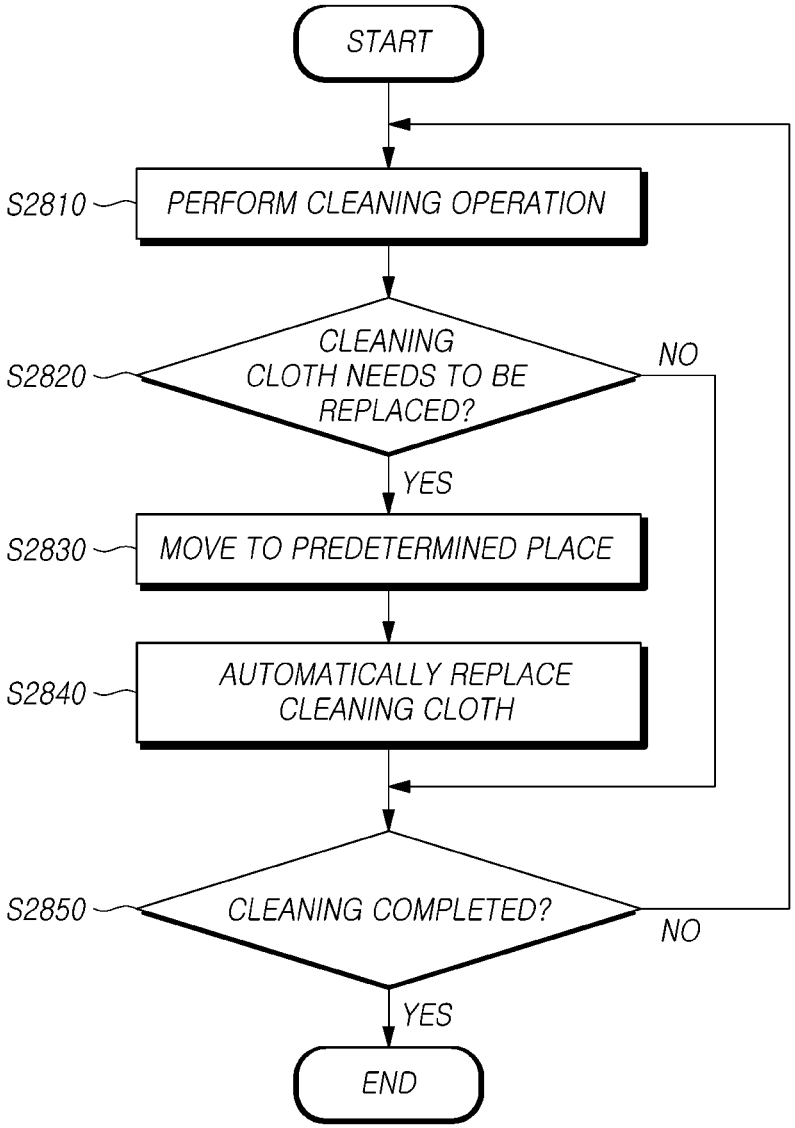
FIG. 28 is a flowchart illustrating a method for controlling the operation of a robot cleaner according to an embodiment.

FIG. 28 is a flowchart illustrating a method for controlling the operation of a robot cleaner according to an embodiment.

Referring to FIG. 28, the operation method of the robot cleaner 100 may include performing a cleaning operation (S2810). In an embodiment, while the cleaning operation is performed, the controller (e.g., the controller 350 of FIG. 3) may control the operation of the travel driver (e.g., the travel driver 361 of FIG. 3) to move the robot cleaner 100 along an appropriate driving path. In an embodiment, while the cleaning operation is performed, the controller 350 may control the operation of the cleaning driver (e.g., the cleaning driver 362 of FIG. 3, the cleaning driver 400 of FIG. 4, or the cleaning driver 2000 of FIG. 20) to rotate the cleaning cloth module (e.g., the cleaning cloth module 140 of FIG. 2, the cleaning cloth module 440 of FIG. 4, or the cleaning cloth module 2400 of FIG. 20) adjacent to the floor.

According to an embodiment, the operation method of the robot cleaner 100 may include determining whether the cleaning cloth P mounted on the cleaning cloth module 140, 440, or 2400 disposed adjacent to the floor, which is currently used for cleaning, should be replaced (S2820).

In an embodiment, such determination may be made by determining whether the degree of contamination of the cleaning cloth P is greater than or equal to a predetermined level by using a contamination sensor separately provided in the robot cleaner 100. In an embodiment, such determination may be made by the robot cleaner 100 determining, based on the timer information, whether the time when the cleaning of the floor using the pre-mounted cleaning cloth P is performed exceeds a reference. According to an embodiment, the robot cleaner 100 may determine whether it is necessary to replace the cleaning cloth by using the cleaning cloth replacement cycle set by the user. For example, in case that the user sets the cleaning cloth replacement cycle to 1 hour, the robot cleaner 100 may determine that the cleaning cloth P needs to be replaced, e.g., in case that it is determined that the use time of the pre-mounted cleaning cloth P reaches 1 hour.

According to an embodiment, in operation S2820, when it is determined that the cleaning cloth P needs to be replaced, the operation method of the robot cleaner 100 may include moving to a predetermined place to replace the cleaning cloth P (S2830). As an embodiment, the predetermined place may be, e.g., a place designated by the user. In an embodiment, the designated place may be a place where the robot cleaner 100 performs charging (e.g., the docking station 2100 of FIG. 29 or the docking station 2200 of FIG. 30) or a place adjacent thereto, but the disclosure is not limited thereto.

According to an embodiment, the operation method of the robot cleaner 100 may include automatically replacing the cleaning cloth P (S2840). The robot cleaner 100 may automatically replace the cleaning cloth P through the automatic cleaning cloth replacement process described with reference to FIGS. 16 to 19.

According to an embodiment, the operation method of the robot cleaner 100 may include determining whether cleaning is completed (S2850). For example, the robot cleaner 100 may determine whether cleaning is completed by determining various termination conditions such as the user's termination command or completion of cleaning of a preset cleaning area. When it is determined that the cleaning is not completed, the robot cleaner 100 may return to operation S2810 and perform the process after operation S2810 again. After completing the predetermined cleaning schedule, the robot cleaner 100 may determine that the cleaning has been completed and end the operation. According to an embodiment, the process of determining whether cleaning is completed may be performed between the above-described processes.

Figure 29:
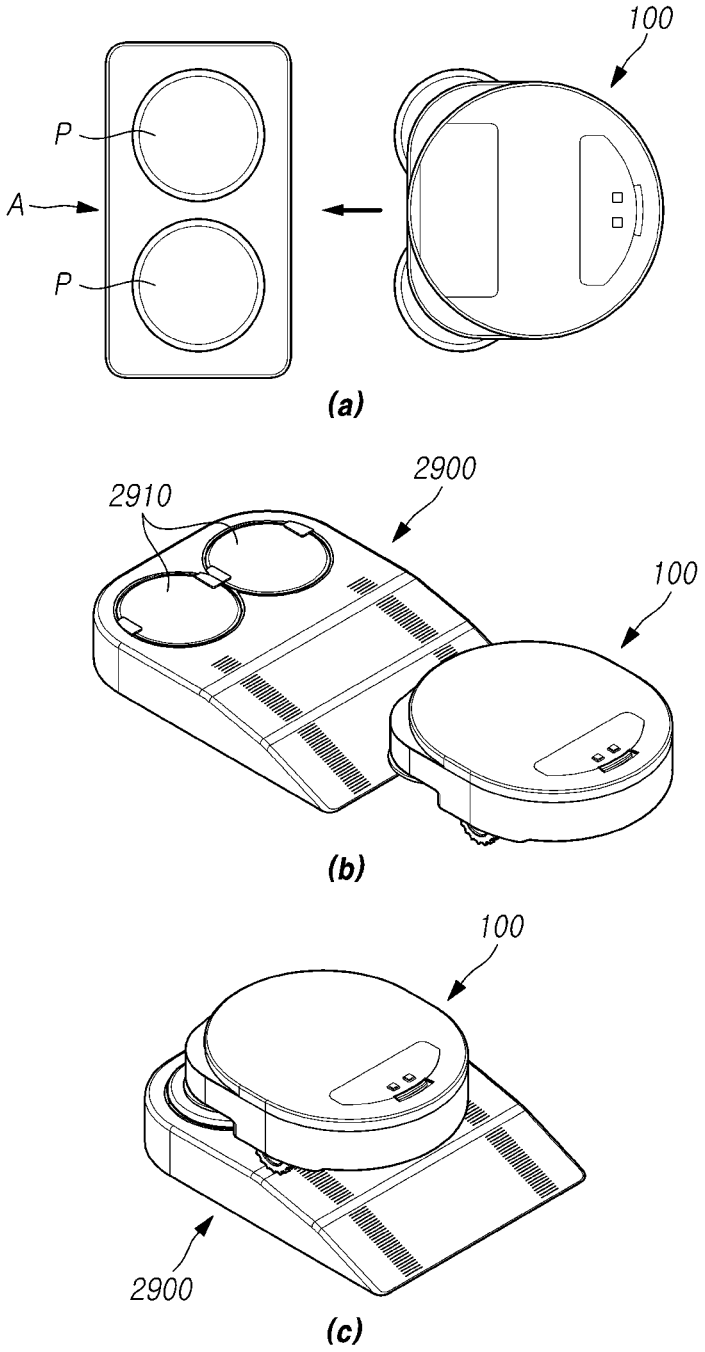
FIG. 29 is a view illustrating a process in which a robot cleaner attaches and detaches a cleaning cloth at a predetermined position according to an embodiment.
Figure 30:
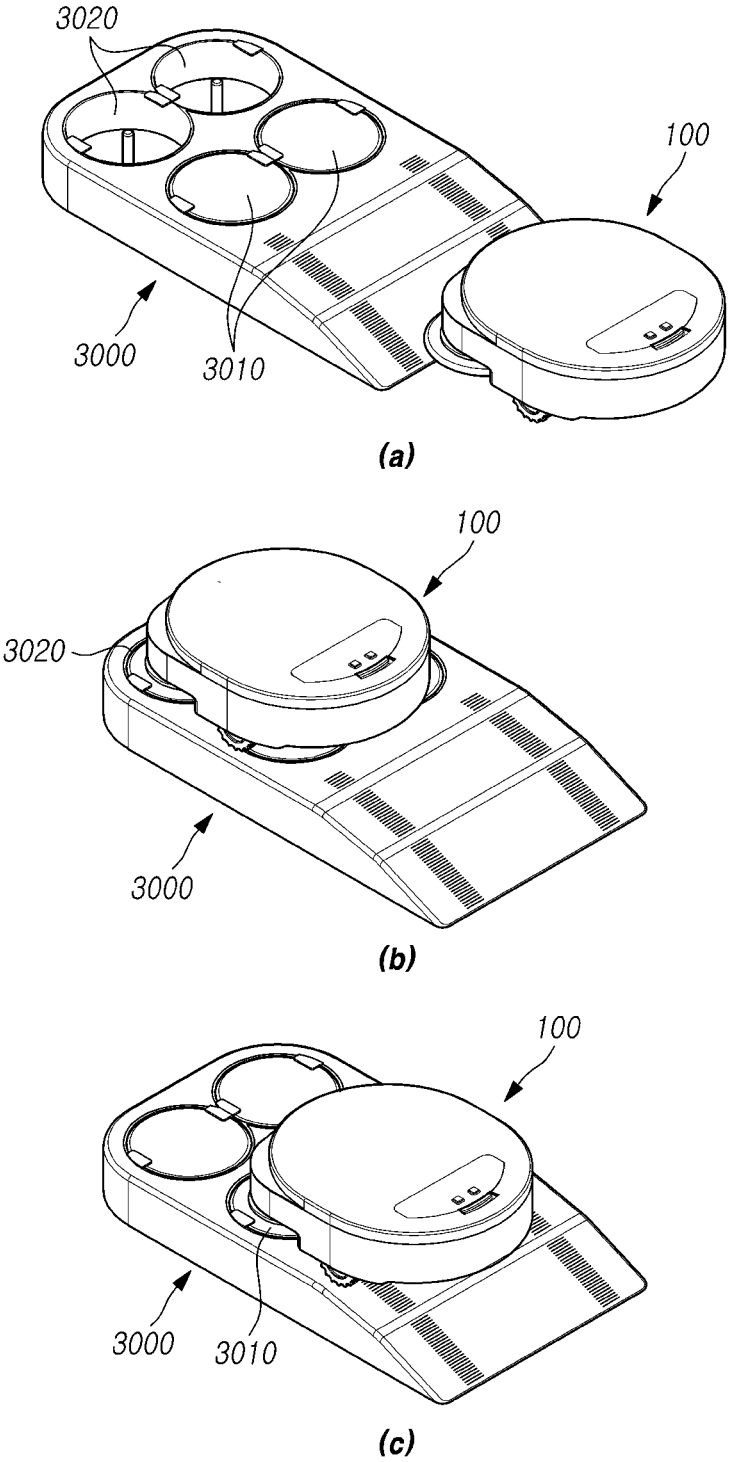
FIG. 30 is a view illustrating a process in which a robot cleaner attaches and detaches a cleaning cloth on a docking station according to an embodiment.

FIG. 29 is a view illustrating a process in which a robot cleaner attaches and detaches a cleaning cloth at a predetermined position according to an embodiment. FIG. 30 is a view illustrating a process in which a robot cleaner attaches and detaches a cleaning cloth on a docking station according to an embodiment.

As illustrated in FIG. 29(*a*), in an embodiment, when it is determined that the cleaning cloth needs to be replaced by the control method described above with reference to FIG. 28, the robot cleaner 100 may move to position A set by the user, such as a place next to the bathroom or a place in front of the laundry room, and then perform the operation of detaching the cleaning cloth P described above to detach the used cleaning cloth P.

Thereafter, as illustrated in (b) of FIG. 29 and (c) of FIG. 29, the robot cleaner 100 may move to the docking station 2900 having a cleaning cloth supply unit 2910 in which the new cleaning cloth P is received, may be positioned at a predetermined position, and may lower the rotating member (e.g., the rotating member 141 of FIG. 2, the second member 443 of FIG. 4, and the second member 2420 of FIG. 20) to mount the new cleaning cloth P to the cleaning cloth module (e.g., the cleaning cloth module 140 of FIG. 2, the cleaning cloth module 440 of FIG. 4, and the cleaning cloth module 2400 of FIG. 20). Thereafter, the robot cleaner 100 may leave the docking station 2900 and resume cleaning.

Unlike FIG. 29, referring to FIG. 30, the robot cleaner 100 may perform both detaching and mounting of the cleaning cloth at the docking station 3000. In an embodiment, when it is determined that the cleaning cloth needs to be replaced by the control method described above with reference to FIG. 28, the robot cleaner 100 may move to the docking station 3000 integrally equipped with the cleaning cloth supply unit 3010 in which the new cleaning cloth P is received and the cleaning cloth collector 3020 for collecting the used cleaning cloth P. According to an embodiment, as illustrated in FIG. 30(*a*), the cleaning cloth collector 3020 may be positioned downstream of the cleaning cloth supply unit 3010 with respect to the entry direction of the robot cleaner 100 toward the docking station 3000, but the disclosure is not limited thereto.

As illustrated in FIG. 30(*b*), the robot cleaner 100 reaching the docking station 3000 may be positioned in place on the cleaning cloth collector 3020 and then perform the above-described operation of detaching the cleaning cloth P to separate the cleaning cloth P from the cleaning cloth module 140, 440, or 2400. In an embodiment, the cleaning cloth P separated from the cleaning cloth module 140, 440, or 2400 may be received in the cleaning cloth collector 3020.

Thereafter, as illustrated in FIG. 30(*c*), the robot cleaner 100 may move backward and be positioned in place on the cleaning cloth supply unit 3010, and then perform the above-described operation of mounting the cleaning cloth P to attach the new cleaning cloth P supplied from the cleaning cloth supply unit 3010 to the cleaner module 140, 440, or 2400. Thereafter, the robot cleaner 100 may leave the docking station 3000 and resume cleaning.

According to an embodiment of the disclosure, the robot cleaner may automatically replace the cleaning cloth on its own without the user's intervention, enhancing user convenience.

The terms as used herein are provided merely to describe some embodiments thereof, but are not intended to limit the disclosure. As used herein, the singular forms "a," "an," and "the" are intended to include the plural forms as well, unless the context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, the term 'and/or' should be understood as encompassing any and all possible combinations by one or more of the enumerated items. As used herein, the terms "include," "have," and "comprise" are used merely to designate the presence of the feature, component, part, or a combination thereof described herein, but use of the term does not exclude the likelihood of presence or adding one or more other features, components, parts, or combinations thereof. As used herein, the terms "first" and "second" may modify various components regardless of importance and/or order and are used to distinguish a component from another without limiting the components.

As used herein, the terms "configured to" may be interchangeably used with the terms "suitable for," "having the capacity to," "designed to," "adapted to," "made to," or "capable of" depending on circumstances. The term "configured to" does not essentially mean "specifically designed in hardware to." Rather, the term "configured to" may mean that a device can perform an operation together with another device or parts. For example, a 'device configured (or set) to perform A, B, and C' may be a dedicated device to perform the corresponding operation or may mean a general-purpose device capable of various operations including the corresponding operation.

Meanwhile, the terms "upper side", "lower side", and "front and rear directions" used in the disclosure are defined with respect to the drawings, and the shape and position of each component are not limited by these terms.

In the disclosure, the above-described description has been made mainly of specific embodiments, but the disclosure is not limited to such specific embodiments, but should rather be appreciated as covering all various modifications, equivalents, and/or substitutes of various embodiments.

What is claimed is:

1. A robot cleaner comprising:

a housing;

a motor in the housing;

a separation driver including a stopper configured to vertically move up and down; and a cleaning cloth module including:

a first member including:

a stopper insertion hole into which the stopper is insertable, and an attaching member to which a cleaning cloth is detachably couplable, and a second member configured to be rotated by the motor, and positioned between the first member and the cleaning cloth to be coupled and separably coupled with the first member, wherein while the cleaning cloth module is rotated with the second member coupled to the first member, when the stopper vertically moves down so as to be inserted into the stopper insertion hole, the first member is stopped by the stopper from being rotated, then separated from the second member to separate the cleaning cloth from the first member.

2. The robot cleaner of claim 1, wherein the separation driver is configured to be rotated by the motor to vertically move up and down according to a rotating direction of the motor.

3. The robot cleaner of claim 2, wherein the separation driver includes:

a rotating member having a thread coupling portion protruding from an outer circumferential surface of the rotating member, and rotated by rotational power from the motor, and the thread coupling portion is configured to be engaged with a thread around the rotating member to be moved along a path of the thread when the rotating member is rotated to vertically move the stopper.

4. The robot cleaner of claim 1, wherein the separation driver includes an actuator to vertically move the stopper.

5. The robot cleaner of claim 4, wherein the actuator operates in a solenoid manner.

6. The robot cleaner of claim 1, wherein the first member includes a first inclined portion protruding from a lower surface of the first member.

7. The robot cleaner of claim 6, wherein when rotation of the first member is stopped by the stopper, the second member is slid along an inclined surface of the first inclined portion to separate the second member from the first member.

8. The robot cleaner of claim 6, wherein the first inclined portion is inclined toward an end portion of the attaching member.

9. The robot cleaner of claim 1, further comprising:

a cleaning cloth driver coupled to the cleaning cloth module to transfer rotational power of the motor to the cleaning cloth module, and configured to vertically move selectively depending on a rotating direction of the motor.

10. The robot cleaner of claim 9, wherein when the cleaning cloth driver is raised to a maximum height, the stopper is inserted into the stopper insertion hole.

11. The robot cleaner of claim 9, wherein when a cleaning cloth is detachably coupled to the attaching member, and the cleaning cloth contacts a surface to be cleaned, and the cleaning cloth driver is rotated in a first direction by the motor, the cleaning cloth is rotated while contacting the surface to be cleaned, and when the cleaning cloth driver is rotated in a second direction opposite to the first direction by the motor, the cleaning cloth driver is moved upward.

12. The robot cleaner of claim 11, wherein when the cleaning cloth driver has been moved upward, and the cleaning cloth driver is rotated in the first direction by the motor, the cleaning cloth driver is moved downward.

13. The robot cleaner of claim 9, wherein the cleaning cloth driver includes:

a first lifting member configured to rotate about a rotational axis and not to vertically move, and a second lifting member between the first lifting member and the second member and configured to vertically move with respect to the first lifting member.

14. The robot cleaner of claim 13, wherein the second lifting member includes a rotational resistance member protruding outward from an outer circumferential surface of the second lifting member, and the rotational resistance member contacts a portion of the housing when the second lifting member is raised, to provide resistance to rotational motion of the second lifting member.

15. The robot cleaner of claim 14, wherein the rotational resistance member is an elastic material.

16. The robot cleaner of claim 13, wherein a magnetic body is disposed in a portion adjacent to the second lifting member in the housing, the second lifting member includes a rotational resistance member having magnetism disposed on an outer circumferential surface of the second lifting member, and the rotational resistance member provides resistance to rotational motion of the second lifting member by a magnetic force generated in the magnetic body in the housing when the second lifting member is raised.

17. The robot cleaner of claim 1, further comprising:

a gear assembly in the housing to transfer rotational power of the motor to the cleaning cloth module and the separation driver.

18. The robot cleaner of claim 1, wherein the cleaning cloth module includes a first elastic body configured to be compressed when a cleaning cloth is detachably coupled to the attaching member, and the cleaning cloth contacts a surface to be cleaned, to provide a repulsive force upward.

19. The robot cleaner of claim 18, wherein the cleaning cloth module includes a second elastic body between the first member and the second member to provide a force in a direction of bringing the first member and the second member into contact with each other.

20. The robot cleaner of claim 1, further comprising:

a controller configured to control an overall operation of the robot cleaner, wherein the controller determines, when a cleaning cloth is detachably coupled to the attaching member, that the cleaning cloth needs to be replaced when a use time of the cleaning cloth exceeds a preset time.

* * * * *